US008172729B2

(12) United States Patent
Ellis

(10) Patent No.: US 8,172,729 B2
(45) Date of Patent: May 8, 2012

(54) EXERCISE TREADMILL FOR SIMULATING PUSHING AND PULLING ACTIONS AND EXERCISE METHOD THEREFOR

(76) Inventor: Joseph K. Ellis, Ocala, FL (US)

( * ) Notice: Subject to any disclaimer, the term of this patent is extended or adjusted under 35 U.S.C. 154(b) by 45 days.

(21) Appl. No.: 12/716,066

(22) Filed: Mar. 2, 2010

(65) Prior Publication Data

US 2011/0118090 A1 May 19, 2011

Related U.S. Application Data

(60) Provisional application No. 61/261,651, filed on Nov. 16, 2009.

(51) Int. Cl.
*A63B 22/02* (2006.01)

(52) U.S. Cl. ..... 482/54

(58) Field of Classification Search ..... 482/5, 51, 482/54, 62, 122, 123, 128, 129
See application file for complete search history.

(56) References Cited

U.S. PATENT DOCUMENTS

| | | | | |
|---|---|---|---|---|
| 4,625,962 | A * | 12/1986 | Street | 482/116 |
| 5,000,440 | A * | 3/1991 | Lynch | 482/54 |
| 5,527,245 | A * | 6/1996 | Dalebout et al. | 482/54 |
| 6,264,588 | B1 * | 7/2001 | Ellis | 482/137 |
| 6,387,015 | B1 * | 5/2002 | Watson | 482/54 |
| 6,520,891 | B1 * | 2/2003 | Stephens, Jr. | 482/54 |
| 6,575,879 | B1 * | 6/2003 | Harney et al. | 482/54 |
| 6,723,028 | B1 * | 4/2004 | Wang et al. | 482/54 |
| 7,066,865 | B2 * | 6/2006 | Radow | 482/4 |
| 7,537,554 | B2 * | 5/2009 | Zhuang | 482/142 |
| 7,585,254 | B1 * | 9/2009 | Vittone et al. | 482/54 |
| 7,878,950 | B1 * | 2/2011 | Bastian | 482/54 |
| 2006/0128532 | A1 * | 6/2006 | Wang | 482/54 |
| 2007/0142178 | A1 * | 6/2007 | Harney et al. | 482/8 |
| 2007/0270286 | A1 * | 11/2007 | Nielsen | 482/54 |
| 2007/0281831 | A1 * | 12/2007 | Wang | 482/54 |
| 2008/0171640 | A1 * | 7/2008 | Chang | 482/54 |
| 2010/0113227 | A1 * | 5/2010 | Habing | 482/51 |
| 2010/0279827 | A1 * | 11/2010 | Farnsworth et al. | 482/54 |

* cited by examiner

*Primary Examiner* — Loan Thanh
*Assistant Examiner* — Daniel F Roland
(74) *Attorney, Agent, or Firm* — Laurence P. Colton; Smith Risley Tempel Santos LLC

(57) ABSTRACT

An exercise treadmill having an endless exercise surface for walking or running while exercising, a resistance mechanism for providing a resistance for simulating the pushing or pulling of a load, wherein the resistance can be adjusted and set to a specific resistance setting. A movable pushing and pulling means is or are operatively attached to the resistance mechanism to transfer the load to the user. The resistance mechanism applies a constant and static force to the pushing and pulling means only in the same direction the endless movable surface moves and opposite a pushing or pulling direction such that operating the treadmill simulates the pushing or pulling of a load by a combination of gripping and pushing or pulling the pushing and pulling means forward or backwards while walking or running forward or backwards.

15 Claims, 41 Drawing Sheets

EXERCISE TREADMILL FOR SIMULATING PUSHING AND PULLING ACTIONS AND EXERCISE METHOD THEREFOR

STATEMENT OF RELATED APPLICATIONS

This patent application claims the benefit of U.S. Provisional Patent Application No. 61/261,651 having a filing date of 16 Nov. 2009 and U.S. patent application Ser. No. 12/579,440 having a filing date of 15 Oct. 2009, both of which are incorporated herein in their entireties by this reference.

BACKGROUND OF THE INVENTION

1. Technical Field

This invention relates to the general technical field of exercise, physical fitness and physical therapy equipment and machines and to the more specific technical field of treadmills that can be operated in a forward and/or rearward walking and running mode to simulate pushing and pulling exercises. This invention also relates to the more specific technical field of using a resistance mechanism to generate a constant static resistance for simulating the pushing and pulling of a load, which resistance can be adjusted (increased and decreased) while exercising.

2. Prior Art

Exercise, physical fitness and physical therapy equipment and machines are available in various configurations and for various purposes, and are available for all of the major muscle groups. The majority of such equipment and machines, especially in the exercise field, concentrate either on an aerobic or anaerobic workout or on areas of the body such as the legs, the hips and lower torso, the chest and upper torso, the back, the shoulders and the arms.

Exercise treadmills are well known and are used for various purposes, including for walking or running aerobic-type exercises, and for diagnostic and therapeutic purposes. For the known and common purposes, the person (user) on the exercise treadmill normally can perform an exercise routine at a relatively steady and continuous level of physical activity, such as by maintaining a constant walking or running velocity and a constant incline, or at a variable level of physical exercise, such as by varying either or both the velocity and incline of the treadmill during a single session.

Exercise treadmills typically have an endless running surface extending between and movable around rollers or pulleys at each end of the treadmill. The running surface generally is a relatively thin rubber-like material driven by a motor rotating one of the rollers or pulleys. The speed of the motor is adjustable by the user or by a computer program so that the level of exercise can be adjusted to simulate running or walking.

The endless running surface, generally referred to as a belt, typically is supported along its upper length between the rollers or pulleys by one of several well known designs in order to support the weight of the user. The most common approach is to provide a deck or support surface beneath the belt, such as a plastic, wood or metal panel, to provide the required support. A low-friction sheet or laminate, such as TEFLON® brand of synthetic resinous fluorine-containing polymers, can be provided on the deck surface (or indeed can be the material of construction of the deck surface) to reduce the friction between the deck surface and the belt.

Many current exercise treadmills, especially the middle to upper quality or feature level of exercise treadmills, also have the ability to provide an adjustable incline to the treadmill.

The incline is accomplished in one of two manners—either the entire apparatus is inclined or just the walking and running surface is inclined. Further, the inclination can be accomplished by either manual or power driven inclination systems, and can be accomplished either at the command of the user or as part of a computerized exercise regimen programmed into the exercise treadmill. An inclination takes advantage of the fact that the exercise effort, or aerobic effect, can be varied with changes in inclination, requiring more exertion on the part of the user when the inclination is greater.

Most known exercise treadmills are structured to allow the user to walk or run in a forward direction, with the belt traveling in a direction that simulates walking or running forward; that is, the belt runs across the top of the deck in a front to back motion. Additionally, the inclination mechanisms in most exercise treadmills are structured to allow the user to walk or run in a level or uphill inclination; that is, the front of the deck can be level with the back of the deck or can be raised relative to the back of the deck to simulate an uphill inclination. Further, the hand rails and controls in most exercise treadmills are structured to complement simulated forward motion and are fixedly attached to the treadmill base.

A specialty treadmill developed by this inventor and patented under U.S. Pat. No. 7,575,537 is structured to allow the user to comfortably simulate a pulling or dragging motion; that is, a backwards walking motion either on a level plane or uphill. This exercise treadmill that provides a constant static weight resistance against pushing so as to simulate pushing of a load, which weight resistance can be varied (increased and decreased) by the user. This simulated pulling or dragging motion can be useful for exercising and developing different groupings of muscles and for providing an aerobic workout.

However, with the exception of this inventor's invention, this inventor is unaware of any specific exercise treadmill that is structured to allow the user to comfortably simulate both a load-pushing motion; that is, a forwards walking motion while simulating pushing a load, either on a level plane or uphill, and a load-pulling motion; that is, a rearwards walking motion while simulating pulling a load, either on a level plane or uphill. Additionally, with the exception of this inventor's invention, this inventor is unaware of any specific exercise treadmill that provides a constant static weight resistance to simulate both the pushing and the pulling of a load, which weight resistance can be varied (increased and decreased) by the user. A simulated pushing motion can be useful for exercising and developing different groupings of muscles and for providing an aerobic workout. Thus it can be seen that an exercise treadmill simulating both a pushing motion and a pulling motion would be useful, novel and not obvious, and a significant improvement over the prior art. It is to such an exercise treadmill that the current invention is directed.

BRIEF SUMMARY OF THE INVENTION

The present invention is a cardiovascular cross training device that addresses many needs not met with the current industry offering of treadmills, elliptical devices, stationary bicycles, and stair climbing devices. Walking and running is incorporated into the fitness and physical rehabilitation programs prescribed by many professional fitness trainers, physical therapists, sports medicine professionals and strength and conditioning professionals. Additionally, many athletes use weight loaded sled pushing and pulling to augment their lower body strength training as well as their overall aerobic and anaerobic conditioning programs. Adding the additional load factor of horizontal resistance (that is, a simulated pushing or pulling motion) and the energy expenditure and muscle loading to the lower body is increased. This increased energy output allows an individual to achieve and maintain their desired heart rate walking or running at a fraction of the speed of any forward walking or running motion oriented exercise that does not incorporate pushing or pulling a load. The present invention combines these features in a versatile cross training device.

The present invention is an exercise treadmill for simulating the pushing and pulling of an object on a level surface, up an incline or down a decline. The treadmill has a lower base having the treadmill surface and housing the internal mechanical components of the walking platform, a movable resistance arm, a fixed console support structure on which at least one pushing and pulling means is attached, and a resistance mechanism located proximal to the console support structure. Various control switches and displays for operating the invention can be located on the pushing and pulling means and/or the console support structure. In one embodiment, the resistance mechanism can be operatively connected to the pushing and pulling means via a cable. In another embodiment, the resistance mechanism can be operatively connected to the pushing and pulling means by levers, rods, or the like. In yet another embodiment, the resistance mechanism can be operatively directly connected to the pushing and pulling means. In another embodiment, the pushing and pulling means can be operatively attached to the resistance mechanism via a cable or other linking means that can pass through and can be operatively supported by the side support structures and/or the console support structure.

In the pushing operation, when a user steps onto the treadmill and grips the pushing and pulling means and starts the treadmill belt moving, the user begins to walk or run in a forwards direction relative to the console support structure, causing the user to push on the pushing and pulling means in a pushing direction. Alternatively, the treadmill may be set up to begin to move automatically at a speed and at an inclination according to a value entered from the input means located on the pushing and pulling means or on the control console. This pushing transfers from the pushing and pulling means, to the main cable or other connecting linkages and/or cables, which is or are operatively connected to the resistance mechanism, thus acting on the resistance mechanism. As disclosed above, the action of the pushing and pulling means on the resistance mechanism can be by many means, such as cables, wires, rods, levers, gears, or the like, directly or indirectly, and structurally attached or in cooperative communication.

In the pulling operation, when a user steps onto the treadmill and grips the pushing and pulling means and starts the treadmill belt moving, the user begins to walk or run in a rearwards direction relative to the console support structure, causing the user to pull on the pushing and pulling means in a pulling direction. Alternatively, the treadmill may be set up to begin to move automatically at a speed and at an inclination according to a value entered from the input means located on the pushing and pulling means or on the control console. This pulling transfers from the pushing and pulling means, to the main cable or other connecting linkages and/or cables, which is or are operatively connected to the resistance mechanism, thus acting on the resistance mechanism. As disclosed above, the action of the pushing and pulling means on the resistance mechanism can be by many means, such as cables, wires, rods, levers, gears, or the like, directly or indirectly, and structurally attached or in cooperative communication.

The resistance mechanism can be set by the user to a specific amount, such as for example 10 kilograms, comparable to known resistance mechanisms such as weight stacks. Thus, when the user pushes on the pushing and pulling means, the resistance mechanism exerts a counterforce on the user of the set weight, 10 kilograms in this example. The counterforce is static and approximately constant at the set weight or level throughout the entire range of movement of the pushing and pulling means, except in some embodiments at the very start of the range of motion when the resistance mechanism is resting on a stop. That is, the resistance mechanism exerts a counterforce on the user of the set weight, 10 kilograms in this example, or level whether the user has pushed or pulled the pushing and pulling means one centimeter or four centimeters, and this set resistance is static and approximately constant, at 10 kilograms in this example, unless the resistance mechanism is reset to a different amount. Thus, the degree of resistance of the resistance mechanism can be controlled by the user to simulate pushing or pulling a weight such that the exercise regimen is similar to walking or running forwards or backwards while pushing or pulling, respectively, an object of a weight comparable to the setting of the resistance mechanism. The higher the setting of the resistance mechanism, the heavier the simulated object being pushed or pulled. The degree of resistance also is adjustable in that the user can set the specific amount of resistance to any amount within the parameters of the resistance mechanism structure prior to and during the exercise regimen, depending on the embodiment of the invention, with slight variations based on the position of the pushing and pulling means. The degree of resistance can be set prior to starting the exercise regimen or during the exercise regimen. Further, the degree of resistance can be changed (increased, decreased, eliminated) during the course of the exercise regimen.

In a preferred embodiment, the resistance mechanism is a moment arm mechanism comprising a moment arm, an adjustable weight, and a drive mechanism for moving the adjustable weight relative to or along the moment arm. As the adjustable weight is adjusted along the moment arm relative to a pivot point of the moment arm, the weight resistance of the moment arm is increased or decreased, thus simulating the pushing of various or varying load weights. The moment arm is operatively connected to the pushing and pulling means via drive cables, thus transferring the weight resistance effect to the user. Thus, when the user pushes or pulls on the pushing and pulling means, so as to activate the moment arm, the moment arm creates a constant and static counterforce equivalent to the specific weight amount set by the user. Preferably, the pushing and pulling means operate independently of each other.

In one embodiment, there can be a single pushing and pulling means, such as a single pushing bar that is operatively connected to the resistance mechanism and connects to either side of the treadmill to form a horizontal bar or handle in front of the user that can be pushed forward or pulled backwards. In other alternative embodiments, the pushing and pulling means can be rigidly attached to the console structure and the console structure is movable (pivotable or slidable, for example) such that when the pushing and pulling means is moved, the entire console structure moves to activate the resistance mechanism.

In other embodiments, the resistance mechanism is a pneumatic mechanism comprising a pneumatic cylinder, an air compressor, and various connecting hoses. In known pneumatic mechanisms, the resistance of the pneumatic cylinder can be set to certain values corresponding to a known resistance by the setting of the compressor (the higher the pressure of the compressed air produced by the compressor, the higher the resistance of the pneumatic cylinder, and the higher the equivalent resistance). Similarly, the resistance mechanism can be a hydraulic cylinder and the air a fluid.

In still other embodiments, the resistance mechanism is an electric motor and braking system comprising an electric motor and a clutch assembly. In known systems of this type, the electric motor imparts a force through the brake, which can correspond to a known resistance by the power supplied to the motor or to the brake. Pushing or pulling on the pushing and pulling means causes a force in a rotational direction counter to the rotational direction of the motor and brake, creating a counterforce that can be measured in an equivalent weight resistance. Thus, in other embodiments, the resistance mechanism does not need to be weight-based.

The invention also can be a combination of a conventional treadmill for forward walking and running and the pushing and pulling motion treadmill. In such treadmills, the lower base housing the treadmill belt motor and the weight resistance mechanism can be a relatively larger structure sitting under and supporting the treadmill or a relatively smaller structure from which the treadmill belt and platform extend. In the first instance, the elevation motor or means for raising and lowering the treadmill belt platform for incline and decline operation can be located within the lower base housing. In the second instance, the elevation motor or means can be located in a separate relatively smaller structure attached to the end of the treadmill platform opposite the end of the treadmill platform attached to the lower base housing.

Generally speaking, the internal mechanical components of the treadmill are similar to (or can be similar to or the same as) the internal mechanical components of known treadmills. The treadmill comprises an endless belt looped about rollers or pulleys so as to provide a platform on which the user can stand, walk and/or run. A deck below a portion of the belt supports the belt and the user. A belt motor cooperates with the belt and/or the rollers or pulleys to move the belt, thus creating a moving platform on which the user can walk or run for the exercise regimen. An incline motor cooperates with the platform, the deck, the rollers or pulleys, the front support legs, and/or the rear support legs to incline the belt to simulate a hill.

These features, and other features and advantages of the present invention will become more apparent to those of ordinary skill in the art when the following detailed description of the preferred embodiments is read in conjunction with the appended figures.

DETAILED DESCRIPTION OF PREFERRED EMBODIMENTS

Figure 1:
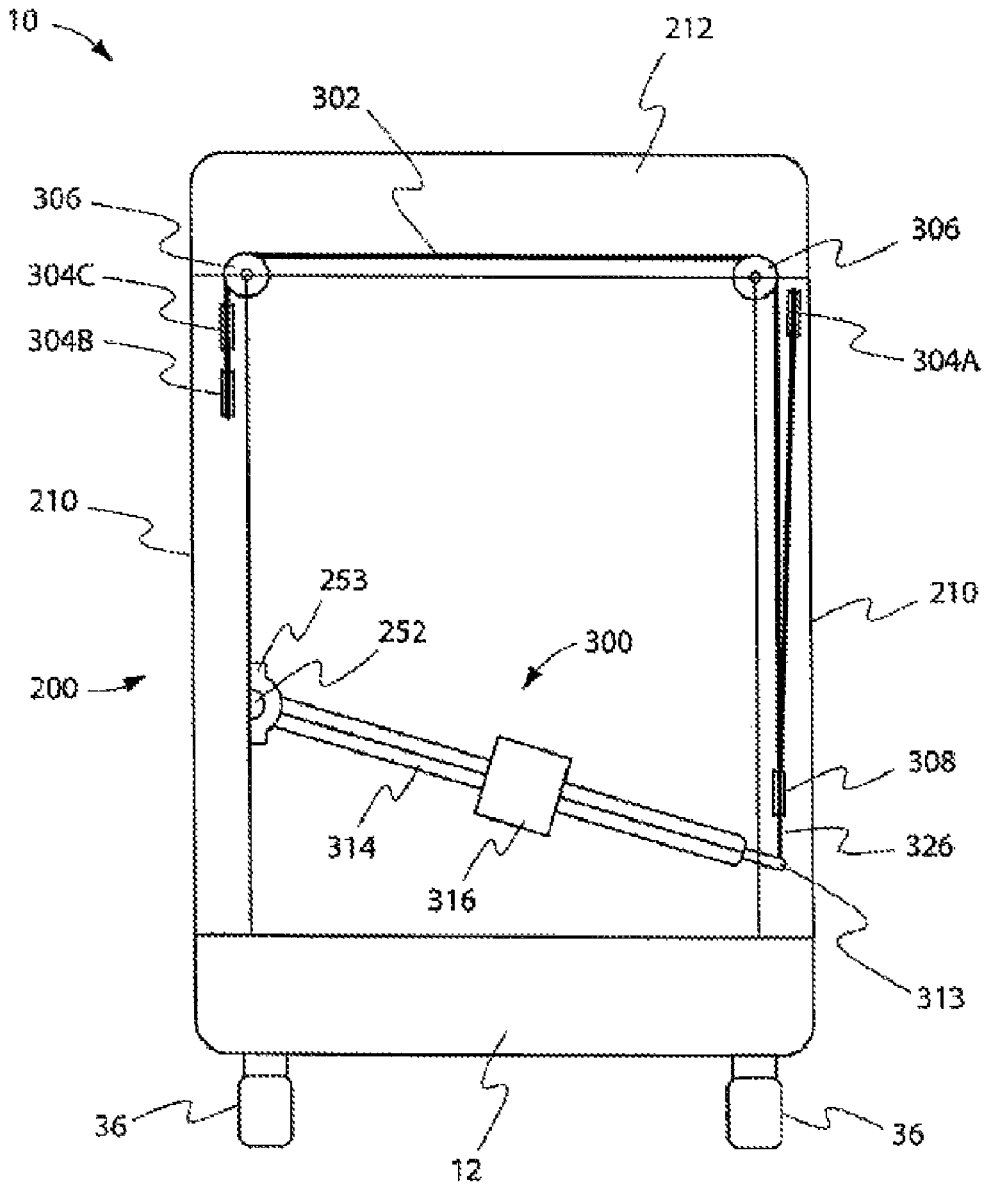
FIG. 1 is a front view, partly in section, of one embodiment of the invention with the moment arm weight resistance mechanism located centrally in the support console.
Figure 2A:
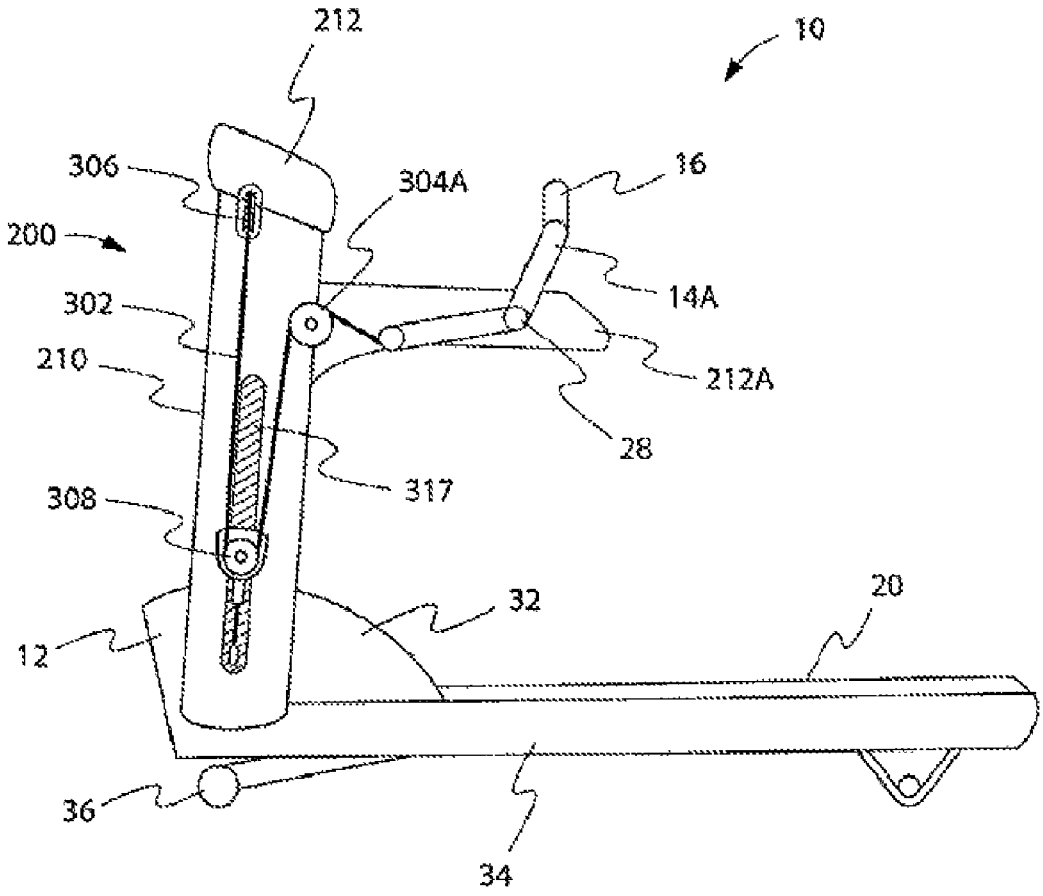
FIG. 2A is a left side view, partly in section, of the embodiment of the invention shown in FIG. 1 shown in the resting mode.
Figure 2B:
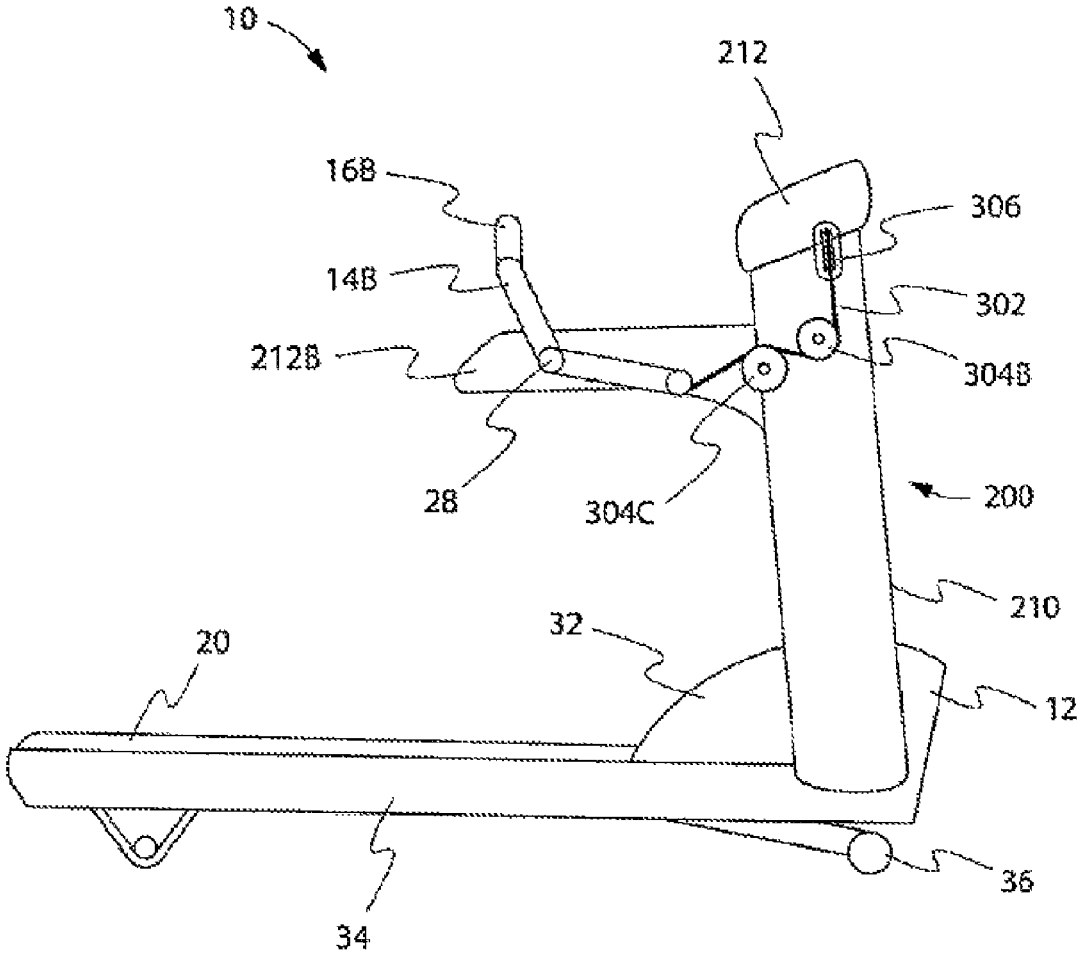
FIG. 2B is a right side view, partly in section, of the embodiment of the invention shown in FIG. 1 shown in the resting mode.
Figure 3A:
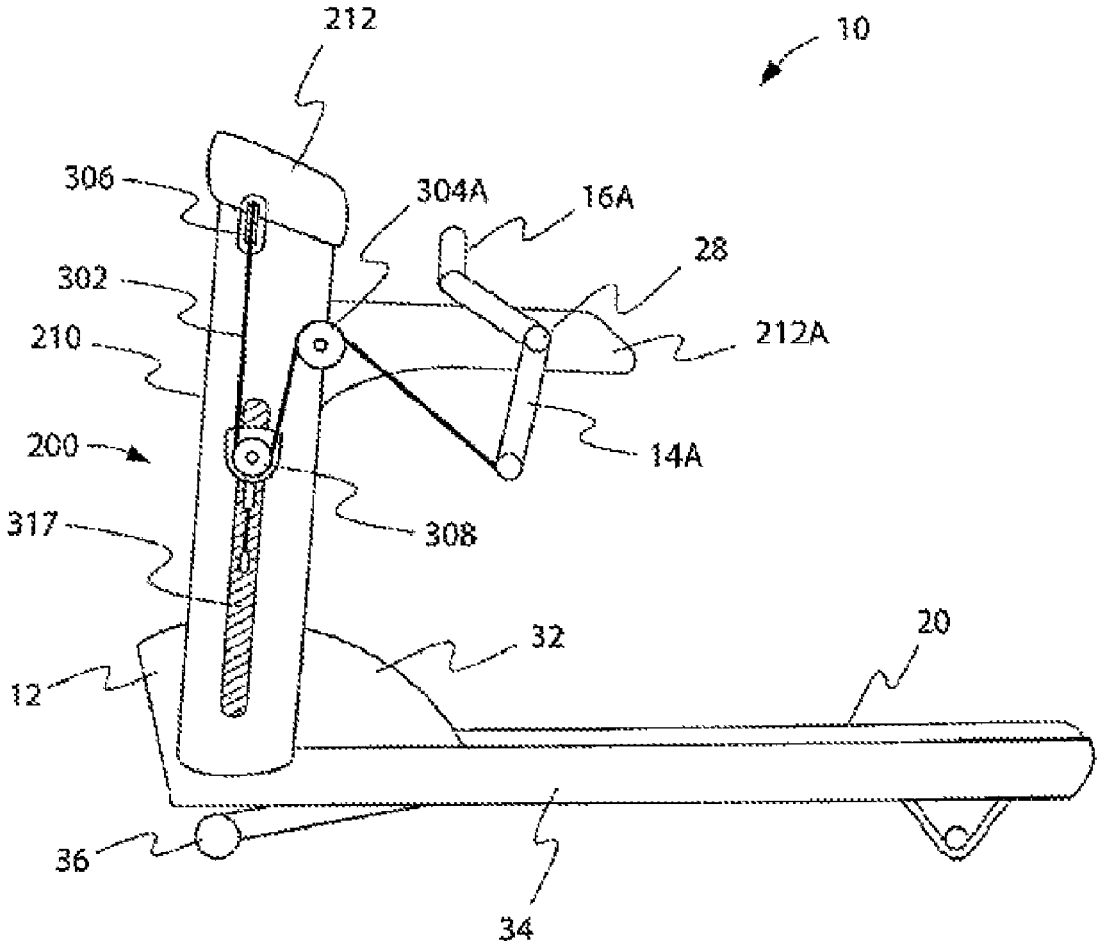
FIG. 3A is a left side view, partly in section, of the embodiment of the invention shown in FIG. 1 shown in the resistance mode.
Figure 3B:
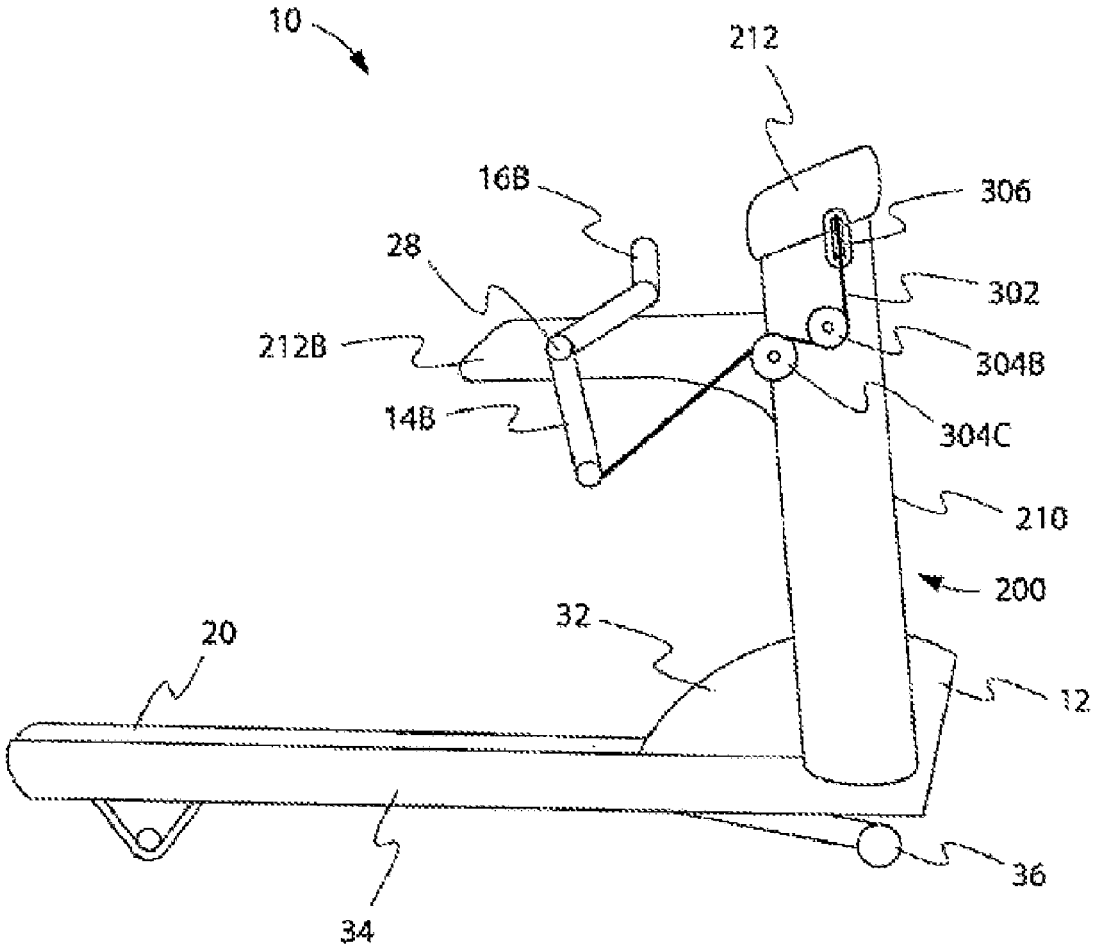
FIG. 3B is a right side view, partly in section, of the embodiment of the invention shown in FIG. 1 shown in the resistance mode.
Figure 4:
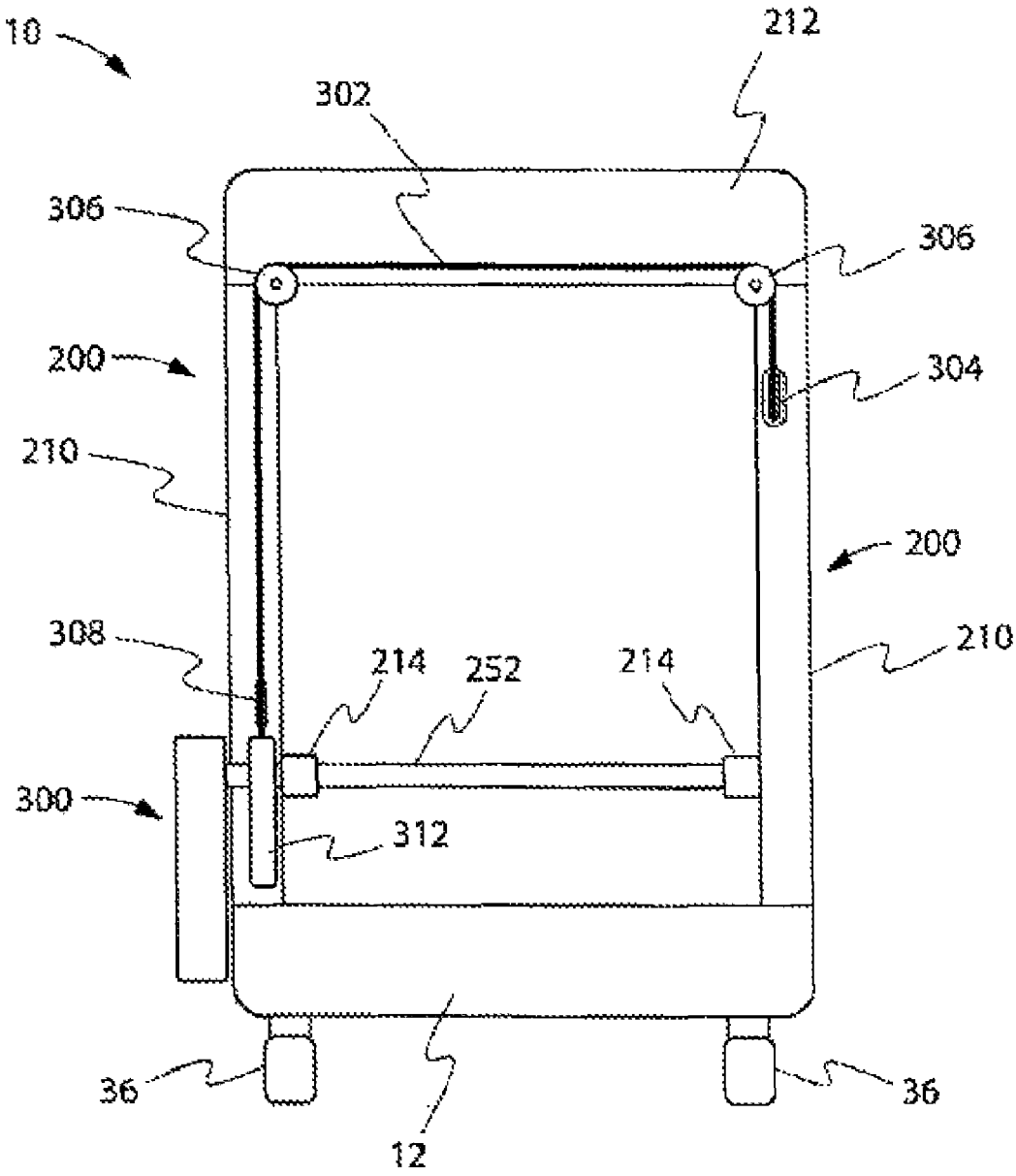
FIG. 4 is a front view, partly in section, of one embodiment of the invention with the moment arm weight resistance mechanism located on the side of the support console.
Figure 5:
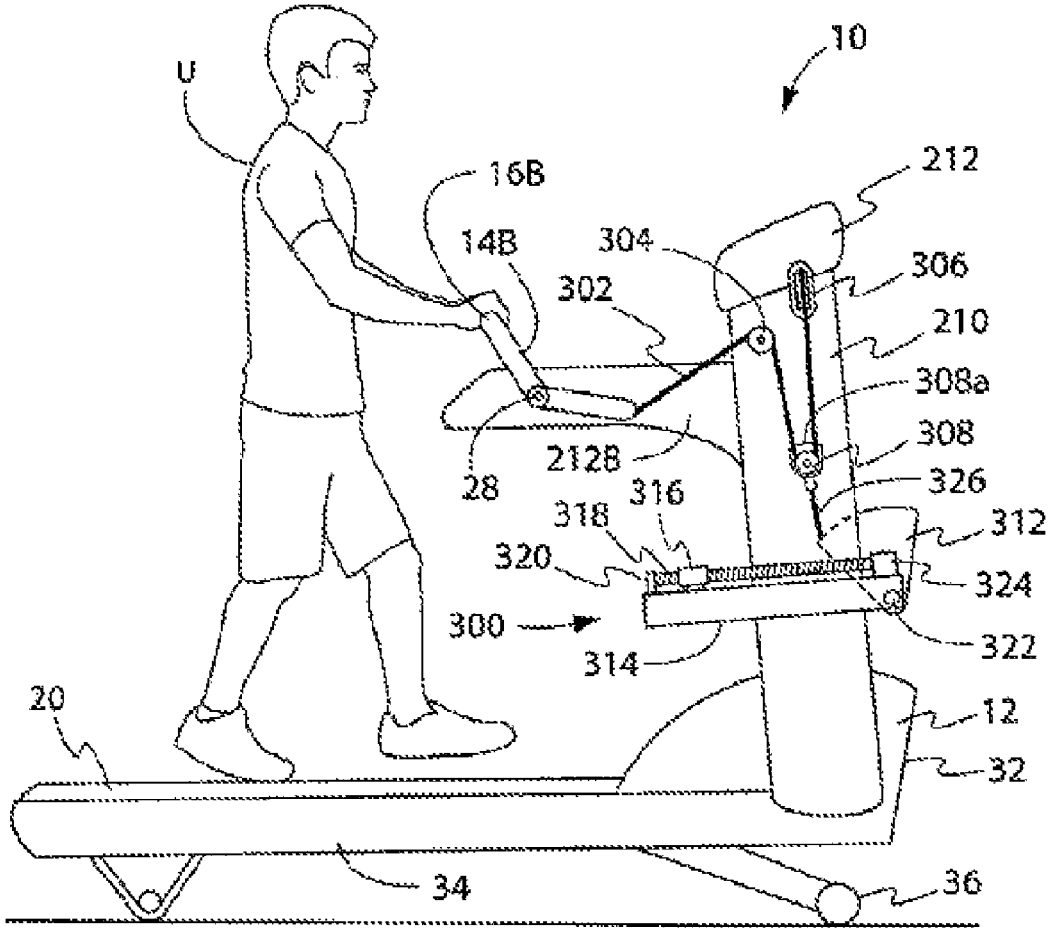
FIG. 5 is a side view, partly in section, of the embodiment of the invention shown in FIG. 4 shown in the resting mode.
Figure 6:
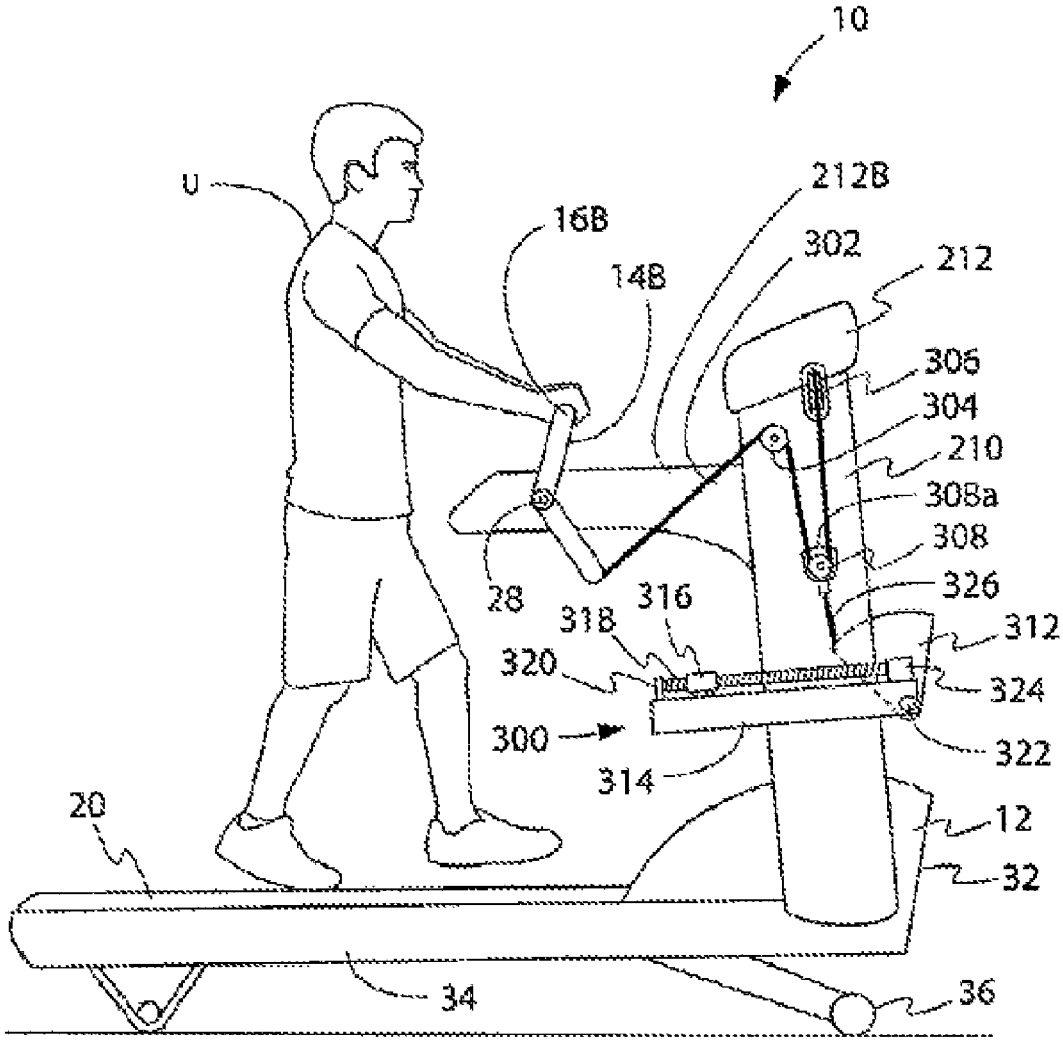
FIG. 6 is a side view, partly in section, of the embodiment of the invention shown in FIG. 4 shown in the resistance mode.

Referring now to the appended figures, the invention will be described in connection with representative preferred embodiments. FIGS. 1-6 illustrate two preferred embodiments of the invention structured with a moment arm or modified moment arm as the exemplary resistance mechanism and illustrating the relationship between the various major components of the device. FIGS. 1-3 illustrate a modified moment arm weight resistance mechanism located between the console support uprights and FIGS. 4-6 illustrate a moment arm weight resistance mechanism located on the side of the invention next to the support console. FIG. 1 is a front view of the center mounted moment arm embodiment. FIGS. 2A and 2B are side views of the center mounted moment arm embodiment in the resting mode. FIGS. 3A and 3B are side views of the center mounted moment arm embodiment in the resistance mode. FIG. 4 is a front view of the side mounted moment arm embodiment. FIG. 5 is a side view of the side mounted moment arm embodiment in the resting mode. FIG. 6 is a side view of the side mounted moment arm embodiment in the resistance mode.

Figure 7:
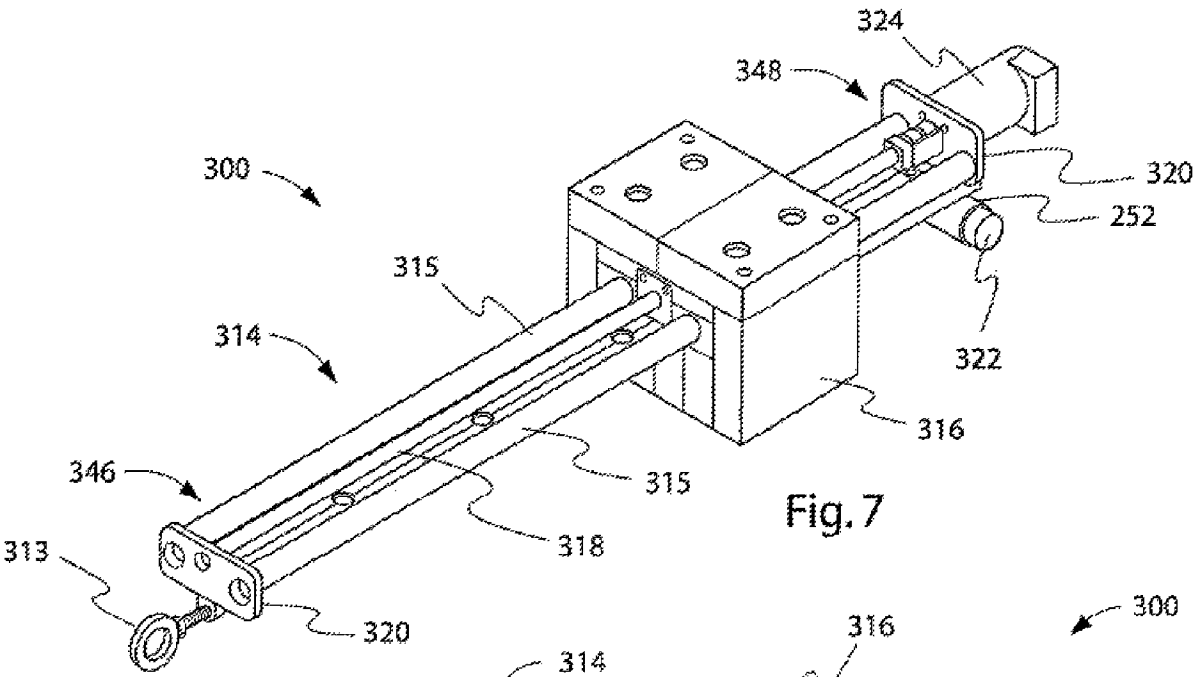
FIG. 7 is a perspective view of a preferred embodiment of a moment arm weight resistance mechanism.
Figure 8:
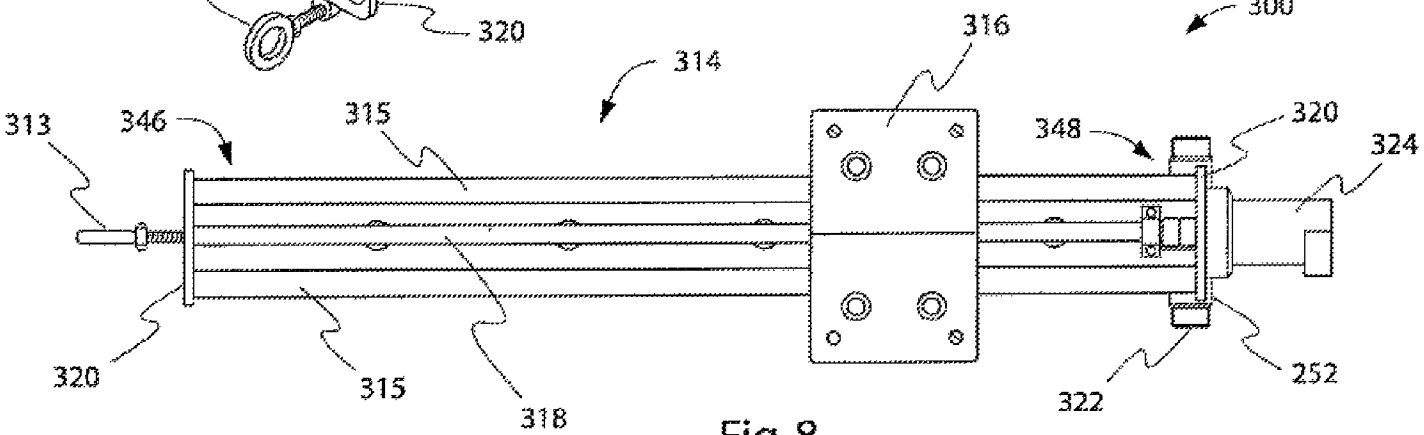
FIG. 8 is a top view of the moment arm weight resistance mechanism shown in FIG. 7.
Figure 9:
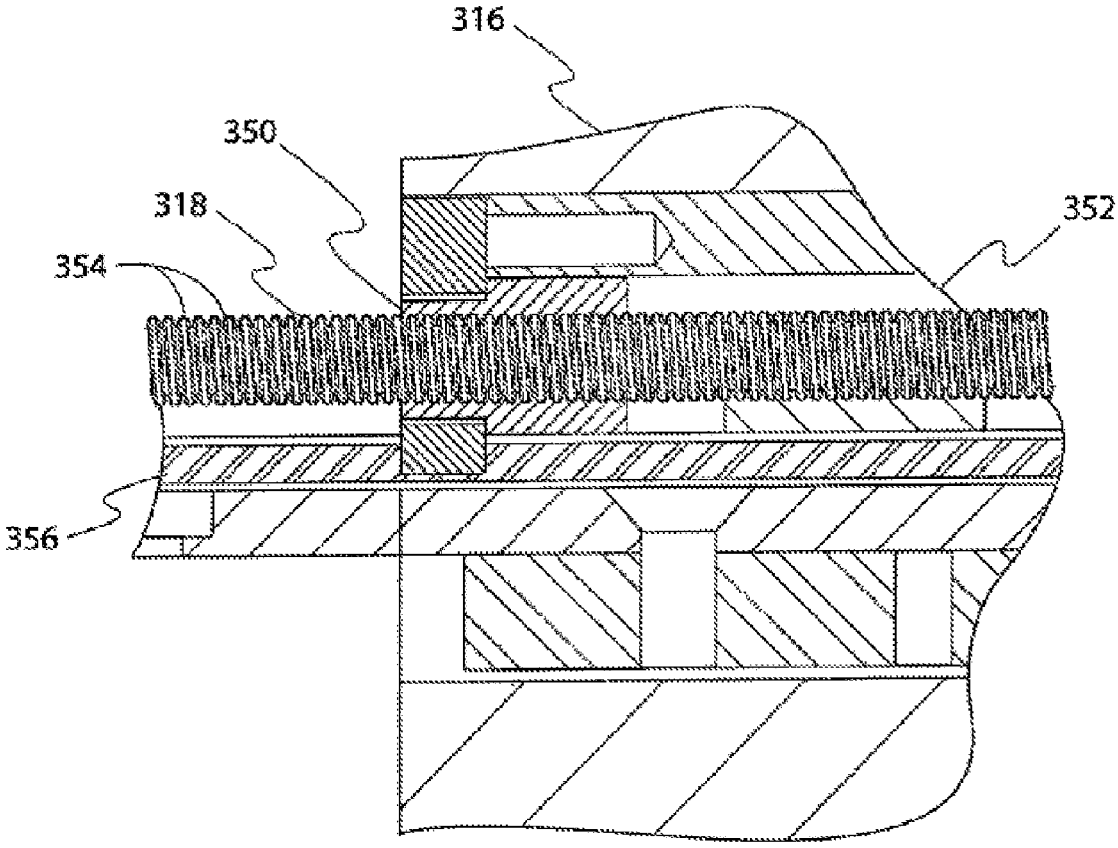
FIG. 9 is a side sectional view of the moment arm weight resistance mechanism shown in FIG. 7.

FIGS. 7-9 illustrate the modified moment arm in more detail. FIG. 7 is a perspective view of a preferred embodiment of a modified moment arm weight resistance mechanism in which the moment arm is raised and lowered by a cable attached to the arcing end of the moment arm. FIG. 8 is a top view of the moment arm weight resistance mechanism shown in FIG. 7. FIG. 9 is a side sectional view of the moment arm weight resistance mechanism shown in FIG. 7.

Figure 10:
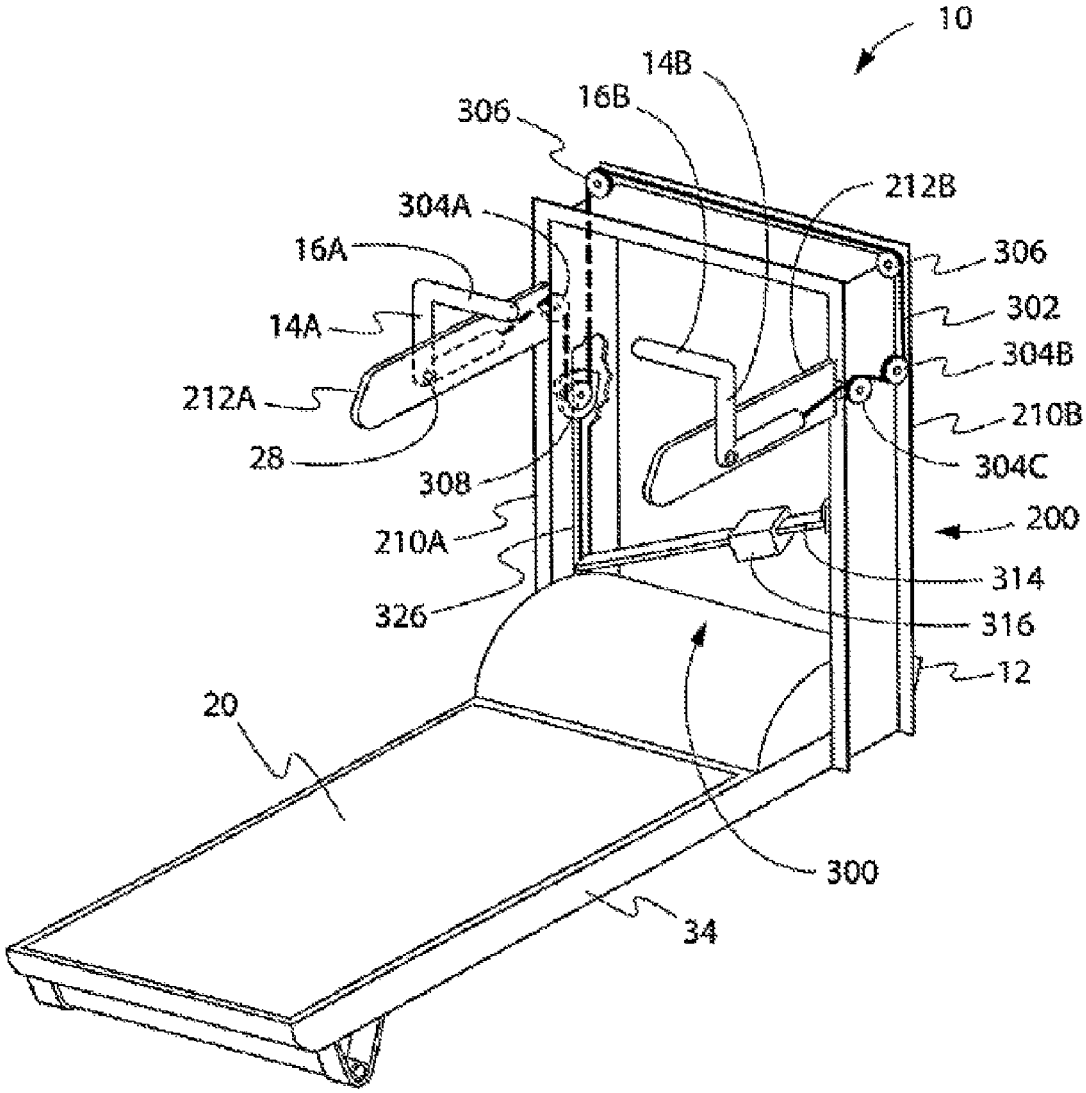
FIG. 10 is a perspective view of an embodiment of the invention with the moment arm weight resistance mechanism located between the console support uprights and in the resting position and with the weight in a first, lesser weight, position.
Figure 11:
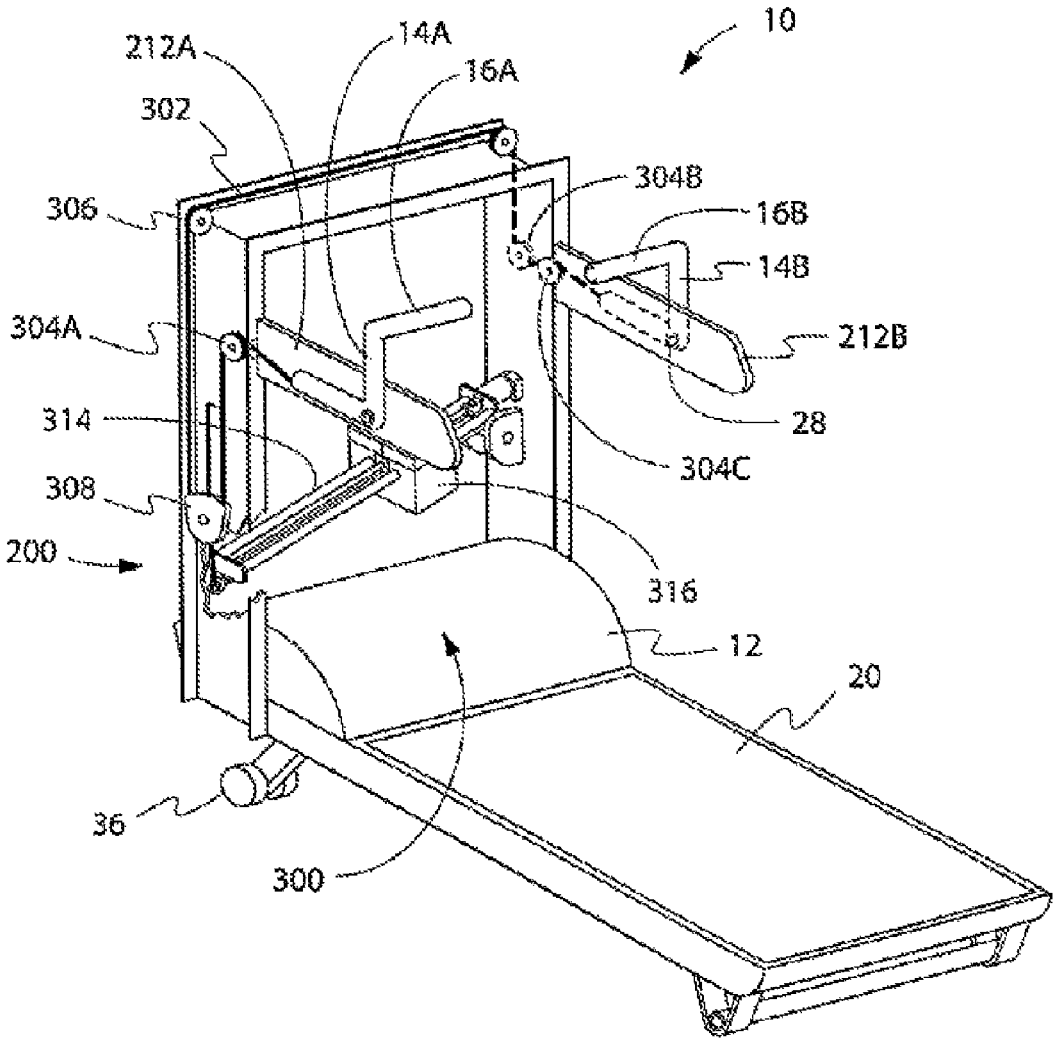
FIG. 11 is a second perspective view of the embodiment of the invention shown in FIG. 10.
Figure 12:
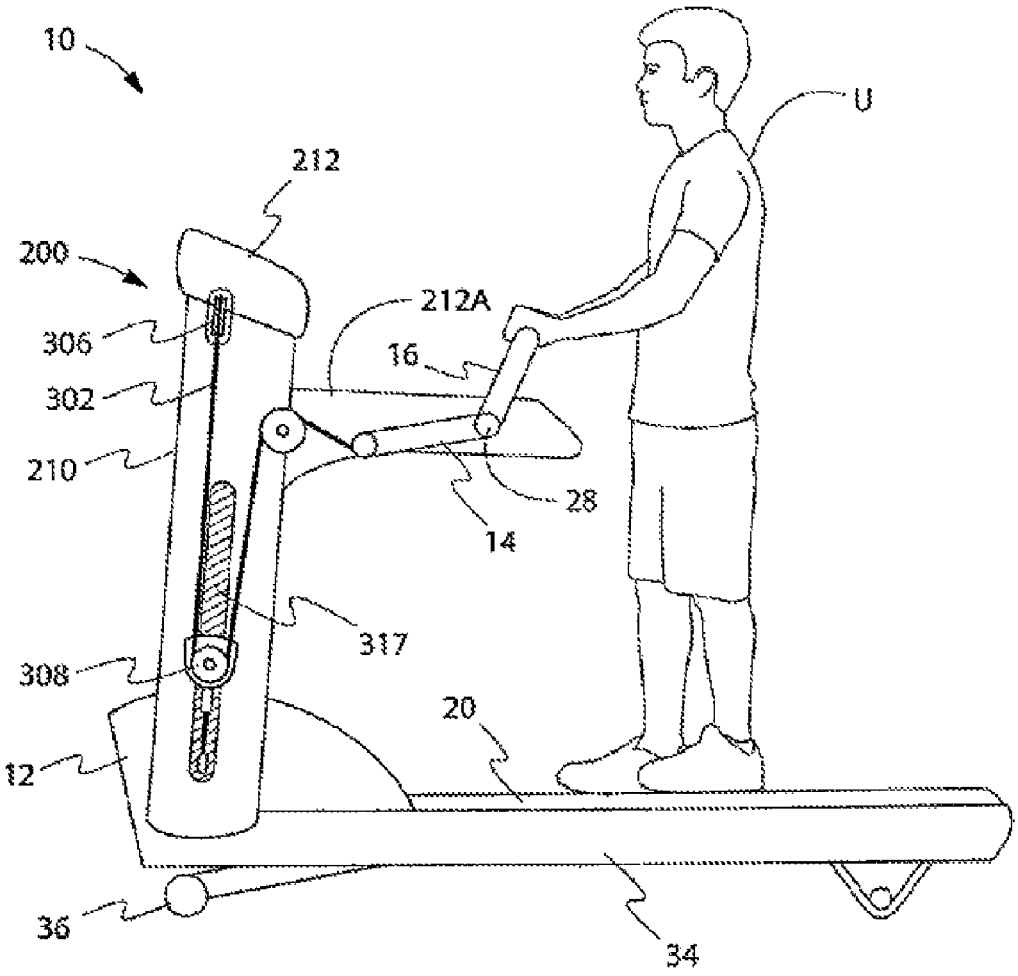
FIG. 12 is a side view of the embodiment of the invention shown in FIG. 10 with a user gripping the pushing handles but with the invention in the resting mode.
Figure 13:
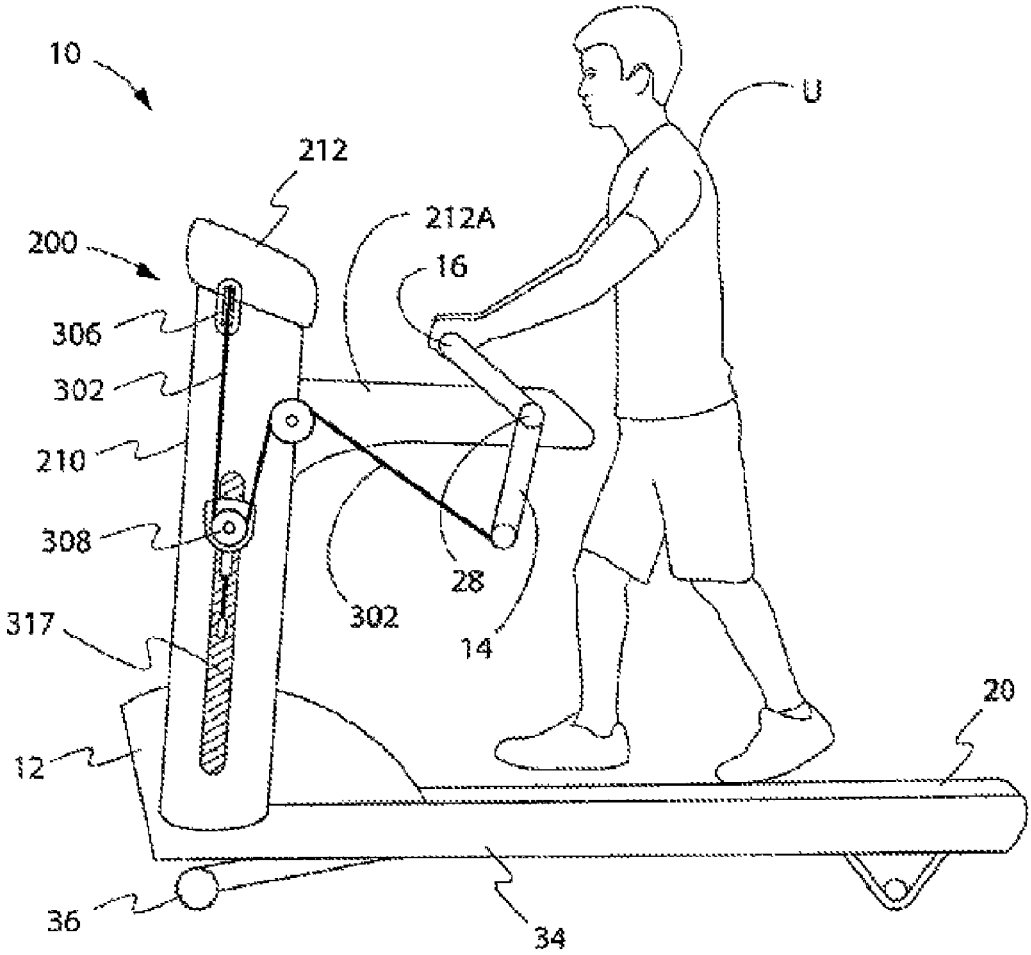
FIG. 13 is a side view of the embodiment of the invention shown in FIG. 10 with a user gripping the pushing handles and using the invention in the pushing mode.

FIG. 10 is a perspective view of an embodiment of the invention as shown in FIGS. 1-3 with the moment arm weight resistance mechanism located between the console support uprights and in the resting position and with the weight in a first, lesser weight, position. FIG. 11 is similar to FIG. 10, but from a different angle. FIG. 12 is a side view of the embodiment of the invention shown in FIG. 10 in the resting mode. FIG. 13 is a side view of the embodiment of the invention shown in FIG. 10 in the operating or resistance mode.

Figure 15:
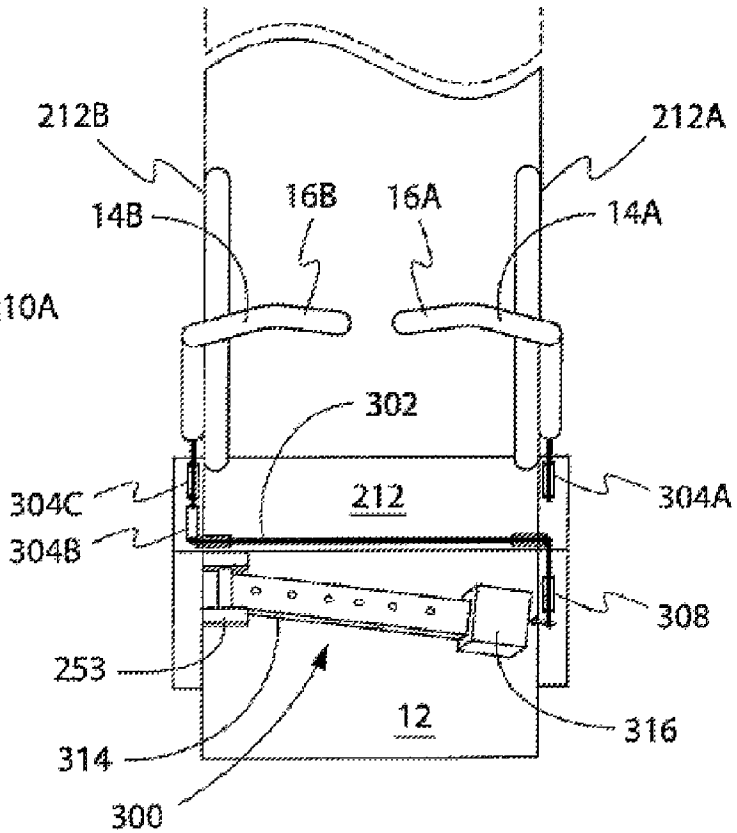
FIG. 15 is a top view of the embodiment of the invention shown in FIG. 10 showing resistance mechanism in the resting mode.
Figure 14:
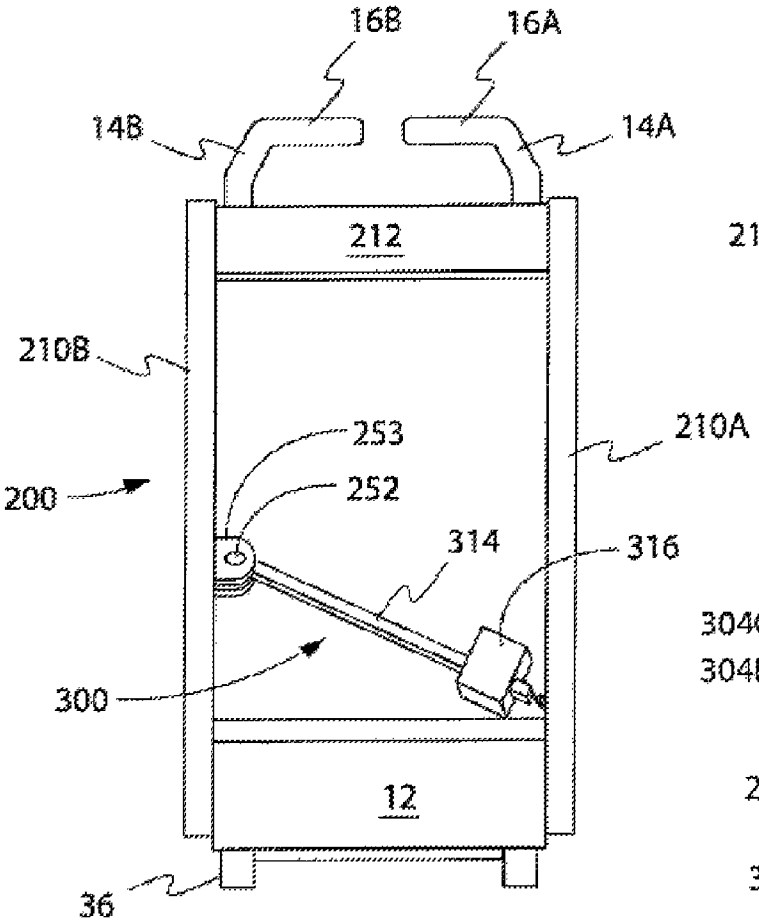
FIG. 14 is a front view of the embodiment of the invention shown in FIG. 10 showing resistance mechanism in the resting mode.
Figure 17:
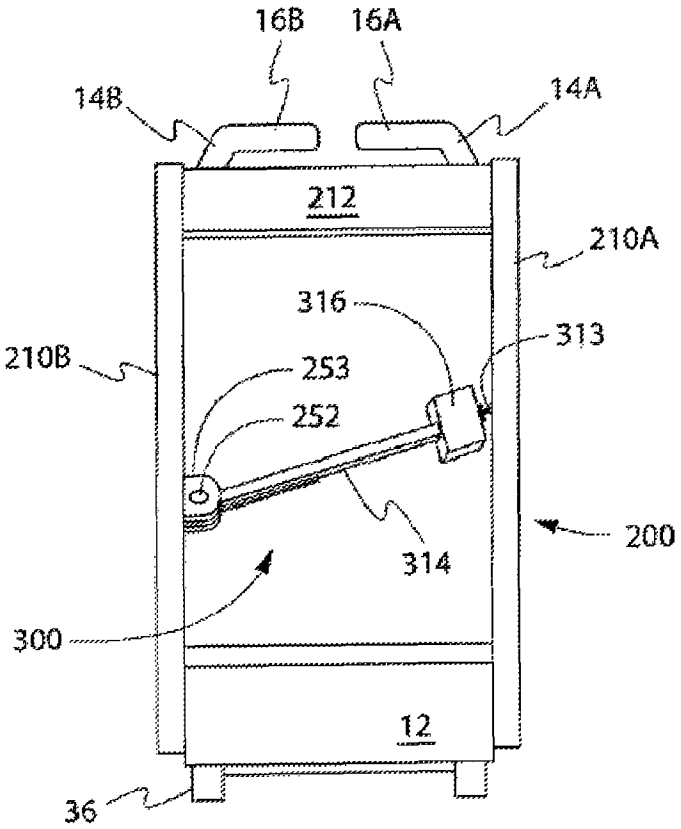
FIG. 17 is front view of the embodiment of the invention shown in FIG. 10 showing resistance mechanism in a fully raised operating mode.
Figure 16:
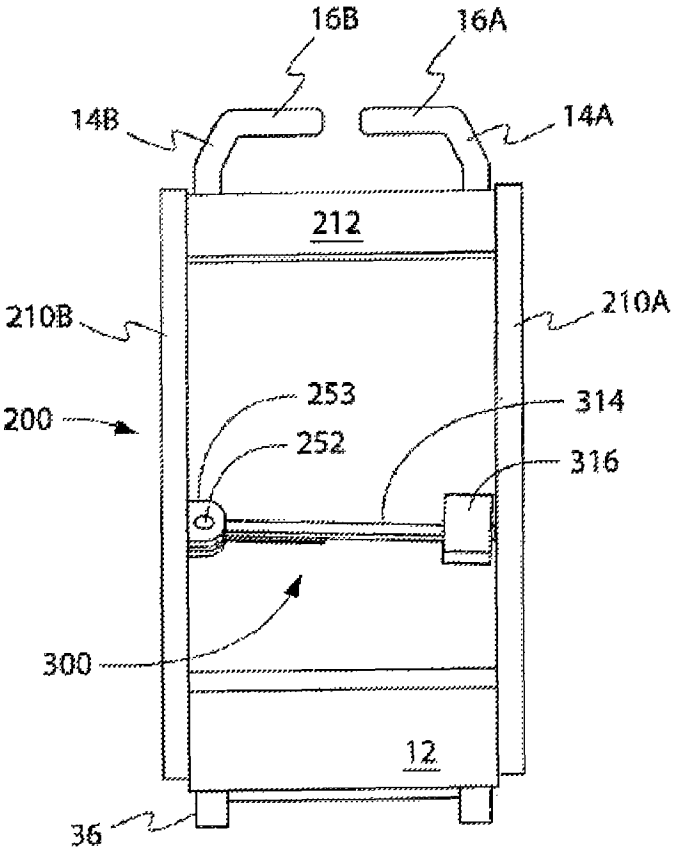
FIG. 16 is a front view of the embodiment of the invention shown in FIG. 10 showing resistance mechanism in a partially raised operating mode.

FIG. 14 is a front view of the embodiment of the invention shown in FIG. 10 showing resistance mechanism in the resting mode. FIG. 15 is a top view of the embodiment of the invention shown in FIG. 10 showing resistance mechanism in the resting mode. FIG. 16 is a front view of the embodiment of the invention shown in FIG. 10 showing resistance mechanism in a partially raised operating or resistance mode. FIG. 17 is front view of the embodiment of the invention shown in FIG. 10 with the resistance mechanism in a fully raised operating or resisting mode. The series of FIGS. 14, 15, and 17 illustrate the action of the cable in raising the moment arm weight resistance mechanism as the pushing handles are pushed by the user U.

FIGS. 10-17 all illustrate a center mount embodiment of the invention. This embodiment also can operate using a true moment arm.

Figure 18:
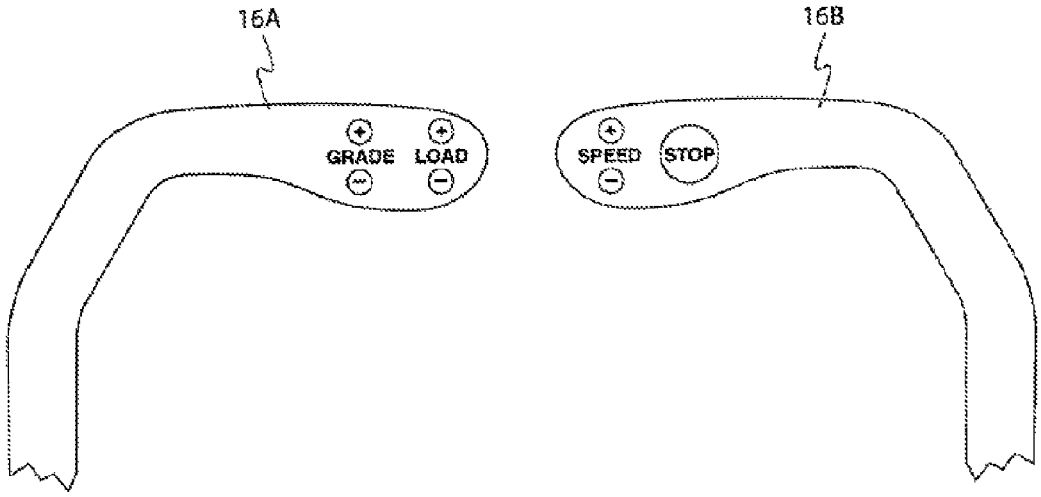
FIG. 18 is a perspective view of an embodiment of representative controls incorporated onto pushing handles for the invention.

FIG. 18 is a perspective view of a control scheme for a representative set of pushing handles for the invention.

Figure 19:
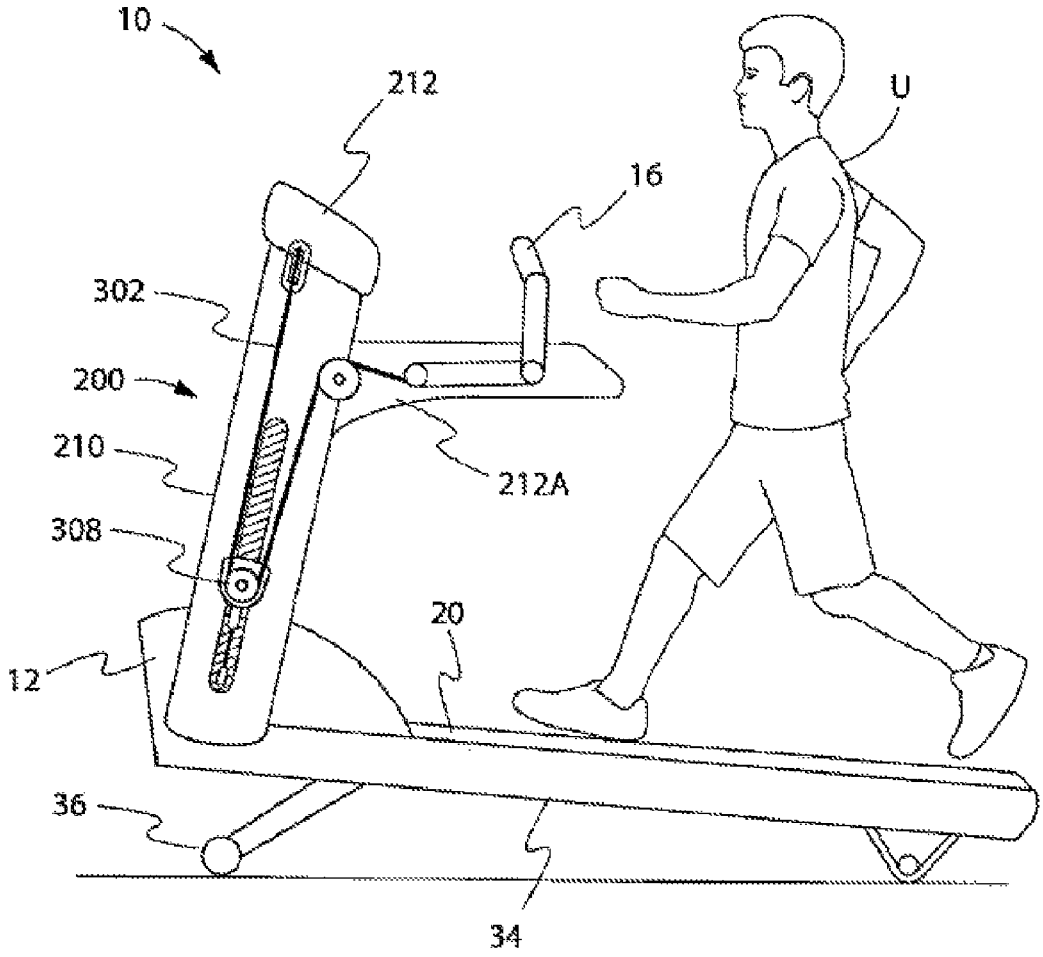
FIG. 19 is a side view of a user using the invention in a typical treadmill manner.

FIG. 19 is a side view of a user using the invention in a typical treadmill manner without engaging the pushing mode.

Figure 20:
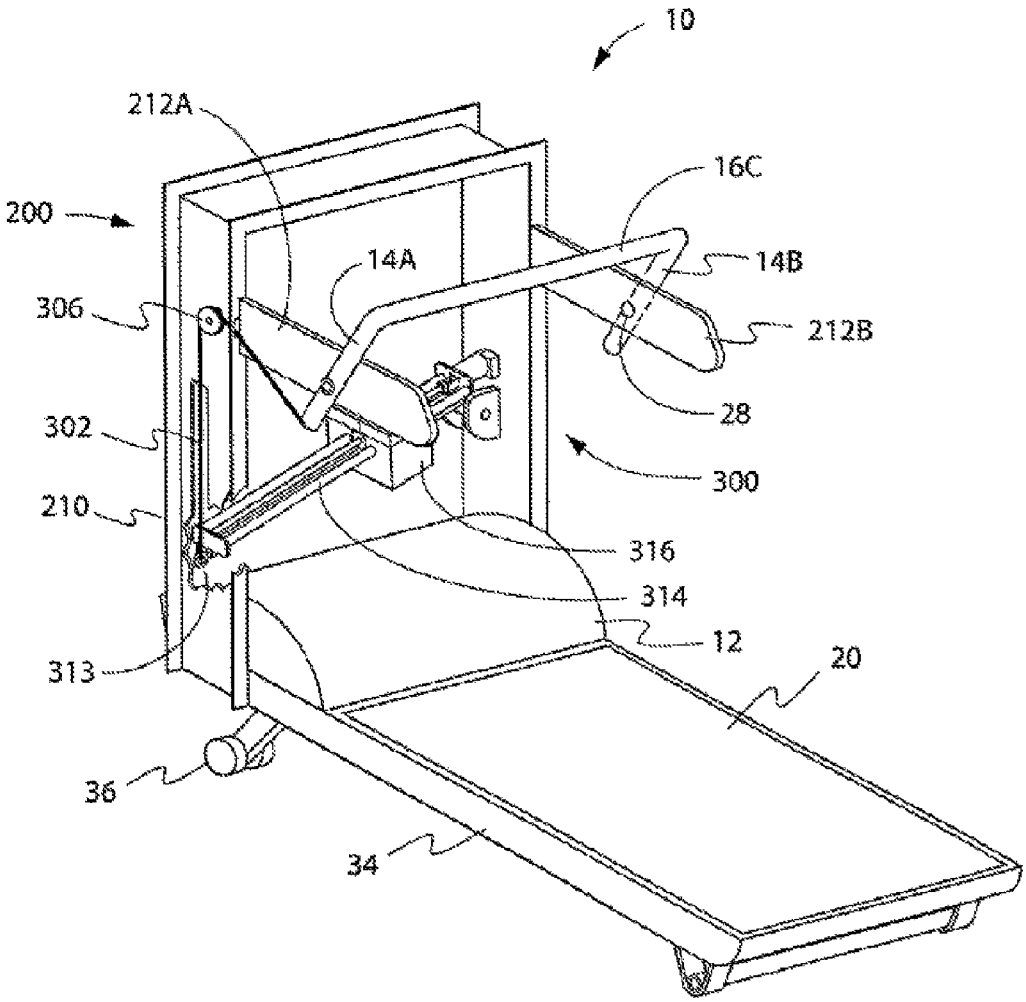
FIG. 20 is a perspective view of an alternate embodiment of the invention having a single pushing bar.
Figure 21:
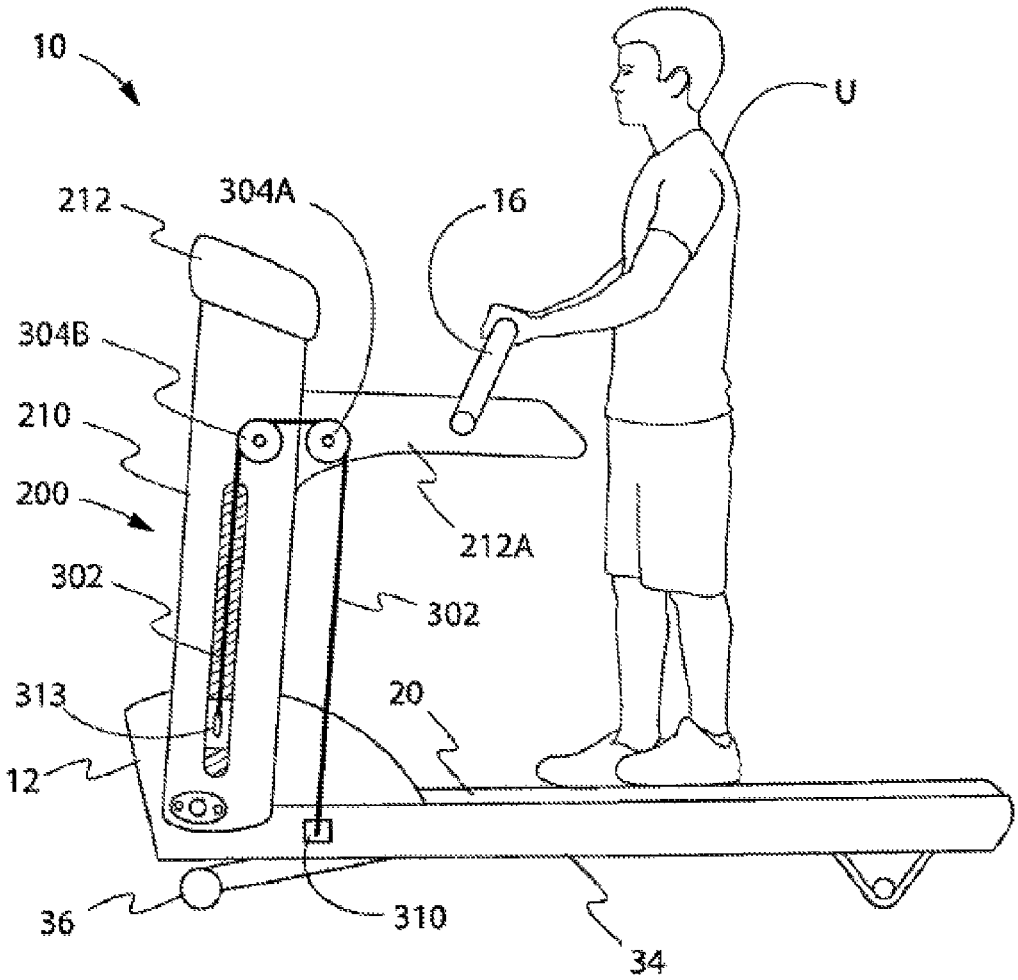
FIG. 21 is a side view of an alternate embodiment of the invention having pivoting uprights in the resting position.
Figure 22:
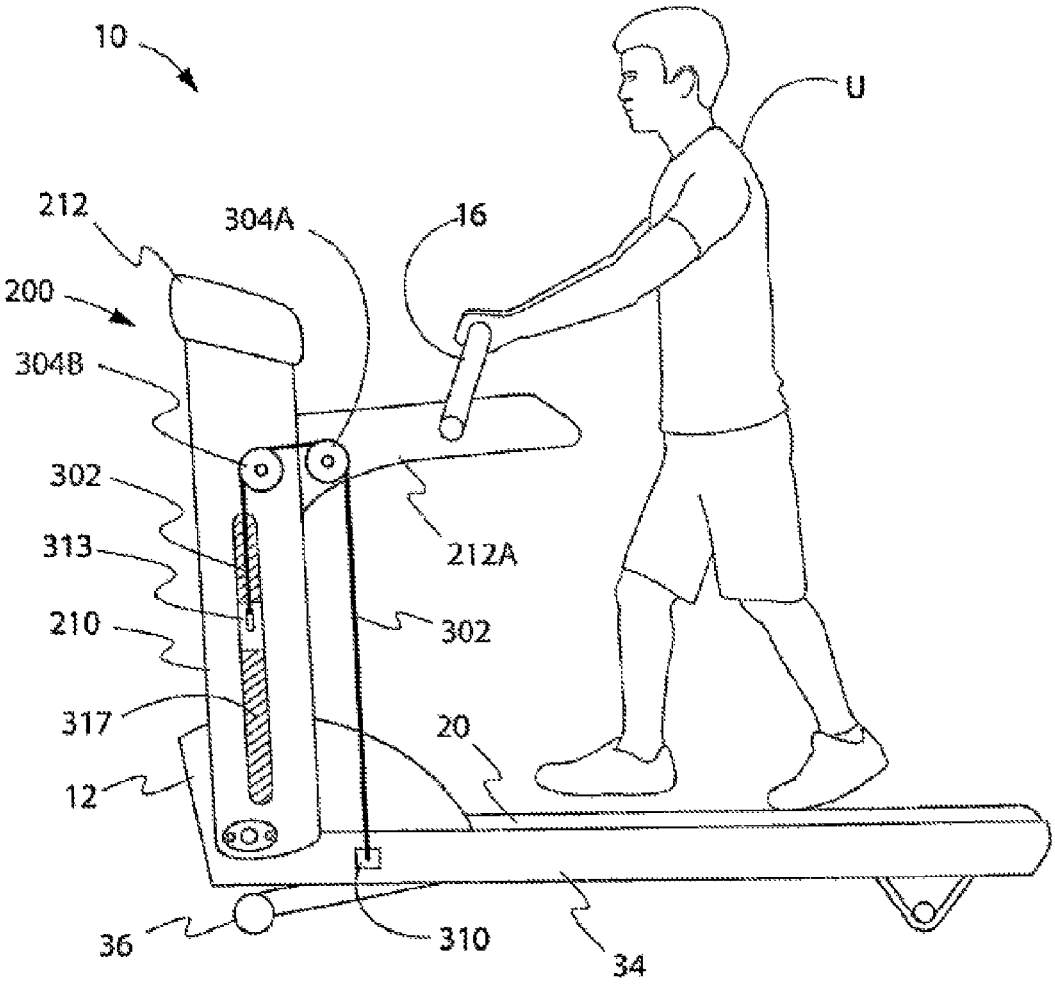
FIG. 22 is a side view of the alternate embodiment shown in FIG. 21 in the operating position.
Figure 23:
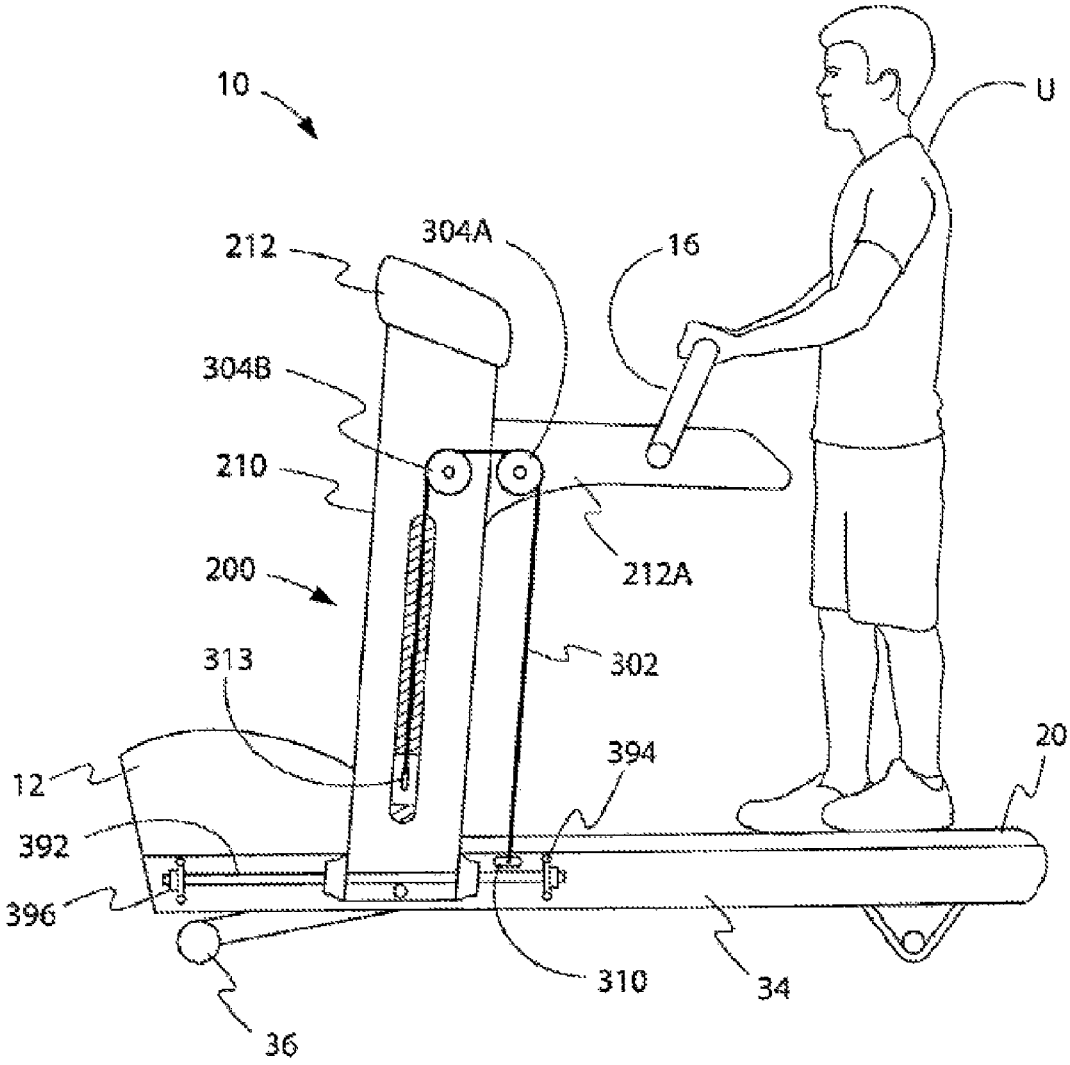
FIG. 23 is a side view of an alternate embodiment of the invention having sliding uprights in the resting position.
Figure 24:
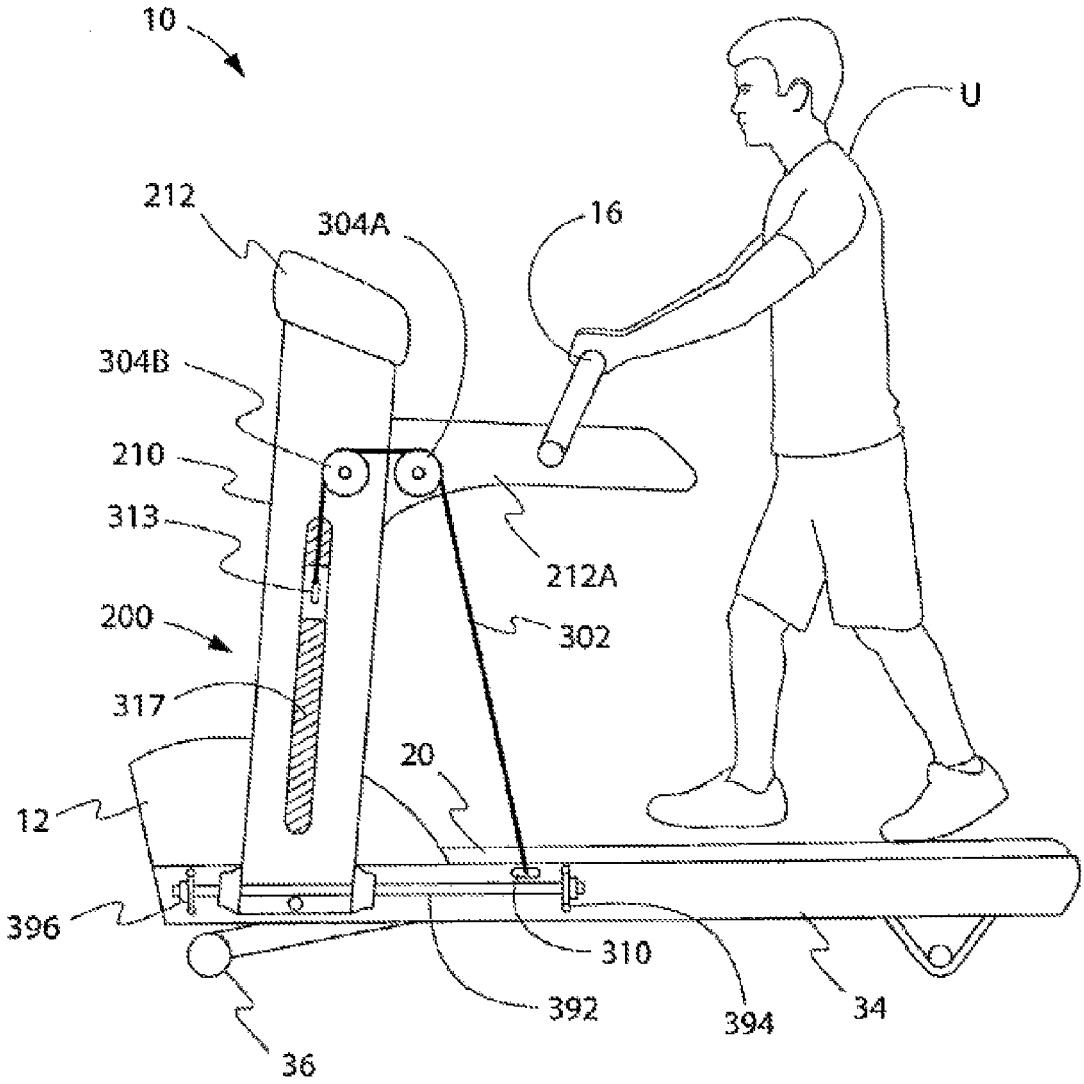
FIG. 24 is a side view of the alternate embodiment shown in FIG. 23 in the operating position.

FIGS. 20-24 illustrate several exemplary alternate embodiments of the invention. FIG. 20 is a perspective view of an alternate embodiment of the invention having a pushing bar pivotally connected to both console arms. FIG. 21 is a side view of an alternate embodiment of the invention having pivoting uprights in the resting position in which the uprights and console pivot. FIG. 22 is a side view of the alternate embodiment shown in FIG. 21 in the operating or resisting position. FIG. 23 is a side view of an alternate embodiment of the invention having sliding uprights in the resting position in which the uprights and console slide. FIG. 24 is a side view of the alternate embodiment shown in FIG. 23 in the operating position. In FIGS. 21-24, the pushing handle(s) or pushing bar is rigidly attached to the console arms such that pushing on the pushing handle(s) or pushing bar causes the entire console structure to pivot (FIGS. 21 and 22) or slide (FIGS. 23 and 24).

Figure 25:
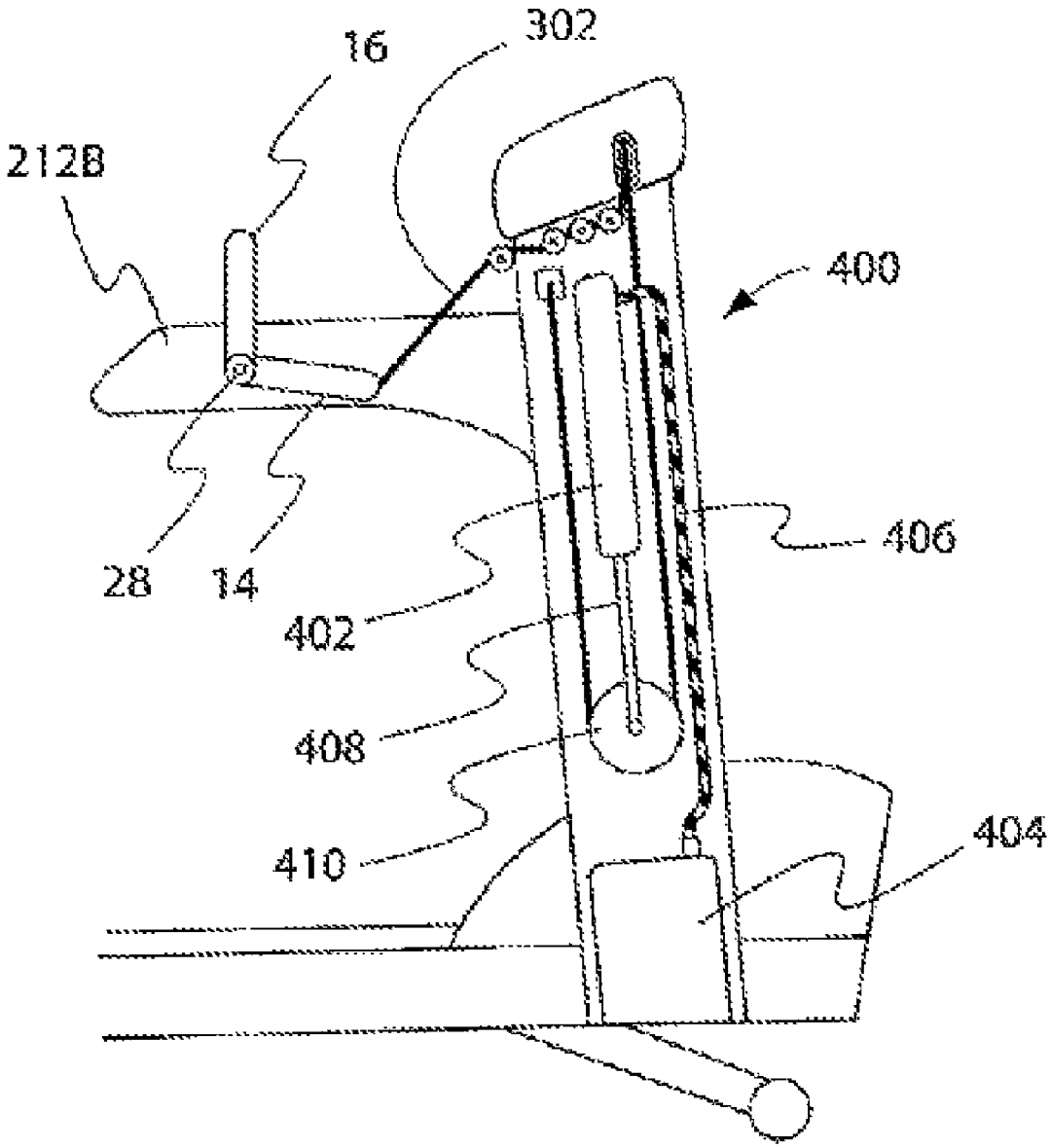
FIG. 25 is a side view, partly in section, of an alternate pneumatic resistance mechanism in the resting position.
Figure 26:
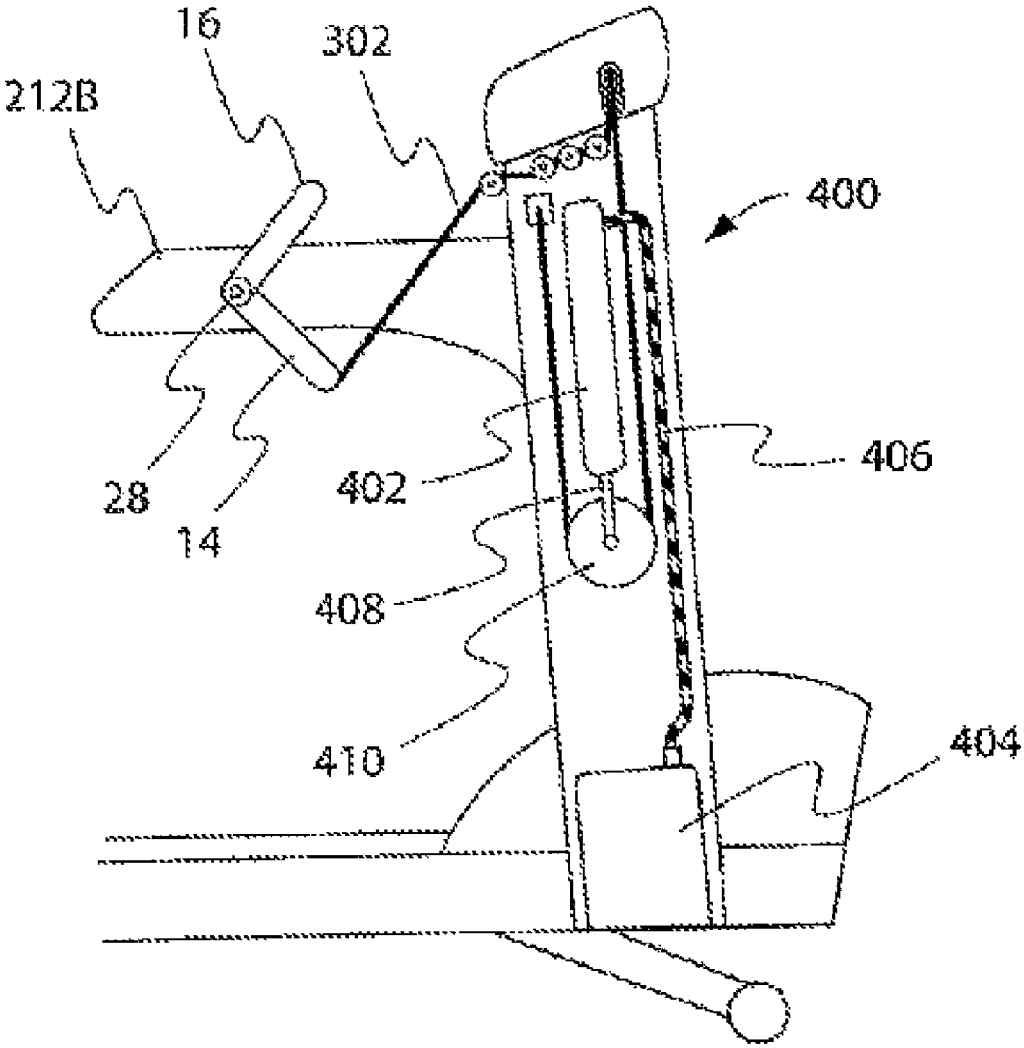
FIG. 26 is a side view, partly in section, of the alternate pneumatic resistance mechanism in a partially extended resistance position.
Figure 27:
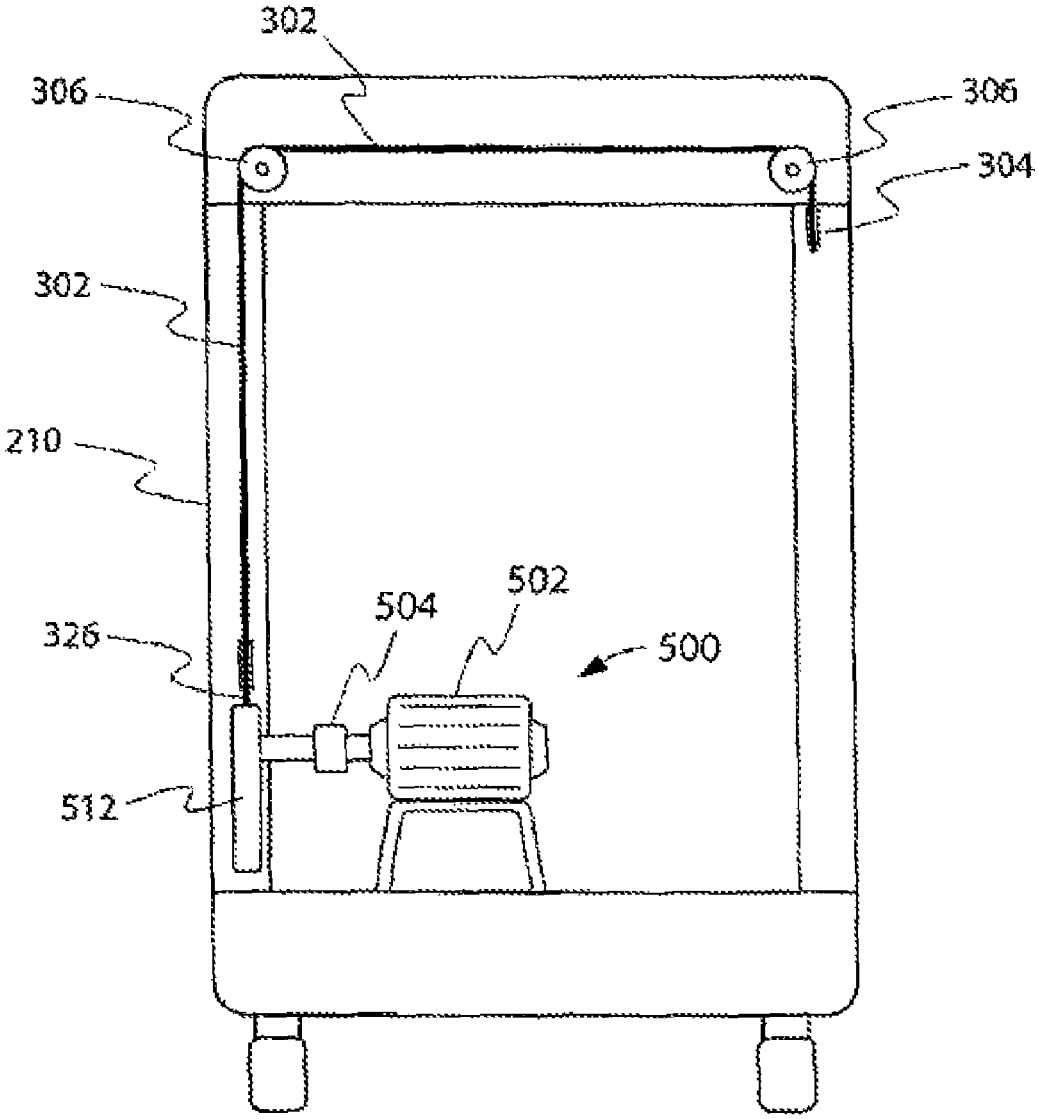
FIG. 27 is a front view, partly in section, of an alternate electric motor and braking resistance mechanism.

FIG. 25 is a side view, partly in section, of an alternate pneumatic or hydraulic resistance mechanism in the resting position. FIG. 26 is a side view, partly in section, of the alternate pneumatic or hydraulic resistance mechanism in a partially extended resistance position. FIG. 27 is a front view, partly in section, of an alternate electric motor clutch brake resistance mechanism.

Figure 28:
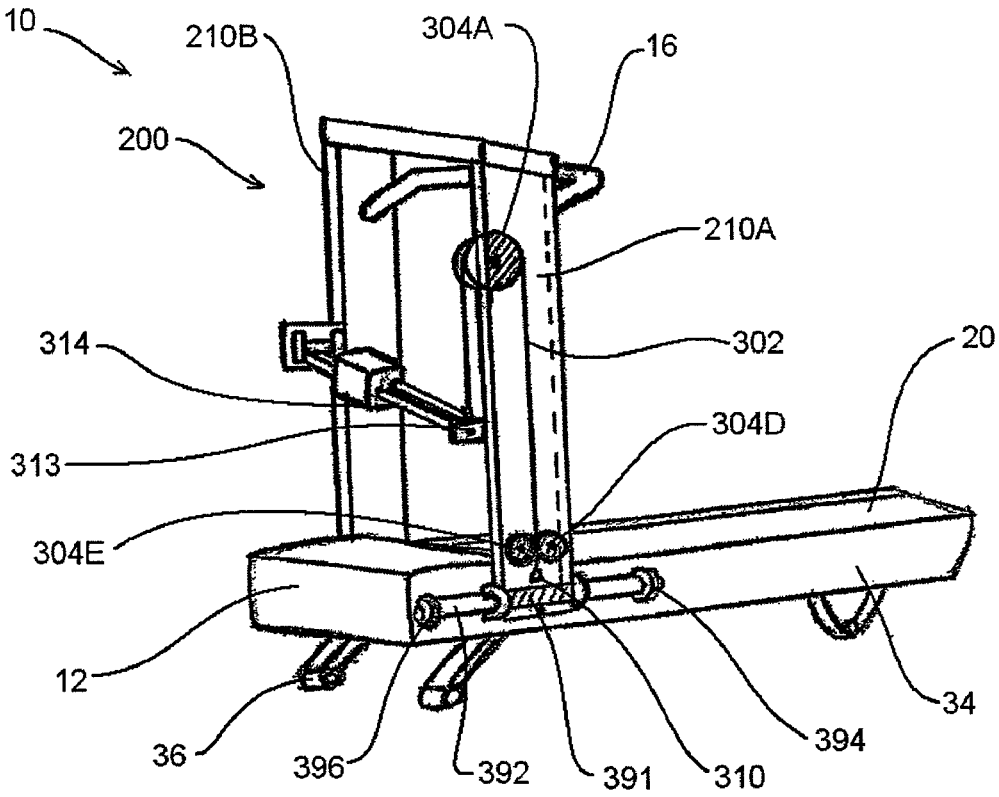
FIG. 28 is a perspective left side front view of an alternate embodiment of the invention having a sliding pushing and pulling console.
Figure 29:
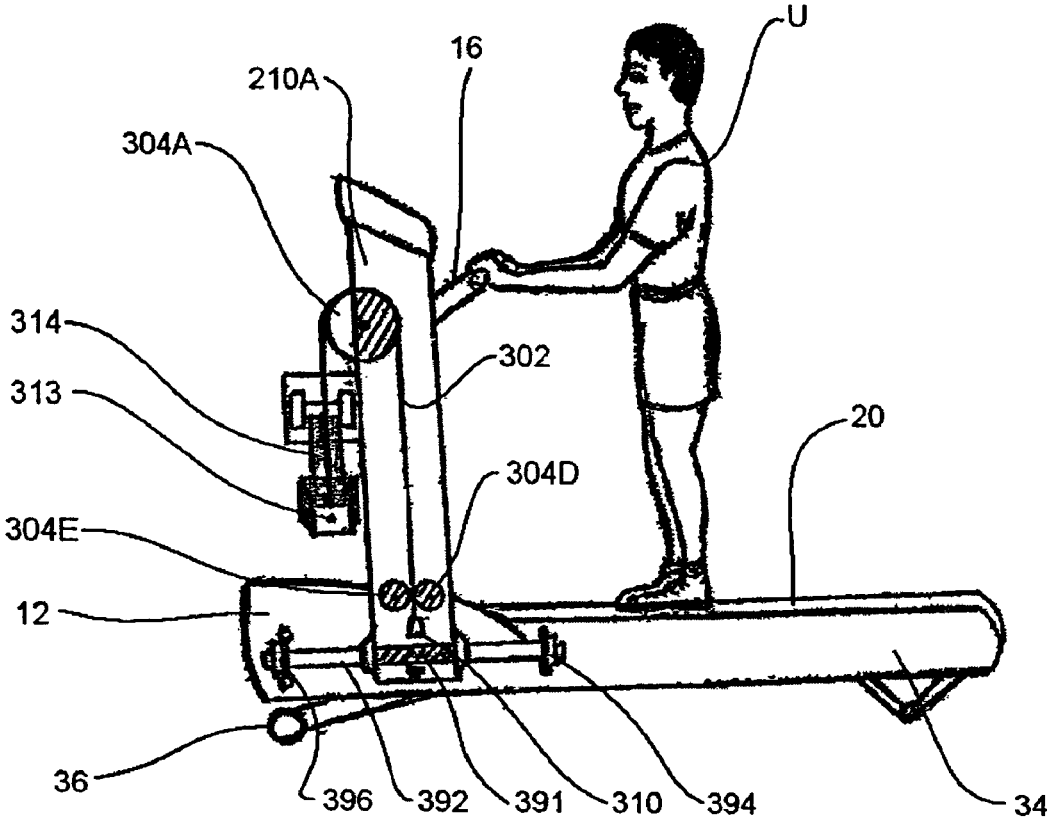
FIG. 29 is a left side view of the embodiment of FIG. 28 shown in the neutral position with the load resting.
Figure 30:
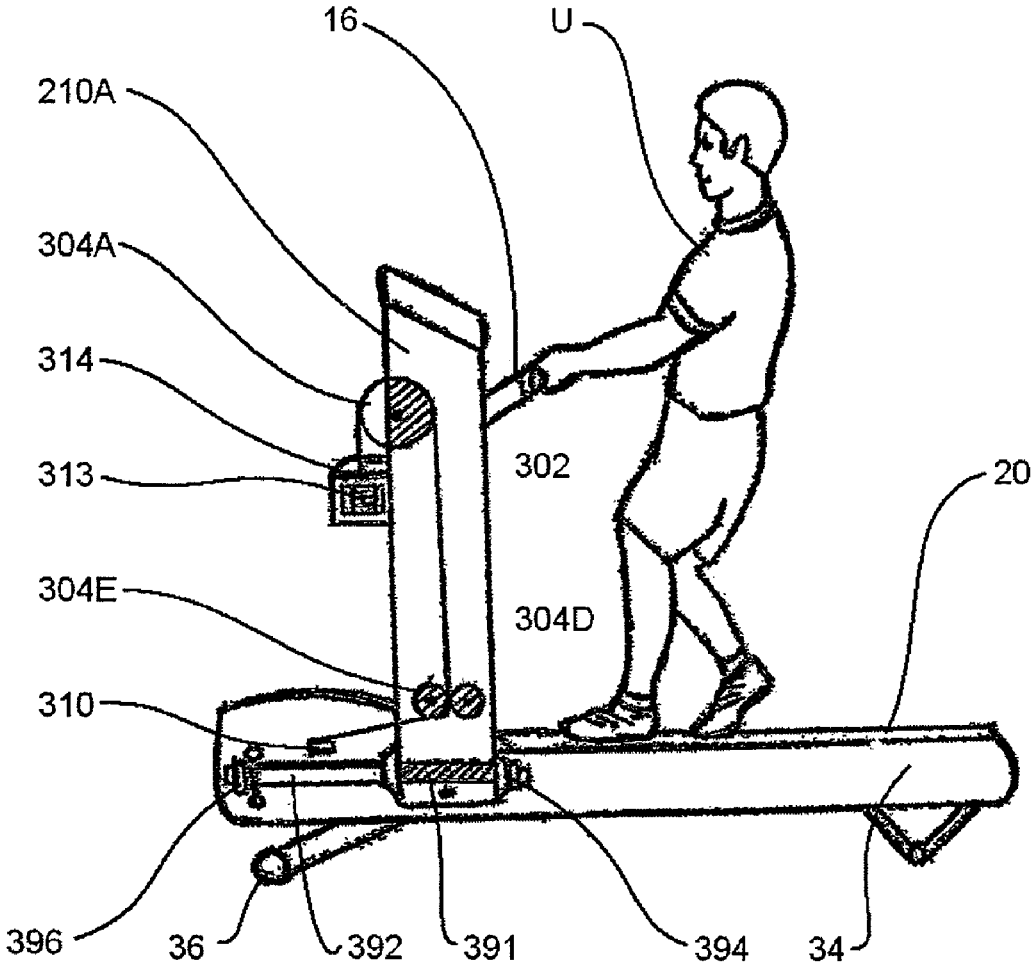
FIG. 30 is a left side view of the embodiment of FIG. 28 shown in the pulling position in which the load is engaged.
Figure 31:
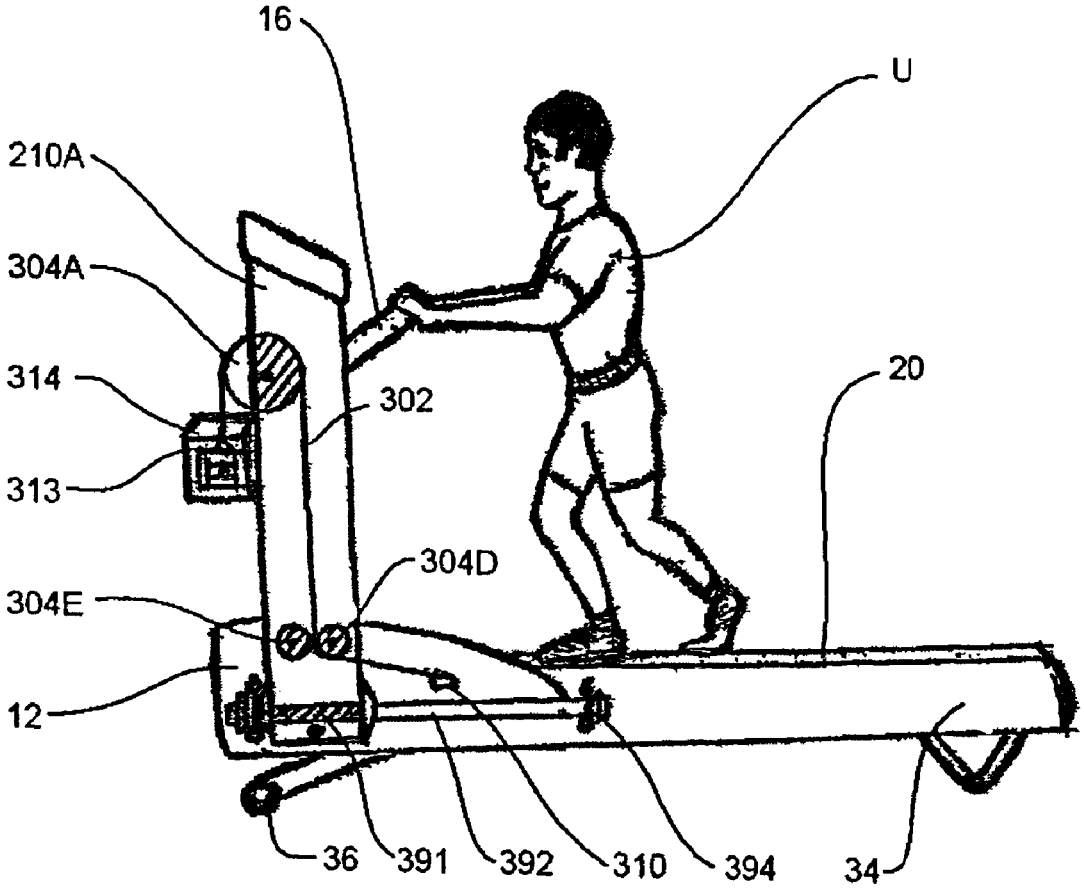
FIG. 31 is a left side view of the embodiment of FIG. 28 shown in the pushing position in which the load is engaged.
Figure 32:
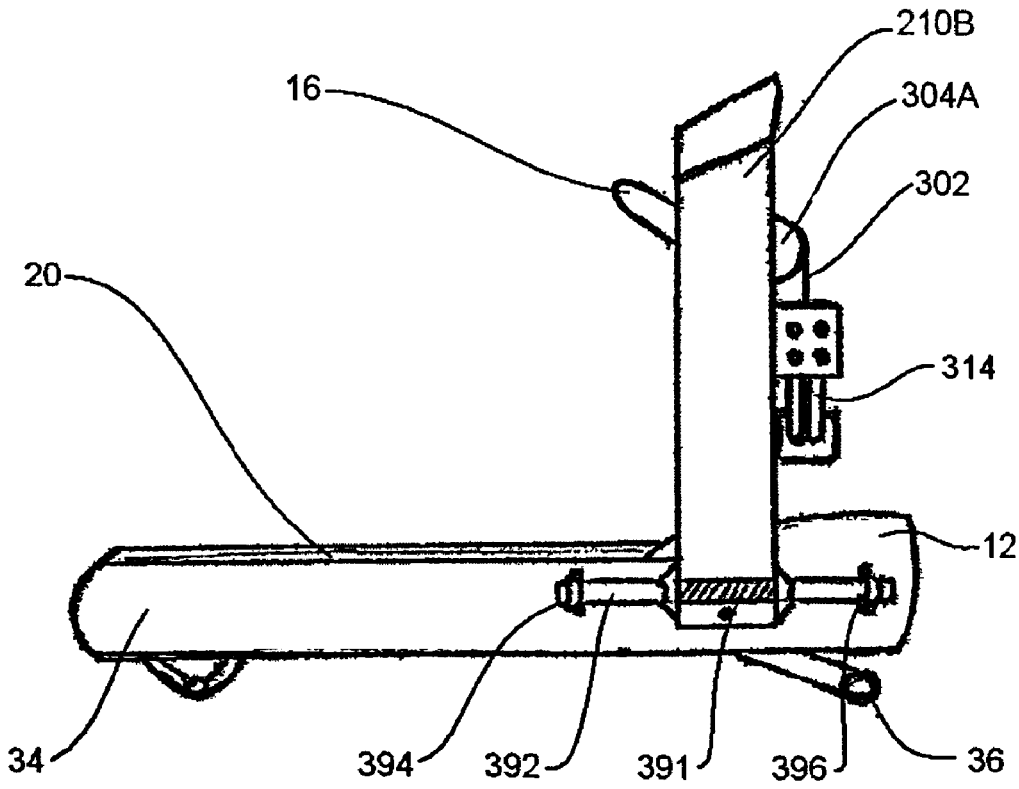
FIG. 32 is a right side view of the embodiment of FIG. 28 shown in the neutral position with the load resting.

FIG. 28 is a perspective left side front view of an alternate embodiment of the invention having a sliding pushing and pulling console that allows the user to engage in both pushing and pulling exercise regimens. FIG. 29 is a left side view of the embodiment of FIG. 28 shown in the neutral position with the load in a resting position. FIG. 30 is a left side view of the embodiment of FIG. 28 shown in the pulling position in which the load is engaged. FIG. 31 is a left side view of the embodiment of FIG. 28 shown in the pushing position in which the load is engaged. FIG. 32 is a right side view of the embodiment of FIG. 28 shown in the neutral position with the load resting.

Figure 33:
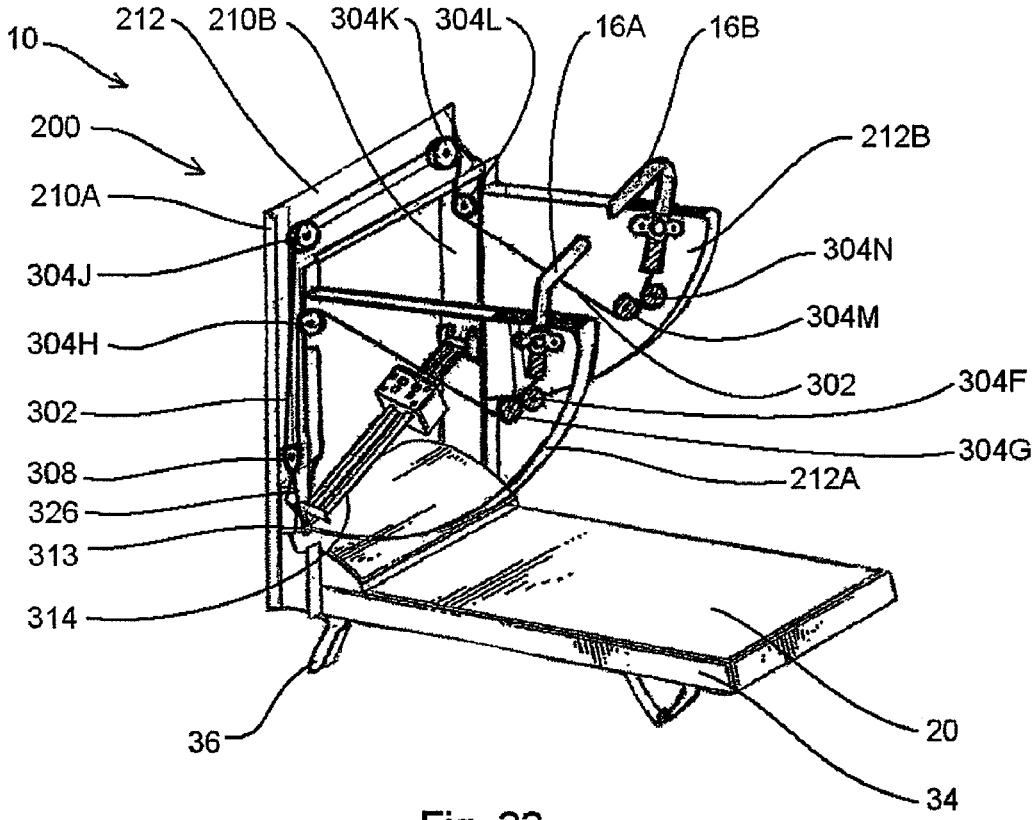
FIG. 33 is a perspective view in partial cutaway of an alternate embodiment of the invention having independent handles.
Figure 34:
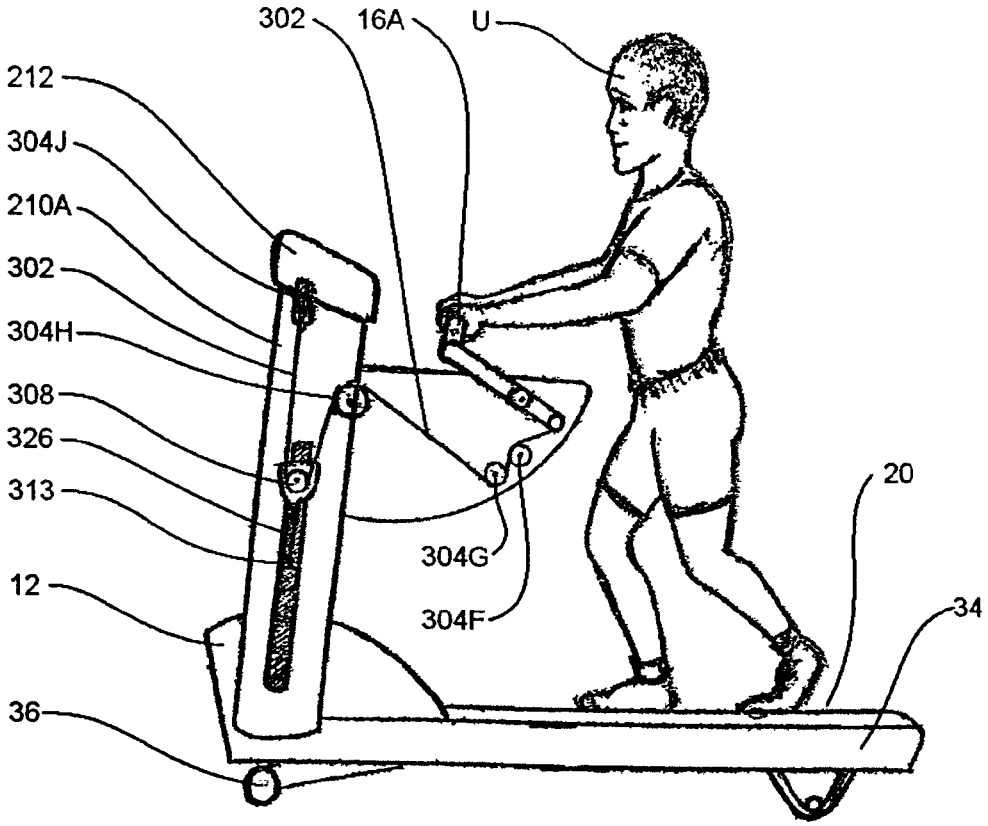
FIG. 34 is a left side view of the embodiment of FIG. 33 shown in the pushing position with the load engaged.
Figure 35:
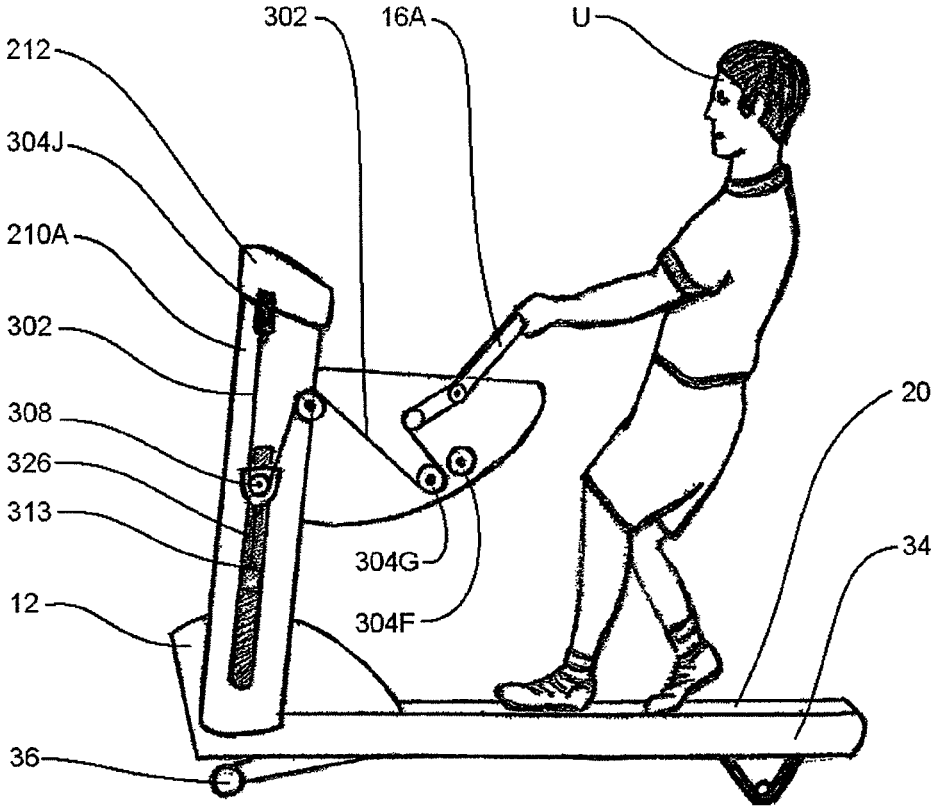
FIG. 35 is a left side view of the embodiment of FIG. 33 shown in the pulling position with the load engaged.

FIG. 33 is a perspective view in partial cutaway of an alternate embodiment of the invention having independent handles attached to a rigid console that allow the user to engage in both pushing and pulling exercise regimens by pushing and/or pulling on the handles. FIG. 34 is a left side view of the embodiment of FIG. 33 shown in the pushing position with the load engaged. FIG. 35 is a left side view of the embodiment of FIG. 33 shown in the pulling position with the load engaged.

Figure 36:
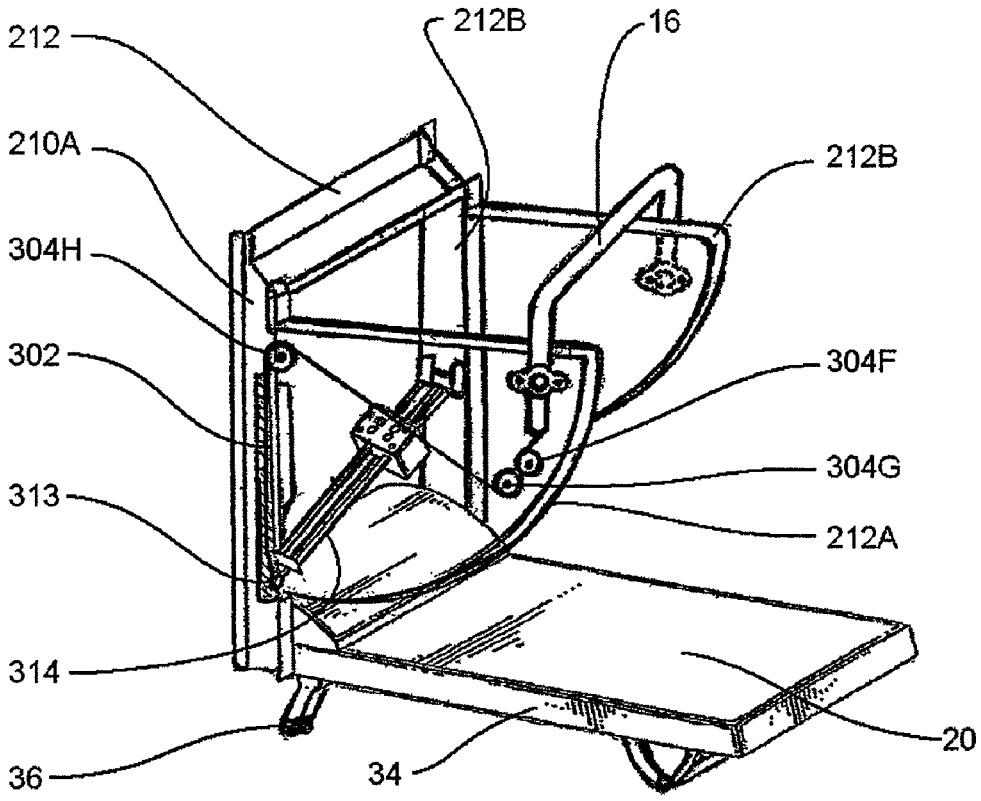
FIG. 36 is a perspective view in partial cutaway of an alternate embodiment of the invention having a single handle.
Figure 37:
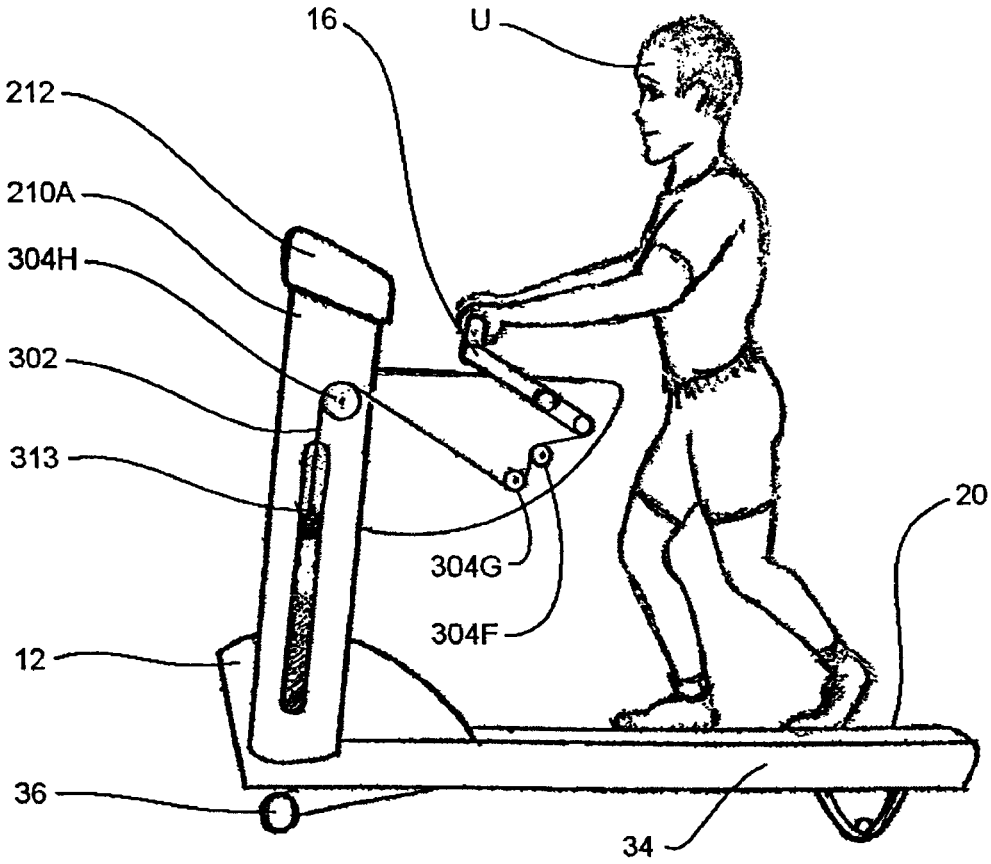
FIG. 37 is a left side view of the embodiment of FIG. 36 shown in the pushing position with the load engaged.
Figure 38:
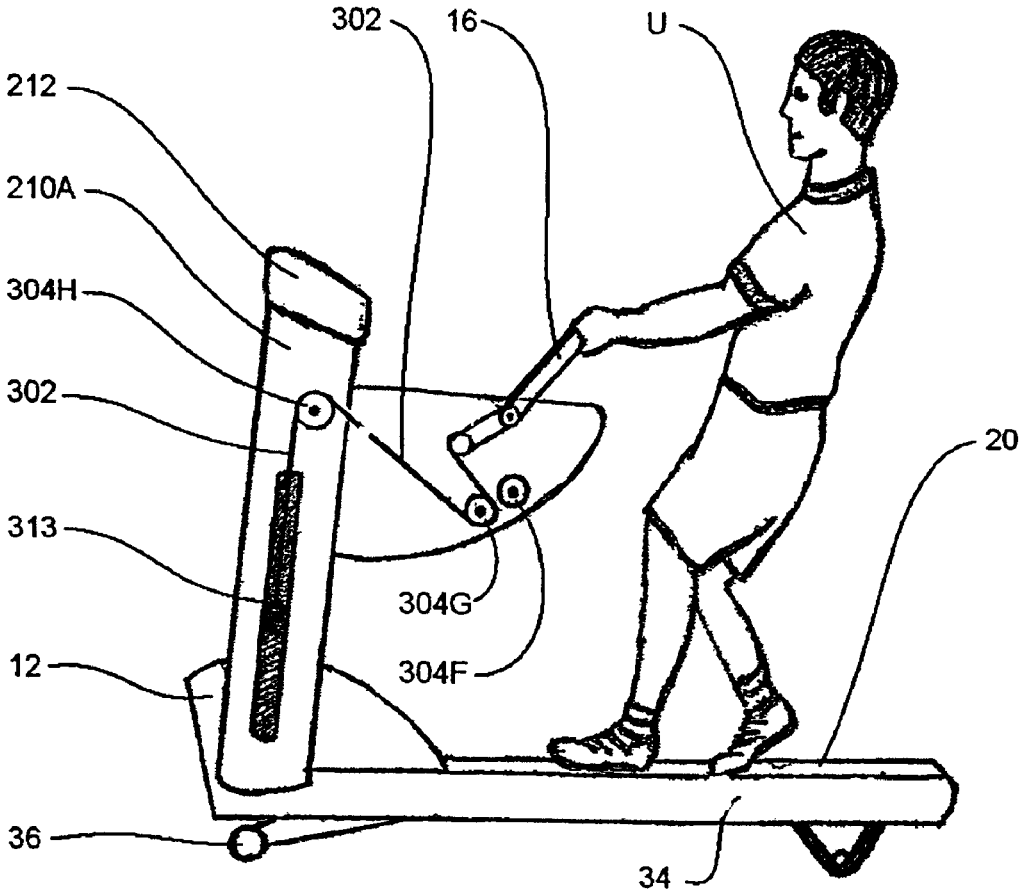
FIG. 38 is a left side view of the embodiment of FIG. 36 shown in the pulling position with the load engaged.

FIG. 36 is a perspective view in partial cutaway of an alternate embodiment of the invention having a single handle attached to a rigid console that allows the user to engage in both pushing and pulling exercise regimens by pushing or pulling on the handle. FIG. 37 is a left side view of the embodiment of FIG. 36 shown in the pushing position with the load engaged. FIG. 38 is a left side view of the embodiment of FIG. 36 shown in the pulling position with the load engaged.

Figure 39:
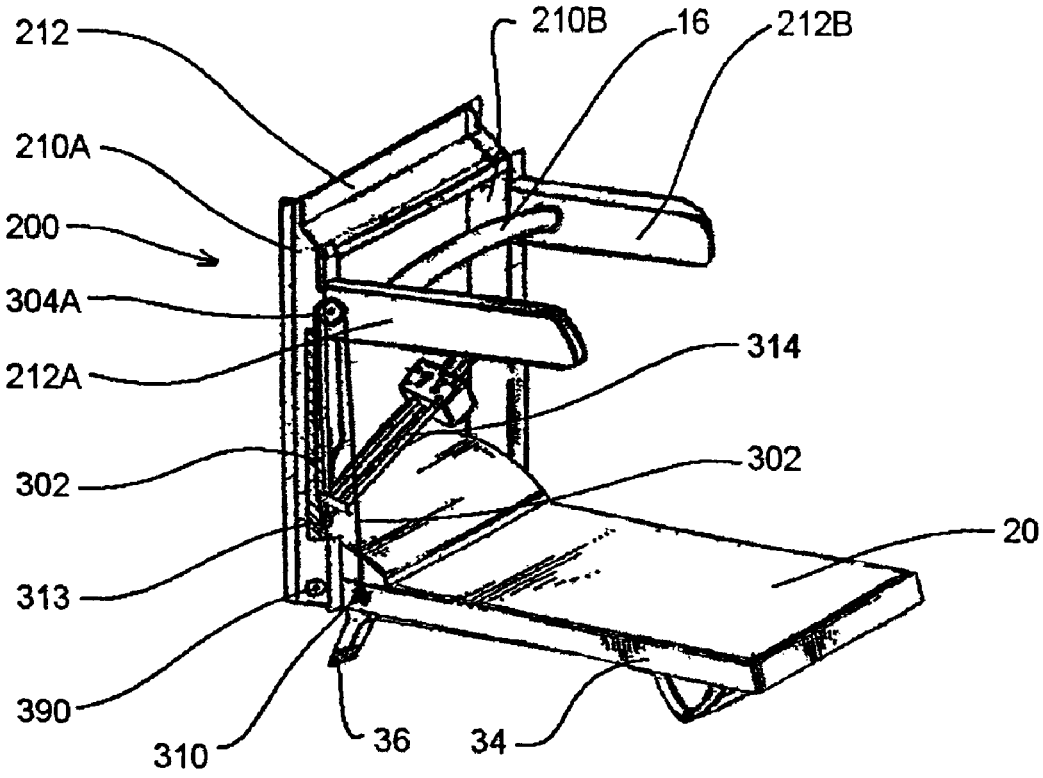
FIG. 39 is a perspective left side view of an alternate embodiment of the invention having a pivoting pushing and pulling console.
Figure 40:
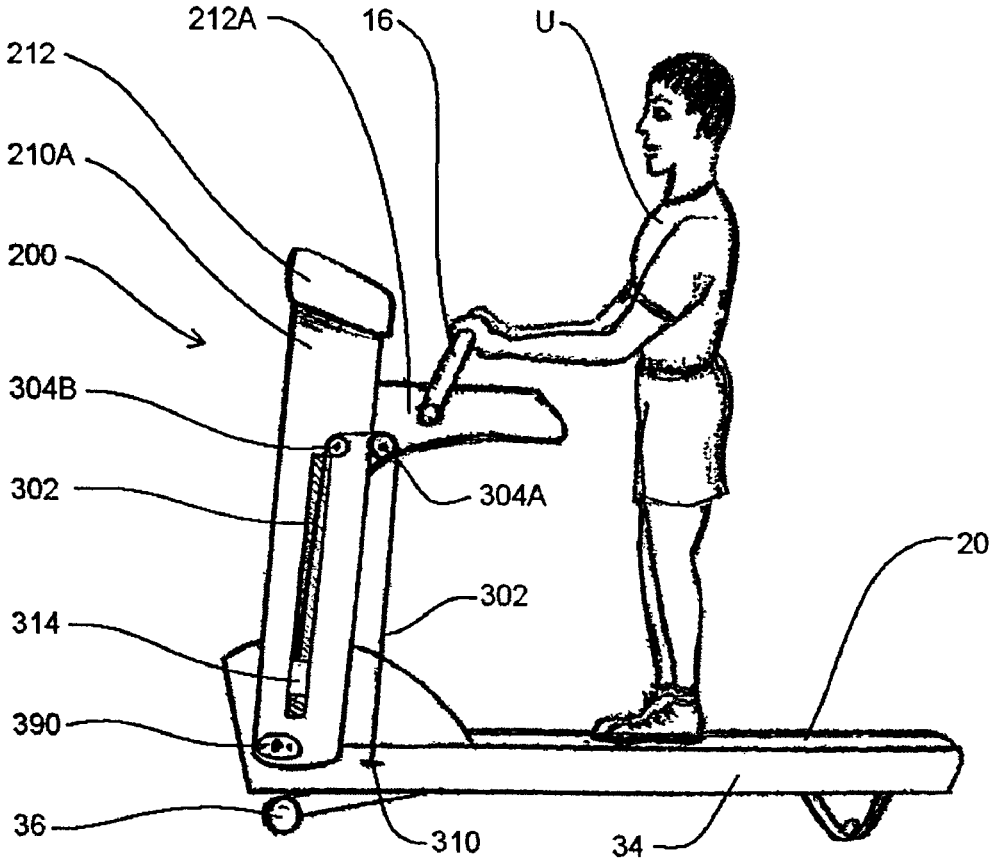
FIG. 40 is a left side view of the embodiment of FIG. 39 shown in the neutral position with the load resting.
Figure 41:
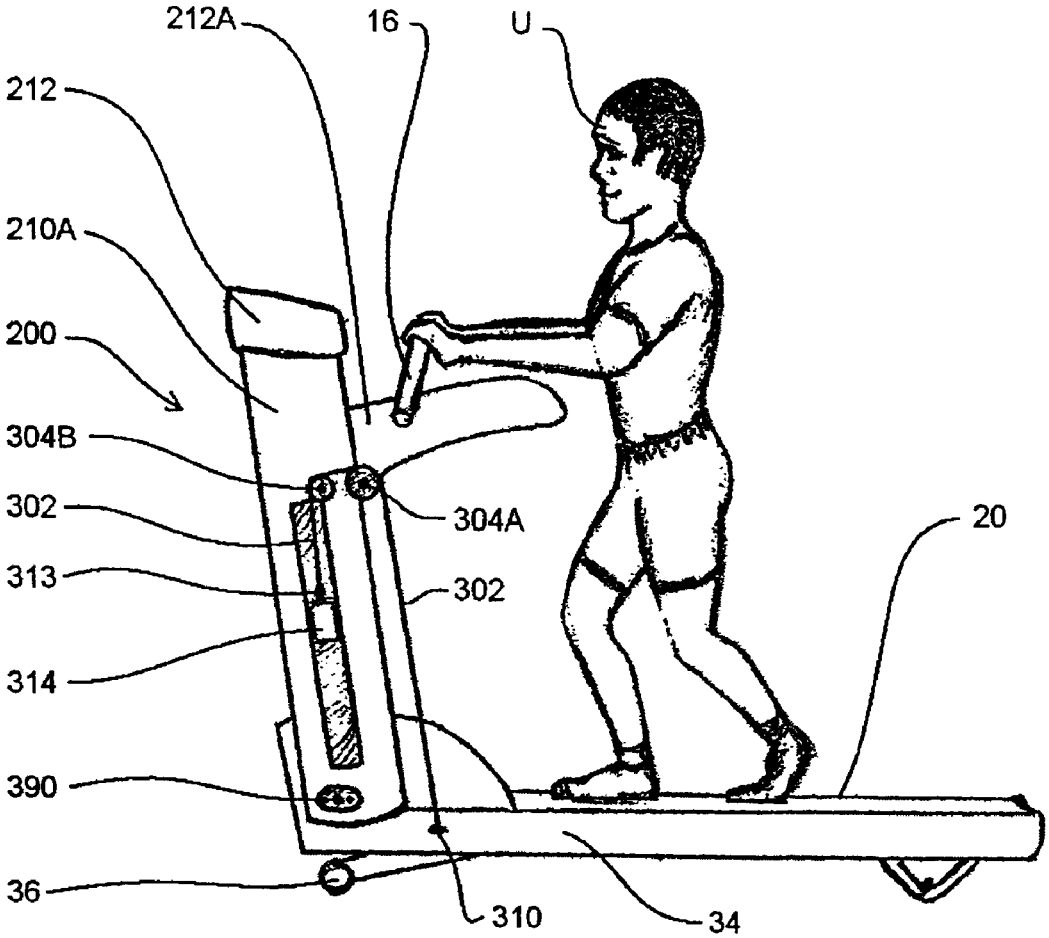
FIG. 41 is a left side view of the embodiment of FIG. 39 shown in the pushing position in which the load is engaged.
Figure 42:
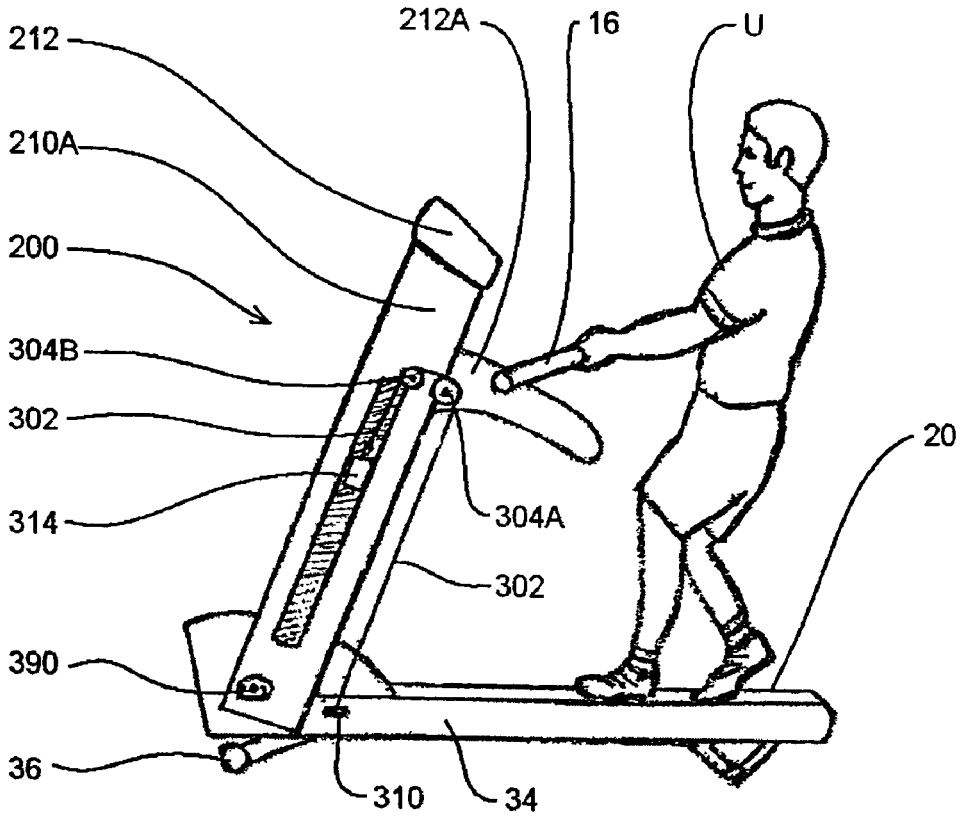
FIG. 42 is a left side view of the embodiment of FIG. 39 shown in the pulling position in which the load is engaged.

FIG. 39 is a perspective left side view of an alternate embodiment of the invention having a pivoting pushing and pulling console that allows the user to engage in both pushing and pulling exercise regimens by pushing or pulling on the console. FIG. 40 is a left side view of the embodiment of FIG. 39 shown in the neutral position with the load resting. FIG. 41 is a left side view of the embodiment of FIG. 39 shown in the pushing position in which the load is engaged. FIG. 42 is a left side view of the embodiment of FIG. 39 shown in the pulling position in which the load is engaged.

Throughout this specification, the terms operating mode and resisting mode will be used interchangeably. For example, when the invention is being used in the pushing or pulling exercise regimen, it is considered to be in the operating mode or the resisting mode, with the resistance mechanism providing pushing or pulling resistance to the user. Also throughout this specification, the resistance mechanism generally will be referred to generically as a resistance mechanism, which includes weight resistance mechanisms, hydraulic resistance mechanisms, electronic resistance mechanisms, motor-brake resistance mechanisms, and the alternatives and equivalents.

FIGS. 1-27 generally illustrate a pushing embodiment of the invention. FIGS. 28-41 generally illustrate a pushing and pulling embodiment of the invention.

FIGS. 1-3 and 10-17 all illustrate one embodiment of the invention showing a center mounted modified moment arm weight resistance mechanism. A true moment arm can be substituted for the modified moment arm with only minor engineering changes well within the skill level of a person of ordinary skill in the relevant art. FIGS. 4-6 all illustrate another embodiment of the invention showing a side mounted moment arm weight resistance mechanism. A modified moment arm can be substituted for the true moment arm with only minor engineering changes well within the skill level of a person of ordinary skill in the relevant art. Many of the remaining figures are generally applicable to both embodiments.

FIGS. 1-3 are views of one embodiment of the invention structured with a modified moment arm as the exemplary resistance mechanism and illustrating the relationship between the various major components of the device. Treadmill 10 has a lower base 12 housing the internal mechanical components of treadmill 10. Projecting upwardly from base 12 is console support structure 200 to which moment arm 314 is pivotally connected or supported. Pushing arm 14, on which pushing handle 16 is mounted, is operatively connected to moment arm 314, which is part of resistance mechanism 300.

Console support structure 200 preferably is fixedly attached to base 12 and comprises two uprights 210 that are secured to base 12 at or along the sides of base 12 at points proximal to the front end of base 12. Console 212 extends generally horizontally between uprights 210 and preferably is located at or proximal to the top of uprights 210. Thus, console 212 in a preferred embodiment is fixedly attached to console support structure 200 and in one embodiment is unmovable or at least not movable as part of the exercise regimen. The combination of console support structure 200, uprights, 210 and the various structural components thereof also are referred to as the frame.

Moment arm 314 extends generally horizontally between uprights 210 and can be pivotally attached to one upright 210, thus allowing moment arm 314 to pivot upwards and downwards generally between uprights 210. Rod supports 253 comprising bearings are one means by which moment arm 314 can be pivotally secured via pivot rod 252 to upright 210. Rod supports 253 can be attached directly to upright 210 or can be mounted on upright 210 via brackets or the like. For example, in some circumstances, it can be advantageous to mount moment arm 314 in front of console support structure 200 rather than directly between uprights 210. In such an embodiment, additional brackets would support rod supports 253 at a position in front of uprights 210, that is, at a position on the opposite side of uprights 210 from user U and treadmill belt 20, or at a position behind uprights 210, that is, at a position on the same side of uprights 210 as user U and treadmill belt 20. One end of moment arm 314 can extend though one of the uprights 210 (the upright that moment arm 314 is not pivotally attached to) such that moment arm 314 can be operatively connected to pushing handle 16. Alternatively, if moment arm 314 is mounted in front of console support structure 200, then moment arm 314 would pass in front of and not through upright 210. Moment arm 314 preferably is mounted more proximal to the bottom of uprights 210, that is, more proximal to base 12. Although this location is generally arbitrary, this location has been found to be preferable from a mechanics standpoint in that this location allows the resistance mechanism 300 to be mounted lower on the treadmill 10, thus providing a lower center of gravity and greater stability for the treadmill 10.

Pushing arm 14 can comprise one, two or more sections, and preferably two sections, not including pushing handle 16 as a section. Pushing arm 14 sections preferably are rigidly attached to each other, or are a single bent or straight structure, and also preferably are rigidly attached to pushing handle 16. Pushing arm 14 can be a rod-like, tubular, flat rigid or semi-rigid structure, or the equivalent, that is pivotally connected to console arms 212A. Pushing arms 14 preferably are pivotally attached to console arms 212A such that operational movement of pushing handles 16/pushing arms 14 actuates resistance mechanism 300. Pushing arms 14 also can be pivotally attached to the treadmill base 12, the uprights 210, or the console 212 with minor engineering changes.

Pushing handle 16 is mounted generally towards the distal end of console arms 212A (distal to console 212), which also is proximal to user U when user U is in the correct position for operating the treadmill 10. The combination of pivot points 28 and the rotation of pushing arm 14 allows desired motion of pushing arm 14 and pushing handle 16 relative to user U. The movable pushing handle 16 solves the problem of allowing the user U to activate the resistance mechanism 300, while at the same time maintain a position on the treadmill 10 and conduct the exercise regiment by pushing against an adjustable but constant and static resistance.

FIGS. 2 and 3 are set of side views of the treadmill 10 in which a user U would be operating the treadmill 10 in a generally flat or level pushing simulation. In this position, user U would be simulating a generally level surface pushing motion and walking or running forwards and pushing on pushing handle 16, and thus pushing against resistance mechanism 300. In FIG. 2 the invention is shown in a resting position, meaning resistance mechanism 300 is not providing resistance to user U, and in FIG. 3 the invention is shown in an operating position, meaning resistance mechanism 300 is providing resistance to user U, as disclosed in more detail herein.

As can be seen in FIGS. 2 and 3, which are being used to show the general components and structural layout of the treadmill 10, pushing handle 16 (and pushing arm 14) is operationally connected to resistance mechanism 300 via main cable 302, pulley system comprising pulleys 304, 306, 308, and secondary cable 326. The pushing handle 16/pushing arm 14 combination can be structured in various configurations. In the embodiment generally shown in the figures and use as the illustrative embodiment in this specification, there are two separate pushing handles 16 each connected to a separate pushing arm 14, with one set of pushing handle 16A/pushing arm 14A being attached to a first console arm 212A (the left side) and another set of pushing handle 16B/pushing arm 14B being attached to a second console arm 212B (the right side). In a one alternate embodiment illustrated in and disclosed in connection with FIG. 20, there is only one pushing handle 16, namely a pushing bar 16C, connected to two pushing arms 14. In another alternate embodiment, there may only be one set of pushing handle 16/pushing arm 14 located on either the first console arm 212A or on the second console arm 212B.

Main cable 302 is attached at one end to first pushing arm 14A and is attached at another end to second pushing arm 14B. In between pushing arms 14A, 14B, main cable 302 travels through directional pulleys 304, console pulleys 306, and lifting pulley 308. Secondary cable 326 operatively connects lifting pulley 308 with the non-pivoting end of moment arm 314, and therefore with resistance mechanism 300, and is attached at one end to lifting pulley frame 308A and is attached at another end to moment arm 314. As moment arm 314 is being pivoted by the action of secondary cable 326 attached to the non-pivoting end of moment arm 314, moment arm 314 in this embodiment is referred to as a modified moment arm.

Directional pulleys 304 and console pulleys 306 can be and preferably are fixed class 1 pulleys that are mounted on or within console 212 or console arms 212A, 212B to direct and redirect the force of main cable 302 and do not move, except to rotate as main cable 302 moves over them. Lifting pulley 308 can be and preferably is a movable class 2 pulley to transform the force of main cable 302 to secondary cable 326. Although all pulleys 304, 306, 308 can be fixed pulleys or movable pulleys, or a combination of fixed and movable pulleys, depending on the relative force needed to operate the resistance mechanism 300, this combination of fixed and movable pulleys provides a suitable transformation of the user's U energy to the actuation of the resistance mechanism 300.

Weight 316 is operationally connected to moment arm 314 and along with moment arm 314 causes a moment about pivot point 322, thus urging a rotation of moment arm 314 about pivot point 322. As moment arm 314 is rotationally urged downwards by weight 316, moment arm 314 acts on secondary cable 326 by pulling secondary cable 326 downward or at least imparting a downward tensional force on secondary cable 326. The downward force on secondary cable 326 is imparted to lifting pulley 308, which imparts a tensional force on main cable 302. The tensional force on main cable 302 is imparted to pushing arm(s) 14 and pushing handle(s) 16, which imparts a pushing force on the user U grasping the pushing handle(s) 16. This creates the pushing sensation and weight resistance of the invention.

As long as weight 316 remains at the same position along moment arm 314, simple physics dictates that the magnitude of the weight or moment will remain approximately constant throughout the rotational arc of moment arm 314 provided for in this invention, thus imparting an approximately constant force on the cable 326/pushing handle 16 system. Thus, user U will be presented with an approximately constant force simulating the pushing action (the force pushes back on pushing handle 16 opposite to the direction user U is pushing). This force also is static in that the force applied by moment arm 314 and weight 316 in one direction is balanced by the force applied by user U in the opposite direction, for a net force of zero. Thus, the invention provides an approximately constant static force for the user U. By moving weight 316 along moment arm 314, the magnitude of the moment, and therefore the magnitude of the force applied ultimately to pushing handle 16, can be adjusted and changed so as to provide different magnitudes of force to user U and different amounts of exertion during the exercise regimens.

FIG. 4 is a front view of another embodiment of the invention structured with a side mounted moment arm as the exemplary resistance mechanism 300 and illustrating the relationship between the various major components of the device. In this embodiment, moment arm pivot rod 252 is elongated and extends generally horizontally between uprights 210 and can be pivotally attached to each upright 210, thus allowing moment arm pivot rod 252 to rotate axially generally between uprights 210. Bearings 214 are one means by which moment arm pivot rod 252 can be rotationally secured or journaled to uprights 210. Bearings 214 can be attached directly to uprights 210 or can be mounted on uprights 210 via brackets or the like.

FIG. 5 is a side view of the treadmill 10 embodiment shown in FIG. 4 showing user U operating the treadmill 10 in a generally flat or level pushing simulation. In this position, user U is simulating a generally level surface pushing motion and is walking or running forwards and pushing on pushing handle 16, and thus pushing against resistance mechanism 300. Resistance mechanism 300 is shown in an operating position, meaning resistance mechanism 300 is providing resistance to user U.

As can be seen in FIG. 5, user U stands on the treadmill 10, specifically belt 20, and grips pushing handles 16. Pushing handles 16 (and pushing arms 14) are operationally connected to resistance mechanism 300 via main cable 302, pulley system comprising pulleys 304, 306, 308, and secondary cable 326. Generally, main cable 302 is attached at one end to first pushing arm 14A and is attached at another end to second pushing arm 14B. In between pushing arms 14A, 14B, main cable 302 travels through directional pulleys 304, console pulleys 306, and lifting pulley 308. Secondary cable 326 operatively connects lifting pulley 308 with cam 312, and therefore with resistance mechanism 300, and is attached at one end to lifting pulley frame 308A and is attached at another end to cam 312.

Moment arm resistance mechanism 300 as illustratively shown in FIGS. 5 and 6 comprises cam 312, moment arm 314, weight 316, weight adjusting drive 318, weight adjusting mechanism support 320, pivot point 322 (corresponding to the end of the moment arm pivot rod 252), and weight adjusting motor 324. Moment arm 314 is secured to moment arm pivot rod 252 and extends generally normal to the axis of moment arm pivot rod 252. Thus, moment arm 314 acts as a cantilever extending from moment arm pivot rod 252, and the combination of moment arm 314 and moment arm pivot rod 252 can rotate about the axis of moment arm pivot rod 252. In this embodiment, moment arm 314 is a generally flat runway on which weight 316 can roll, and can be termed an open arm.

Weight 316 causes a moment about pivot point 322, thus urging a rotation of moment arm pivot rod 252 about its axis. As moment arm pivot rod 252 is rotationally urged, cam 312 also is rotationally urged in the same direction, thus acting on secondary cable 326 by pulling secondary cable 326 downward or at least imparting a downward tensional force on secondary cable 326. The downward force on secondary cable 326 is imparted to lifting pulley 308, which imparts a tensional force on main cable 302. The tensional force on main cable 302 is imparted to pushing handle 16, which imparts a pushing force on the user U grasping the pushing handles 16. This creates the pushing sensation and weight resistance of the invention.

FIG. 6 is a side view of the invention very similar to FIG. 5 but showing user U operating the treadmill 10. In this position, user U is simulating a pushing motion and is walking or running forwards and pushing on pushing handles 16, and thus pushing against resistance mechanism 300. As an alternative, the invention can be operated in an inclined position in which the front (console end) of the treadmill 10 is elevated relative to the rear of the treadmill 10, to allow the simulation of pushing a load uphill.

A second embodiment of moment arm resistance mechanism 300 as illustratively shown in FIG. 6 comprises cam 312, moment arm 314, weight 316, weight adjusting drive 318, pivot point 322 (corresponding to the end of the moment arm pivot rod 252), and weight adjusting motor 324. Moment arm 314 can be secured to moment arm pivot rod 252 via weldments 344, and extends generally normal to the axis of moment arm pivot rod 252. Thus, moment arm 314 acts as a cantilever extending from moment arm pivot rod 252, and the combination of moment arm 314 and moment arm pivot rod 252 can rotate about the axis of moment arm pivot rod 252.

As can be seen in FIGS. 2, 3, 5 and 6, base 12 can comprise a separate motor housing 32 and belt platform 34. Motor housing 32 contains the various conventional motors and associated components for moving belt 20 and for raising and lowering base 12 and belt platform 34 for inclined exercising. Alternatively, each of the above disclosed elements can be located as desired in either motor housing 32 or belt platform 34 by the person of ordinary skill in the art. In such a configuration, the inclination of belt 20 is accomplished by an incline motor raising the front end of base 12 relative to the rear end of base 12, in a manner well known in the art. For example, as shown in a comparison of FIGS. 5 and 6, an illustrative inclination mechanism is provided to permit inclination of belt platform 34 and belt 20. Illustrative lift mechanisms include a leg lift, comprising an incline motor and front legs. Such lift mechanisms are known in the treadmill art.

Weight adjusting motor 324 can be a bidirectional electric motor. Preferably, weight adjusting motor 324 is located proximal to pivot point 322 as weight adjusting motor 324 does have some weight and, if located on the free end 330 of moment arm 314, would impart a certain amount of weight to moment arm 314 creating an increased base moment about pivot point 322. Weight adjusting motor 324 can be selected to move weight 316 relative to or along moment arm 314 away from or towards pivot point 322, and therefore must be of sufficient power to accomplish this task. Alternatively, weight adjusting motor 324 can be mounted outside of moment arm 314 and a hole can be located on the end of moment arm 314 to allow weight adjusting drive to extend therethrough and into the interior of moment arm 314 to cooperate with weight 316.

Weight 316 can be any structure having mass. In the illustrative example shown, weight 316 is a solid mass having an internal threaded passage extending from a first side to an opposite second side or, as disclosed in connection with FIG. 8, a combination of an internal passage 352 and threaded nut 350. Internal threaded passage or nut 350 cooperates with the screw thread on weight adjusting drive such that when weight adjusting drive is turned or rotated by weight adjusting motor 324, weight 316 is forced to move linearly. Weight 316 can comprise optional wheels 332 on the bottom and optionally on the top that cooperate with moment arm 314 to allow the easier movement of weight 316 along moment arm 314. Thus, as weight adjusting motor 324 turns weight adjusting drive 318, the complimentary screw threads cooperate and force weight 316 to move linearly along or relative to moment arm 314.

The amount or level of pushing force imparted to the user U can be adjusted by moving weight 316 along the moment arm 314. By pushing force it is meant the counterforce created by the resistance mechanism 300 in response to the user pushing on pushing handles 16. The pushing force is equal to and opposite the force created by the user pushing on pushing handles 16. If weight 316 is proximal to pivot point 322, then the moment created by weight 316 is minimal and therefore the amount or level of pushing force imparted to the user U is minimized. If weight 316 is distal to the pivot point, then the moment created by weight 316 is maximized and therefore the amount or level of pushing force imparted to the user U is maximized. Conventional controls on movable pushing handles 16 or fixed console 212 or elsewhere operate weight adjusting motor 324 so as to move weight 316 to the desired position along moment arm 314 for imparting the desired amount or level of pushing force to the user U as the user U pushes on pushing handle 16.

Main cable 302 and secondary cable 326 can be of any flexible structure, such as a rope, a chain, a belt, monofilaments, braided wires, flexible materials, and other suitable equivalents, that allow a transfer of force between pushing handle 16/pushing arm 14 and resistance mechanism 300, and is not limited to a standard cable. As disclosed herein, main cable 302 can be directed around one or more pulleys 304, 306, 308 to direct or redirect main cable 302 between pushing arm 14 and resistance mechanism 300, and to prevent main cable 302 from becoming entangled in the internal mechanical components of treadmill 10. Thus, in operation, when user U grips pushing handle 16 and starts belt 20 moving, user U begins to walk or run in a simulated forwards direction relative to console 212, causing user U to push on pushing handle 16. This force transfers to main cable 302, which in turn acts on resistance mechanism 300 by lifting moment arm 314, thus creating the force or moment due to the weight of weight 316 (and the moment arm itself, as well as any components on or attached to moment arm 314), resulting in the pushing force, which in this respect also can be termed a counterforce to the force created by the user U pushing on pushing handles 16.

The degree of resistance can be controlled by user U. At settings in which weight 316 is creating a weight on moment arm 314 or a moment on moment arm 314 about pivot point 322, user U would be simulating pushing a weight (the force created by moment arm 314 as transferred to user U) and the exercise regimen would be similar to walking or running forwards while pushing an object of a weight comparable to the setting of resistance mechanism 300. The higher the setting of resistance mechanism 300 (that is, with weight 316 further from pivot point 322), the heavier the simulated object being pushed. With this arrangement, it is therefore possible to vary the weight resistance being pushed during the exercise regimen. However, once the desired resistance is set, the resistance is constant and static as transferred to pushing handles 16, thus imparting a constant and static resistance to the user U as long as the user U maintains the resistance setting. The resistance setting can be changed (increased, decreased) during the exercise regimen, at which point the resistance would be changed to the new resistance level, and would remain at that level until changed by the user U.

A comparison of the position of pushing arm 14 in FIGS. 2 and 5 versus FIGS. 3 and 6, respectively, shows how pushing arm 14 can move. Pushing arm 14 is shown in the at rest position in FIGS. 2 and 5, and in the operational position (partially pivoted) in FIGS. 3 and 6. Pushing arm 14 can pivot between the at rest position and a fully operational position, and the position of pushing arm 14 during operation is dependent on user U. Stops (not shown) prevent pushing arm 14 from moving past the at rest position in one direction of motion and the fully operational position in the opposite direction of motion.

FIGS. 2 and 3 also illustrate an embodiment of directional pulleys 304 and the main cable 302 configuration traveling through directional pulleys 304. Generally, main cable 302 is attached to first pushing arm 14A, loops over a first directional pulley 304A, loops through lifting pulley 308, loops over console pulleys 306, loops under second directional pulley 304B and over third directional pulley 304C, and then attaches to second pushing arm 14B. Directional pulleys 304 are used to redirect main cable 302 towards console pulleys 306 and lifting pulley 308 such that main cable 302 enters and travels through console 212 and console pulleys 306 at proper angles. Directional pulleys 304 also helps maintain tension within the main cable 302 and helps reduce the possibility that main cable 302 will fall off of pulleys 304. Other configurations of pulleys 304 and pulley 306 are contemplated, and this configuration is only for illustrative purposes.

FIG. 7 is a perspective view of a preferred embodiment of a modified moment arm resistance mechanism 300 in which the moment arm 314 is raised and lowered by a cable 302 attached to the arcing end 346 of the moment arm 14. FIG. 8 is a top view and FIG. 9 is a side sectional view of the modified moment arm resistance mechanism 300 shown in FIG. 7. This modified moment arm resistance mechanism 300 comprises cable attachment 313, moment arm 314, guide rails 315, weight 316, weight adjusting drive 318, weight adjusting mechanism supports 320, pivot point 322, and weight adjusting motor 324. Moment arm 314 is secured to moment arm pivot rod 252 and extends generally normal to the axis of moment arm pivot rod 252. Thus, moment arm 314 acts as a cantilever extending from moment arm pivot rod 252, and the combination of moment arm 314 and moment arm pivot rod 252 can rotate about the axis of moment arm pivot rod 252.

FIG. 8 illustrates that guide rails 315 extend between and are secured to weight adjusting mechanism supports 320 so as to form the general skeletal structure of moment arm 314. Cable attachment 313 is secured to weight adjusting mechanism support 320 on arcing endpivot point end 346 of moment arm 314 and weight adjusting motor 324 is secured to weight adjusting mechanism support 320 on pivot point end 348 of moment arm 314 proximal to moment arm pivot rod 252. Weight adjusting drive 318 extends from weight adjusting motor 324 between and generally parallel to guide rails 315 and is rotationally journaled into weight adjusting mechanism support 320 on arcing endpivot point end 346 of moment arm 314. Weight 316 is slidably supported on guide rails 315 and can travel between weight adjusting mechanism supports 320.

FIG. 9 is a sectional side view of a weight 316 and weight adjusting drive 318 that can be used with the present invention. Weight 316 comprises internal passage 352 extending therethrough from one side to an opposite side. Internal passage 352 can be a smooth bore with no screw thread in which the diameter of internal passage 352 is greater than the outer diameter of the screw thread 354 of weight adjusting drive 318 such that weight adjusting drive 318 can slide into and through internal passage 352. One or more threaded nuts 350 are inserted into internal passage 352 and secured by known means, such as, but not limited to, friction, adhesives, welding, soldering, clips, a flange that is part of the nut 350 itself and screwed into the weight 316, and the like. Weight adjusting drive 318, and particularly screw thread 354 of weight adjusting drive 318 cooperates with screw thread 356 of nut 350 such that when weight adjusting drive 318 is rotated, weight 316 will move relatively along weight adjusting drive 318. Alternatively, at least a portion of internal passage 352 can comprise a thread to cooperate with screw thread 354 of weight adjusting drive 318. Weight adjusting drive 318 is operatively connected to weight adjusting motor 324 and to weight 316 and can be used to transfer the motion generated by weight adjusting motor 324 to weight 316 and move weight along guide rails 315 of moment arm 314. Weight adjusting motor 324 turns weight adjusting device 318, and screw threads, 354, 356 cooperate to move weight 316 back and forth along moment arm 314.

Weight 316 causes a moment about pivot point 322, thus urging a rotation of moment arm pivot rod 252 about its axis. The size of the moment is related to the position of weight 316 on moment arm 314. Specifically, if weight 316 is proximal to pivot point end 348 the moment, and thus the ultimate weight value presented to user U, is smaller and if weight 316 is proximal to arcing endpivot point end 346 the moment, and thus the ultimate weight value presented to user U, is larger. As moment arm pivot rod 252 is rotationally urged, a downward tensional force is created on main cable 302. The tensional force on main cable 302 is imparted ultimately to pushing handle 16, which imparts a pushing force on user U grasping pushing handle 16. This creates the pushing sensation and weight resistance of the invention.

As shown in additional detail in FIGS. 10-13, treadmill 10 has a lower base 12 housing the internal mechanical components of treadmill 10. Projecting upwardly from base 12 is console support structure 200. At least one console arm 212A, and preferably two console arms 212A, 212B, extend rearward from console support structure 200 proximal to an upright 210. Pushing arm 14 (which includes pushing arms 14A, 14B), on which pushing handle 16 (which includes pushing handles 16A, 16B) is mounted, is pivotally mounted on console arm 212A, 212B and is operatively connected to resistance mechanism 300 via or through the frame.

FIG. 10 is a perspective view of an embodiment of the invention with the various covers and facades removed to better show the internal positioning of the cables 302, 326 and pulleys 304, 306, 308. FIG. 11 is similar to FIG. 10, but from a different perspective angle. FIG. 12 is a side view of the embodiment of the invention shown in FIGS. 10 and 11. In these views, resistance mechanism 300 is located between console support uprights 210 and in the resting position and with weight 316 in a first, lesser weight (lesser resistance), position. As can be seen from these figures, moment arm 314 is pivotally attached to a first of uprights 210 via pivot rod 252 using pivot rod supports 253. Main cable 302 travels from pushing arm 16A through left console arm 212A to directional pulley 304A, down first upright 210A to lifting pulley 308, back up first upright 210A to first console pulley 306A, across console 212 to second console pulley 306B and into second upright 210B, down second upright 210B to second directional pulley 304B and third directional pulley 304C, through right console arm 212B, and ultimately is attached to pushing arm 16B.

When main cable 302 is pulled and released by user U via pushing handles 16, causing an imparting and release of tension on main cable 302 respectively, lifting pulley 308 is lifted, imparting and releasing tension on secondary cable 326, thereby pivoting moment arm 314 upwards and downwards respectively relative to pivot rod 252. A stop (not shown) can be placed on second upright 210 or on motor housing 32 on which moment arm 314 can rest in the resting position shown in these figures. In the resting mode, moment arm 314 is in an angled down position and either resting on a support or being supported such that no or a minimal amount of weight or force is being transferred to main cable 302, pushing arm 14 or pushing handles 16, or hanging from main cable 302 such that the tension created by main cable 302 connected to pushing arm 14 prevents the further downward motion of moment arm 14. In the operating mode, moment arm 314 is raised off of the support or stop and can be in any position from immediately above the resting position to the upper limit of travel of the moment arm 314 and still have the same resistance effect.

FIG. 13 is a side view of the embodiment of the invention shown in FIG. 10 with a user gripping the pushing handles 16 and using the invention in the pushing mode. In this figure, it can be seen that main cable 302 travels down first upright 210A, around lifting pulley 308 and back up first upright 210A to console pulley 306. In this figure, user U is shown as pushing on pushing handles 16, thus rotating pushing arm 14 and imparting tension on main cable 302, thus pulling upwardly on lifting pulley 308, thus applying tension on secondary cable 326. This, in turn, lifts the arcing end 346 of moment arm 314. This figure illustrates user U involved in a typical pushing exercise.

FIG. 13 also shows the general components and structural layout of the treadmill 10 when in use. User U stands on the treadmill 10, specifically belt 20, and grips pushing handles 16, which extend from pushing arms 14. Pushing arm 14 is operationally connected to resistance mechanism 300 via main cable 302, pulley system comprising pulleys 304, 306, 308, and secondary cable 326. Pushing handles 16 and pushing arm 14 are shown imparting tension on main cable 302, thus pulling upwardly on lifting pulley 308. FIG. 13 focuses in on the operative relationship between pushing arm 14 and moment arm 314 in what is termed the operating mode. In this mode, pushing arm 14 is being pushed by a user, thus pivoting and pulling on the main cable 302. Main cable 302 is pulled through directional pulleys 304 and console pulleys 306 so as to direct or redirect main cable 302 from pushing arm 14 ultimately to secondary cable 326. In one illustrative embodiment, main cable 302 travels through (and within the interior of) console 212 and upright 210 for aesthetics and safety purposes. As main cable 302 is pulled, the attachment to moment arm 314 causes moment arm 314 to rotate or pivot about moment arm pivot rod 252 upwards into the operating position. Release of pushing handles 16, that is allowing pushing handles 16 to return towards the resting position, has the opposite rotational effect.

FIGS. 14-17 illustrate the operation of the embodiment of the invention shown in FIG. 10 showing moment arm 314 and pushing arm 14/pushing handles 16 in various operating positions and with weight 316 in a greater weight (greater resistance) position. FIG. 14 is front view and FIG. 15 is a top view showing resistance mechanism 300 in the resting mode. In these views, pushing handles 16 are not being pushed. FIG. 16 is a front view showing resistance mechanism 300 in a partially raised operating mode. In this view, pushing handles 16 are being pushed approximately one half of their available travel distance. FIG. 17 is front view showing resistance mechanism 300 in a fully raised operating mode. In this view, pushing handles 16 are being pushed approximately their entire available travel distance. The series of FIGS. 14-17 illustrates the action of main cable 302/secondary cable 326 in raising resistance mechanism 300 as pushing handles 16 are pushed by user U.

FIG. 18 is a perspective view of an embodiment of representative controls located on pushing handles 16 for the invention. Various controls and information displays can be located on each or both of pushing handles 16 and/or on console 212 individually or in a redundant manner. As can be seen, controls for grade, load, speed, and stopping the machine can be located on the pushing handles 16 for ease of operation. Various combinations of controls can be located on pushing handles 16 and/or console 212

FIG. 19 is a side view of a user U using the invention in a typical treadmill manner in an inclined forward uphill walking or running mode. In this view and mode, the pushing handles 16 and the resistance mechanism 300 are not being used.

FIGS. 20-24 illustrate several exemplary alternate embodiments of the invention. FIG. 20 is a perspective view of an alternate embodiment of the invention having a pushing bar 16C, rather than two separate pushing handles 16A, 16B, pivotally connected to both console arms 212A, 212B. In this embodiment, user US pushes on pushing bar 16C, which activates resistance mechanism 300. This embodiment can comprise a simplified cable and pulley configuration. As shown, main cable 302 can attach directly to pushing arm 14, loop over a single directional pulley 306 and then connect directly to cable attachment 313. Thus, pushing the pushing bar 16C, a direct cable connection is made to moment arm 314 without the need for lifting pulley 308 or secondary cable 326. A lifting pulley 308 and secondary cable 326 can be used if desired to step down the effect of pushing bar 16C. Additionally, a separate attachment of main cable 302 to a second pushing arm 14B is unnecessary. Similarly, an accessory configured like pushing bar 16C can be supplied, which accessory can fit over pushing handles 16A, 16B and act as pushing bar 16C.

FIG. 21 is a side view of an alternate embodiment of the invention having pivoting uprights 210 in the resting position in which the uprights 210 and console 212 pivot. FIG. 22 is a side view of the alternate embodiment shown in FIG. 21 in the operating position. In these views, pushing handle 16 (or pushing bar 16C) is rigidly attached to console arm 212A. When user U pushes on pushing handle 16, the entire console structure 200 comprised of pushing handle 16, console arm 212A (and console arm 212B), console 212, and uprights 210 pivots forward about console pivot point 390. Main cable 302 is attached to lower frame 34 via cable attachment 310, travels upwards to and around directional pulley 304A, around directional pulley 304B and downwards to directly connect to cable attachment 313 located at an end of moment arm 314. Thus, pushing the pushing handle 16 (or pushing bar 16C) causes the console structure 200 to pivot forward and cable 302 to lift moment arm 314. This embodiment also allows for a direct cable connection to moment arm 314 without the need for lifting pulley 308 or secondary cable 326. A lifting pulley 308 and secondary cable 326 can be used if desired to step down the effect of pushing bar 16C. Additionally, a separate attachment of main cable 302 to a second pushing arm 14B is unnecessary.

FIG. 23 is a side view of an alternate embodiment of the invention having sliding uprights in the resting position in which the uprights and console slide. FIG. 24 is a side view of the alternate embodiment shown in FIG. 23 in the operating position. In these views, pushing handle 16 (or pushing bar 16C) is rigidly attached to console arm 212A. When user U pushes on pushing handle 16, the entire console structure 200 comprised of pushing handle 16, console arm 212A (and console arm 212B), console 212, and uprights 210 slides forward along slide(s) 392 between resting stop 394 and extended stop 396. A bearing 391 is located at the bottom of each upright 210 and cooperates with slide 392 to allow console to slide along slide 392. Bearing can be any conventional bearing device, including ball bearings, roller bearing, and low friction bearings, to name a few. Main cable 302 is attached to lower frame 34 via cable attachment 310, travels upwards to and around directional pulley 304A, around directional pulley 304B and downwards to directly connect to cable attachment 313 located at an end of moment arm 314. Thus, pushing the pushing handle 16 (or pushing bar 16C) causes the console structure 200 to slide forward and cable 302 to lift moment arm 314. This embodiment allows for a direct cable connection to moment arm 314 without the need for lifting pulley 308 or secondary cable 326. A lifting pulley 308 and secondary cable 326 can be used if desired to step down the effect of pushing bar 16C. Additionally, a separate attachment of main cable 302 to a second pushing arm 14B is unnecessary. Console locking pin 398 can be used to lock the console structure 200 in the resting position. Analogous locking pins can be included in any of the embodiments to lock the pushing arms 14, pushing handles 16, and/or pushing bars 16C with minor engineering changes.

FIG. 25 is a side view, partly in section, of an alternate pneumatic resistance mechanism 400 in the resting position. In this embodiment, resistance mechanism 400 is a pneumatic mechanism comprising pneumatic cylinder 402, air compressor 404, and various connecting hoses 406. In known pneumatic mechanisms, the resistance of pneumatic cylinder 402 can be set to certain values corresponding to a known resistance by the setting of compressor 404 (the higher the pressure of the compressed air produced by compressor 404, the higher the resistance of pneumatic cylinder 402, and the higher the equivalent resistance). Similarly, the resistance mechanism can be a hydraulic cylinder and the air a fluid. Pneumatic cylinder 402 is attached to the frame of the device and cylinder rod 408 is attached to rod pulley 410. Pushing on pushing handles 16 ultimately, via cabling and pulleys as disclosed previously, pushes cylinder rod 408 into pneumatic cylinder 402, with the air within pneumatic cylinder 402 providing resistance. The use of a pneumatic cylinder 402 with known or adjustable resistance is known and can be used to provide a basis for determining the simulated resistance (weight) being pushed by user U. FIG. 26 is a side view, partly in section, of the alternate pneumatic resistance mechanism 400 in a resistance position.

FIG. 27 is a front view, partly in section, of an alternate electric motor clutch brake resistance mechanism 500. In this embodiment, resistance mechanism 500 is an electric motor and braking system comprising electric motor 502 and brake assembly 504. In known systems of this type, electric motor 502 imparts a force through brake assembly 504 to movable pushing handles 16, which can correspond to a known resistance by the power supplied to motor 502 or to brake assembly 504. Motor 502 is attached to the frame of the device and brake assembly 504 is attached to cam 512. When motor 502 is actuated, cam 512 is rotated, thus ultimately, via cabling and pulleys as disclosed previously, pulling on pushing arm 14 providing resistance to user U holding pushing handles 16. The use of a brake assembly 504 with known or adjustable resistance is known and can be used to provide a basis for determining the simulated resistance being pushed by user U.

The invention also can be structured so as to provide both a pulling and a pulling exercise regimen via the same console or handle(s). FIGS. 28-41 illustrate several illustrative examples of a single device that can be used for both pushing and pulling regimens. The basic components of the pushing/pulling devices are the same as or analogous to the basic components of the pulling-only and pushing-only devices. For example, the treadmill lower base 12, treadmill motor, endless belt 20, belt platform 34, lever legs 36, and other basic components disclosed above can be used in the pushing/pulling devices. Likewise, the moment arm weight resistance mechanism 300 disclosed above can be used in the pushing/pulling devices. The console and handle structures and operations of the pushing/pulling devices are different and are disclosed below.

FIG. 28 is a perspective left side front view of an alternate embodiment of the invention 10 having a sliding pushing and pulling console support structure 200 such that the user can select or alternate between a pushing regimen and a pulling regimen. FIG. 29 is a left side view of the embodiment of FIG. 28 shown in the neutral position with the load resting. This embodiment is similar to that embodiment shown in FIGS. 23 and 24 but with the addition of the novel pushing and pulling ability. Thus, in this embodiment, the uprights 210 and console support structure 200 slide forwards and backwards along slide 392. In this view, pushing and pulling means 16 (the equivalent of pushing handle 16 or pushing bar 16C) is rigidly attached to the console support structure 200.

FIGS. 28 and 29 illustrates the position of console 200 in the neutral or resting position in which the user U is neither pushing nor pulling on pushing and pulling means 16 and moment arm 314 is in the resting position. Console support structure 200 is located generally centrally along slide(s) 392, approximately equidistant between pulling stop 394 and pushing stop 396. Main cable 302 is attached to lower frame 34 via cable attachment 310, travels upwards through two cooperating fixed pulleys 304D, 304E, to and around a directional pulley 304A, and downwards to directly connect to cable attachment 313 located at an end of moment arm 314. In this embodiment, directional pulley 304A and fixed pulleys 304D, 304E are attached to console upright 210 and travel along with console support structure 200, as disclosed below, while cable attachment 310 is attached to lower frame 34 and remains at a fixed position. Preferably, directional pulley 304A, fixed pulleys 304D, 304E, and cable attachment 310 lie approximately in the same vertical plane. Also preferably, directional pulley 304A and fixed pulleys 304D, 304E are located and centered vertically above cable attachment 310 in the resting or neutral position, which will result in moment arm 314 being in the lowest (unlifted) position when the device 10 is in the resting or neutral position.

FIG. 30 is a left side view of the embodiment of FIG. 28 shown in the pulling position in which the load is engaged. When user U pulls on pushing and pulling means 16, while walking in a rearwards direction, the entire console structure comprised of pushing and pulling means 16, console support structure 200, and uprights 210 slides backward along slide(s) 392 towards pulling stop 394. Thus, pulling the pushing and pulling means 16 causes the console structure to slide backwards and cable 302 to lift moment arm 314. The two cooperating fixed pulleys 304D, 304E maintain the cable 302 in proper alignment when being acted on by the movement of the console support structure 200. Specifically, as can be seen in FIG. 30, when console support structure 200 is pulled backwards, cable 302 engages the front fixed pulley 304D. The lifting of moment arm 314 causes a weight resistance to be applied to the console support structure 200, and therefore to user U, as user U is walking or running backwards. Thus, in this regimen, the treadmill 10 is activated in the rearwards walking mode and the user U pulls on the pushing and pulling means 16. When the console support structure 200 is pulled backwards, the cable 302 engages the forwardmost of the fixed cable pulleys 304D, which causes the cable 302 to pull upwards on the weight resistance mechanism 300.

FIG. 31 is a left side view of the embodiment of FIG. 28 shown in the pushing position in which the load is engaged. Analogously to the disclosure given in connection with FIG. 30 above, when user U pushes on pushing and pulling means 16, while walking in a forwards direction, the entire console structure comprised of pushing and pulling means 16, console support structure 200, and uprights 210 slides forward along slide(s) 392 towards pushing stop 396. Thus, pushing the pushing and pulling means 16 causes the console structure to slide forwards and cable 302 to lift moment arm 314. The two cooperating fixed pulleys 304D, 304E maintain the cable 302 in proper alignment when being acted on by the movement of the console support structure 200. Specifically, as can be seen in FIG. 31, when console support structure 200 is pushed forwards, cable 302 engages the rear fixed pulley 304E. The lifting of moment arm 314 causes a weight resistance to be applied to the console support structure 200, and therefore to user U, as user U is walking or running forwards. Thus, in this regimen, the treadmill 10 is activated in the forwards walking mode and the user U pushes on the pushing and pulling means 16. When the console support structure 200 is pushed forwards, the cable 302 engages the rearwardmost of the fixed cable pulleys 304E, which causes the cable 302 to pull upwards on the weight resistance mechanism 300.

This embodiment allows for a direct cable connection to moment arm 314 without the need for a lifting pulley or a secondary cable. A lifting pulley and secondary cable can be used if desired to step down the effect of pushing and pulling means 16. The two fixed pulleys 304D, 304E and the directional pulley 304A preferably are mounted on the inner side of the upright 210. The moment arm resistance mechanism 300 is mounted on one of the uprights 210 and preferably in a position in front of the uprights 210, and not directly between the uprights 210 as in other embodiments.

FIG. 32 is a right side view of the embodiment of FIG. 28 shown in the neutral position with the load resting. Although this embodiment has been disclosed with the cable 302, the pulleys 304A, 304D, 304E, and the cable attachment 310 on the left side of the device, they alternatively can be located on the right side of the device.

FIG. 33 is a perspective view in partial cutaway of an alternate embodiment of the invention having independent handles 16A, 16B. Handles 16A, 16B are pivotally attached to console arms 212A, 212B, respectively, which in turn are attached to console uprights 210. In this embodiment, console support structure 212 is rigidly attached to lower frame 34 and does not pivot or slide. In this embodiment, the user U pushes forward on handles 16A, 16B while walking in a forwards direction to effect a pushing regimen and pulls on handles 16A, 16B while walking in a backwards direction to effect a pulling regimen.

FIG. 33 illustrates the position of handles 16A, 16B in the neutral or resting position in which the user U is neither pushing nor pulling on handles 16A, 16B and moment arm 314 is in the resting position. Handles 16A, 16B are in the neutral, generally upright position, relative to console arms 212A, 212B. In this position, no weight resistance is being transferred to the handles 16A, 16B or to the user U.

Main cable 302 is attached to handle 16A at one end and handle 16B at the other end. Main cable 302 follows a path between handles 16A, 16B through console arms 212A, 212B, uprights 210, and console 212. For example, main cable 302 is attached at one end to handle 16A, travels through two directional pulleys 304F, 304G proximal to handle 16A, through console arm 212A to directional pulley 304H proximal to upright 210A, through upright 210A to lifting pulley 308, back up through upright 210A to directional pulley 304J at a first side of console 212, through and across console 212 to directional pulley 304K at a second side of console 212, through directional pulley 304L proximal to upright 210B, through console arm 212B to directional pulleys 304M, 304N proximal to handle 16B, and is attached to handle 16B at the other end. This cable path allows handles 16A, 16B to cooperate in lifting moment arm 314, but also allow each handle 16A, 16B to operate independently in lifting moment arm 314. As can be seen, and also with reference to FIGS. 34 and 35, pushing or pulling on handles 16A, 16B will result in the tensioning of main cable 302, which will result in the lifting of lifting pulley 308, which in turn will result in the pulling of secondary cable 326, thereby lifting moment arm 314, thus imparting a weight resistance to main cable 302 and, as a result to handles 16A, 16B, which will impart a weight resistance to user U. Such a weight resistance will be imparted both upon the pushing of handles 16A, 16*b* and the pulling of handles 16A, 16B.

FIG. 34 is a left side view of the embodiment of FIG. 33 shown in the pushing position in which the load is engaged. When user U pushes on handles 16A, 16B, while walking in a forwards direction, main cable 302 is pulled (placed in tension). The two cooperating fixed directional pulleys 304F, 304G maintain the main cable 302 in proper alignment when being acted on by handle 16A and the two cooperating fixed directional pulleys 304M, 304N maintain the main cable 302 in proper alignment when being acted upon by handle 16B. Directional pulleys 304H, 304J, 304K, 304L direct main cable 302 from and to handles 16A, 16B through console arms 212A, 212B, through uprights 210A, 210B, and through console 212. The tensioning of main cable 302 causes the lifting of lifting cable 308, and thus the lifting of moment arm 314, which causes a weight resistance to be applied to main cable 302, and therefore to handles 16A, 16B, and therefore to user U, as user U is walking or running forwards. Thus, in this regimen, the treadmill 10 is activated in the forwards walking mode and the user U pushes on handles 16A, 16B. In this mode, when the handles 16A,16B are pushed forwards, the cable 302 engages all four directional pulleys 304F, 304G, 304M, 304N proximal to handles 16A, 16B.

FIG. 35 is a left side view of the embodiment of FIG. 33 shown in the pulling position in which the load is engaged. Analogously to the disclosure given in connection with FIG. 34 above, when user U pulls on handles 16A, 16B, while walking in a backwards direction, main cable 302 also is pulled (placed in tension). The fixed directional pulley 304G maintains the main cable 302 in proper alignment when being acted on by handle 16A and the fixed directional pulley 304M maintains the main cable 302 in proper alignment when being acted upon by handle 16B. Directional pulleys 304H, 304J, 304K, 304L direct main cable 302 from and to handles 16A, 16B through console arms 212A, 212B, through uprights 210A, 210B, and through console 212. The tensioning of main cable 302 causes the lifting of lifting cable 308, and thus the lifting of moment arm 314, which causes a weight resistance to be applied to main cable 302, and therefore to handles 16A, 16B, and therefore to user U, as user U is walking or running backwards. Thus, in this regimen, the treadmill 10 is activated in the backwards walking mode and the user U pulls on handles 16A, 16B. In this mode, when the handles 16A, 16B are pulled backwards, the cable 302 engages only two directional pulleys 304G, 304M proximal to handles 16A, 16B.

This embodiment allows for a cable connection to moment arm 314 via a lifting pulley 308, but without the need for a secondary cable. A secondary cable can be used if desired to step down the effect of handles 16A, 16B. The fixed directional pulleys 304F, 304G, 304H, 304J, 304K, 304L, 304M, 304N preferably are fixedly mounted within console arms 212A, 212B, uprights 210A, 210B, and console 212. The moment arm resistance mechanism 300 is mounted on one of the uprights 210 and preferably in a position in front of the uprights 210, and not directly between the uprights 210 as in other embodiments.

FIG. 36 is a perspective view in partial cutaway of an alternate embodiment of the invention having a single handle 16. The operation of this embodiment is similar to the operation of the embodiment disclosed in connection with FIGS. 33-35, but with a simpler main cable 302 path. Handle 16 is a single bar that is pivotally attached to console arms 212A, 212B, respectively, which in turn are attached to console uprights 210. In this embodiment, console support structure 212 is rigidly attached to lower frame 34 and does not pivot or slide. In this embodiment, the user U pushes forward on handle 16 while walking in a forwards direction to effect a pushing regimen and pulls on handle 16 while walking in a backwards direction to effect a pulling regimen.

FIG. 36 illustrates the position of handle 16 in the neutral or resting position in which the user U is neither pushing nor pulling on handle 16 and moment arm 314 is in the resting position. Handle 16 is in the neutral, generally upright position, relative to console arms 212A, 212B. In this position, no weight resistance is being transferred to the handle 16 or to the user U.

Main cable 302 is attached to handle 16 at both ends of handle 16. Main cable 302 follows a path between the ends of handle 16 through console arm 212A to weight resistance mechanism 300. For example, main cable 302 is attached at one end to a first end of handle 16, travels through two directional pulleys 304F, 304G proximal to the first end of handle 16, through console arm 212A to directional pulley 304H proximal to upright 210A, through upright 210A to cable attachment 313. As can be seen, and also with reference to FIGS. 37 and 38, pushing or pulling on handle 16 will result in the tensioning of main cable 302, which will result in the lifting of moment arm 314, thus imparting a weight resistance to main cable 302 and, as a result to handle 16, which will impart a weight resistance to user U. Such a weight resistance will be imparted both upon the pushing of handle 16 and the pulling of handle 16.

FIG. 37 is a left side view of the embodiment of FIG. 36 shown in the pushing position in which the load is engaged. When user U pushes on handle 16 while walking in a forwards direction, main cable 302 is pulled (placed in tension). The two cooperating fixed directional pulleys 304F, 304G maintain the main cable 302 in proper alignment when being acted on by handle 16. Directional pulley 304H directs main cable 302 to moment arm 314. The tensioning of main cable 302 causes the lifting of moment arm 314, which causes a weight resistance to be applied to main cable 302, and therefore to handle 16, and therefore to user U, as user U is walking or running forwards. Thus, in this regimen, the treadmill 10 is activated in the forwards walking mode and the user U pushes on handle 16. In this mode, when the handle 16 is pushed forwards, the cable 302 engages two directional pulleys 304F, 304G proximal to handle 16.

FIG. 38 is a left side view of the embodiment of FIG. 36 shown in the pulling position in which the load is engaged. Analogously to the disclosure given in connection with FIG. 37 above, when user U pulls on handle 16 while walking in a backwards direction, main cable 302 also is pulled (placed in tension). The fixed directional pulley 304G maintains the main cable 302 in proper alignment when being acted on by handle 16. Directional pulley 304H directs main cable 302 to moment arm 314. The tensioning of main cable 302 causes the lifting of moment arm 314, which causes a weight resistance to be applied to main cable 302, and therefore to handle 16, and therefore to user U, as user U is walking or running backwards. Thus, in this regimen, the treadmill 10 is activated in the backwards walking mode and the user U pulls on handle 16. In this mode, when the handle 16 is pulled backwards, the cable 302 engages only one directional pulleys 304G proximal to handle 16.

This embodiment also allows for a cable connection to moment arm 314 without the need for a lifting pulley or a secondary cable. A lifting pulley and/or secondary cable can be used if desired to step down the effect of handle 16. The fixed directional pulleys 304F, 304G, 304H preferably are fixedly mounted within console arm 212A and upright 210A. The moment arm resistance mechanism 300 is mounted on one of the uprights 210 and preferably in a position in front of the uprights 210, and not directly between the uprights 210 as in other embodiments.

FIG. 39 is a perspective left side view of an alternate embodiment of the invention having a pivoting pushing and pulling console support structure 200 This embodiment comprises pivoting uprights 210, which are pivotally attached to lower frame 34 at pivot points 390 via known means, such as bearings or journals. In operation, a user pushes or pulls upon handle 16, thus pivoting console support structure 200 forwards or backwards, respectively, while walking forwards or backwards, respectively.

FIGS. 39 and 40 illustrate this embodiment in the resting or neutral position in which console support structure 200 is generally upright or slightly leaning rearward. Preferably, directional pulley 304A and directional pulleys 304A, 304B are located and centered vertically above cable attachment 310 in the resting or neutral position, which will result in moment arm 314 being in the lowest (unlifted) position when the device 10 is in the resting or neutral position.

FIG. 41 is a side view of the alternate embodiment shown in FIGS. 39 and 40 in the pushing position. In these views, handle 16 is rigidly attached to console arms 212A, 212B. When user U pushes on handle 16, the entire console structure 200 comprised of handle 16, console arms 212A, 212B, console 212, and uprights 210 pivots forward about console pivot point 390. Main cable 302 is attached to lower frame 34 via cable attachment 310, travels upwards to and around directional pulley 304A, optionally around directional pulley 304B (see FIGS. 40-42) and downwards to directly connect to cable attachment 313 located at an end of moment arm 314. Thus, pushing the handle 16 causes the console structure 200 to pivot forward and cable 302 to lift moment arm 314. This embodiment also allows for a direct cable connection to moment arm 314 without the need for lifting pulley 308 or secondary cable 326. A lifting pulley 308 and secondary cable 326 can be used if desired to step down the effect of handle 16.

FIG. 42 is a side view of the alternate embodiment shown in FIGS. 39 and 40 in the pulling position. In these views, handle 16 is rigidly attached to console arms 212A, 212B. When user U pulls on handle 16, the entire console structure 200 comprised of handle 16, console arms 212A, 212B, console 212, and uprights 210 pivots backward about console pivot point 390. Main cable 302 is attached to lower frame 34 via cable attachment 310, travels upwards to and around directional pulley 304A, optionally around directional pulley 304B (see FIGS. 40-42) and downwards to directly connect to cable attachment 313 located at an end of moment arm 314. Thus, pulling the handle 16 causes the console structure 200 to pivot backward and cable 302 to lift moment arm 314. This embodiment also allows for a direct cable connection to moment arm 314 without the need for lifting pulley 308 or secondary cable 326. A lifting pulley 308 and secondary cable 326 can be used if desired to step down the effect of handle 16.

Treadmill 10 utilizes a known microprocessor (not shown) or other suitable electronic controller to control and operate the various features of the invention. For example, the speed of belt 20, can be controlled by the microprocessor or other suitable electronic controller. The speed is adjustable from controls on pushing and pulling means 16 or console 212 making it possible to vary the speed of belt 20 during the exercise regimen. Further, the inclination of belt 20 also can be controlled by the microprocessor or other suitable electronic controller. For example, the inclination of the base 12, and thus the treadmill 10 can be illustrated by a simple incline mechanism in which a lever leg 36 is rotated by an incline motor to raise and lower base 12. Actuation of the incline motor causes the rotation of lever leg 36 in the desired direction, thus raising or lowering base 21 and belt platform 34, thus causing the decline or incline, respectively, of belt platform 34. The degree of inclination chosen by user U is adjustable from controls on pushing and pulling means 16 or console 212 making it possible to vary the inclination of belt 20 during the exercise regimen.

Additionally connected to the microprocessor or other suitable electronic controller are the various display and other elements of the pushing and pulling means 16 and the console 212. For the sake of simplicity, the signals are transmitted to and from the microprocessor or other suitable electronic controller to the pushing and pulling means 16 and console 212, and are operatively connected to switches, dials, etcetera on the pushing and pulling means 16 and console 212 and the specific elements, such as belt motor, incline motor, and moment arm resistance mechanism 300. Again, the use of this type of microprocessor or other suitable electronic controller is well known in the treadmill art.

The invention also can comprise additional optional features. For example, the invention can comprise a safety mechanism to prevent user U from inadvertently speeding up the movement of belt 20, and from speeding up the movement of belt 20 to a speed faster than what is inputted. In other words, treadmill 10 can further comprise a means for preventing belt 20 from running out from under user U should either user U move too fast relative to belt 20 or belt 20 move too fast relative to user U. This also would help prevent the force of user's U foot plant from undesirably increasing the speed of belt 20. Clutches attached to belt 20 or electronic motor controllers can be used, among other known mechanisms. For another example, step offs optionally can be located on the sides and ends of the base 12 and can be a substantial width to allow for a wider platform for user U to step onto or step off of treadmill 10. Side rails and kill switches also can be used. Heart rate monitors can be used, and the microprocessor, or other suitable electronic controllers, can be configured to allow for heart rate monitoring and for the adjustment of belt 20 speed and incline and the level of weight resistance to maintain a desired heart rate.

In stark contrast to known treadmills, the present invention accomplishes a different exercise regimen than an aerobic walking or running workout. The use of a resistance mechanism 300 for simulating the pushing and pulling of a load in combination with a walking or running motion, and the ability to switch back and forth between a pushing regimen and a pulling regimen during the same exercise session, provides a more complex exercise regimen. It has been found that the combination of walking or running in conjunction with the simulation of pushing or pulling a load provides a useful aerobic and/or anaerobic work out and can strengthen various muscles and muscle groups, specifically leg muscles and the gluteus maximus and also possibly arm, chest, shoulder and back muscles.

Other alternatives and embodiments can comprise one or more of the following features. The treadmill drive motor assembly and incline assembly can be positioned at either end, or in the middle, of the base. The belt platform can incline and decline in both directions, providing incline or decline resistance for both conventional treadmill operation and for reverse treadmill operation. Additionally, the invention can have more common features including the ability to incline and decline at various or continuous degree settings and a belt that moves at various or continuous speeds. Alternative resistance adjusting drives and motors can include electromagnets, mechanical levers, and the like.

In normal operation, user U will step onto belt 20 and grasp pushing and pulling means 16, positioning himself or herself generally centrally on belt 20 so as to face console 212. As belt 20 begins to move, user U will start a forward walking or running motion in the direction of the front of treadmill 10, or a backward walking or running motion in the direction of the rear of the treadmill 10, depending on the regimen selected, pushing or pulling, respectively, with belt 20 moving accordingly, such that user U will remain generally in the same position centrally on belt 20 as treadmill 10 is operating. Alternatively, treadmill 10 may be set up to begin to move automatically at a speed according to a value entered from pushing and pulling means 16 or console 212. Alternatively, belt 20 can be in a manual mode, moving only when the user U walks. The pace of the walking or running motion may be increased or decreased depending upon the speed of belt 20. The speed of belt 20 can be controlled by the adjustment of the controls on pushing and pulling means 16 or console 212, along with the adjustment of the inclination of treadmill 10 and other functions and features. Belt 20 also can comprise two belts, one for each foot, as an alternative. The user U pushes on pushing and pulling means 16, which as previously disclosed actuates resistance mechanism 300. User U can adjust the amount or level of resistance, either prior to stepping on the machine or during the exercise routine itself while user U is carrying out the pushing or pulling motion, and can proceed to enjoying a pushing or pulling exercise regimen.

The resistance mechanism can be set by the user U to a specific amount, such as for example 10 kilograms, comparable to known resistance mechanism such as weight stacks. Thus, when user U pushes or pulls on the pushing and pulling means 16, resistance mechanism 300 exerts a counterforce on user U of the set weight, 10 kilograms in this example, or other measure of resistance. The counterforce is static and approximately constant at the set resistance level throughout the entire range of movement of the pushing and pulling means 16, except in some embodiments at the very start of the range of motion when resistance mechanism 300 is resting on a stop. That is, resistance mechanism 300 exerts a counterforce on user U of the set resistance level, 10 kilograms in this example, whether user U has pushed or pulled the pushing and pulling means 16 one centimeter or four centimeters, and this set resistance level is static and approximately constant, at 10 kilograms in this example, unless resistance mechanism 300 is reset to a different amount. Thus, the degree of resistance of resistance mechanism 300 can be controlled by user U to simulate pushing or pulling a weight such that the exercise regimen is similar to walking or running forwards (or backwards) while pushing (or pulling) an object of a weight comparable to the setting of resistance mechanism 300. The higher the setting of resistance mechanism 300, the greater the force acting on pushing and pulling means 16, and the heavier the simulated object being pushed (or pulled). The degree of resistance also is adjustable in that user U can set the specific amount of resistance to any amount within the parameters of resistance mechanism 300 structure prior to and during the exercise regimen, depending on the embodiment of the invention.

In preferred embodiments, the resistance mechanism is a moment arm resistance mechanism 300 comprising modified moment arm 314, adjustable weight 316, and drive mechanism 318, 324 for moving adjustable weight 316 relative to or along moment arm 314. As adjustable weight 316 is adjusted along moment arm 314 relative to pivot point 252 of moment arm 314, the weight resistance of moment arm 314 is increased or decreased, thus simulating the pushing (or pulling) of various or varying load weights. Moment arm 314 is operatively connected to pushing and pulling means 16 via main cable 302, thus transferring the weight resistance effect to user U. Thus, when user U pushes on pushing and pulling means 16 so as to activate moment arm 314, moment arm 314 creates an approximately constant and static counterforce equivalent to the specific weight amount set by user U.

Thus, in a simple form the invention is an exercise machine for simulating a pushing or pulling action comprising an endless movable surface looped around rollers or pulleys to form an upper run and a lower run, the movable surface being rotated when one of the rollers or pulleys is rotated, thereby creating an exercise surface for walking or running, the improvement comprising (a) a constant, adjustable, one directional resistance means that produces a load or force for simulating a pushing or pulling action and (b) one or more handle(s) that is/are operatively attached to the resistance means that the user can grasp and push or pull while walking or running forwards or backwards on the treadmill to simulate the pushing or pulling action, wherein the moment arm weight resistance mechanism is located preferably and generally between the two uprights of the console support structure and is pivotally attached at a first end to a first of the uprights and is pivotally acted upon at a second end proximal to the second of the uprights.

The endless movable surface also can be operable as a conventional walking or running treadmill. The exercise machine also can comprise a grade or elevation adjustment mechanism for adjusting the walking or running surface between various incline, flat and decline positions.

The resistance means can be produced by any of the following means: leverage, moment arm or cantilevered members coupled with one or more solid, semi-solid or liquid filled mass(s); electric motors, electronic or eddy current brakes; one or more metal or other solid mass weights; pneumatics or hydraulics; various types of springs, friction members, flexible rods, tension devices, or the like; and any combination thereof.

The console and/or pushing and pulling means can comprise controls for manipulating the various functions of the machine by the user such as but not limited to: the direction of travel of the walking/running surface, the speed of the walking/running surface, the grade or elevation of the walking/running surface, the amount of force of the resistance system applied to the pushing and pulling means, and informational data useful to the user. The machine function controls and informational data also may be contained on one or more stationary housing(s) on any part of the fixed frame.

The exercise machine of the present invention can simulate a pushing action by the following illustrative method:

A user steps onto a moveable endless surface looped around rollers on either end as with known treadmills and grasps the pushing and pulling means that is/are operatively connected to a resistance means that produces a constant, adjustable, one directional resistance against the pushing and pulling means;

The user manipulates the controls of the machine such that the endless moveable surface moves in the direction opposite to that the user is facing causing the user to walk or run in a forwards direction;

While walking or running forwards, the user pushes on the pushing and pulling means, which in turn actuates the resistance means, which imparts a constant, adjustable one directional resistance on the pushing and pulling means in a direction towards the user, that is, in a direction opposite the force of the resistance on the pushing and pulling means;

While continuing to walk or run forwards, the user then either can hold the pushing and pulling means, and thus the console, in a fixed position anywhere in the moveable range of motion of the pushing and pulling means to simulate a pushing action or can push on and release the force against the pushing and pulling means to produce a pushing action for the duration of the exercise period; and Throughout the duration of the exercise period, the user can manipulate all functions and informational data of the machine via controls contained on the pushing and pulling means and or mounted on a stationary portion of the frame of the machine.

The exercise machine of the present invention can simulate a pulling action by the following illustrative method:

A user steps onto a moveable endless surface looped around rollers on either end as with known treadmills and grasps pushing and pulling means that is/are operatively connected to a resistance means that produces a constant, adjustable, one directional resistance against the pushing and pulling means;

The user manipulates the controls of the machine such that the endless moveable surface moves in the direction the same as that the user is facing causing the user to walk or run in a backwards direction;

While walking or running backwards, the user pulls on the pushing and pulling means, which in turn actuates the resistance means, which imparts a constant, adjustable one directional resistance on the pushing and pulling means in a direction away from the user, that is, in a direction the same as the force of the resistance on the pushing and pulling means;

While continuing to walk or run backwards, the user then either can hold the pushing and pulling means, and thus the console, in a fixed position anywhere in the moveable range of motion of the pushing and pulling means to simulate a pulling action or can pull on and release the force against the pushing and pulling means to produce a pulling action for the duration of the exercise period; and Throughout the duration of the exercise period, the user can manipulate all functions and informational data of the machine via controls contained on the pushing and pulling means and or mounted on a stationary portion of the frame of the machine.

While the invention has been described in connection with certain preferred embodiments, it is not intended to limit the spirit or scope of the invention to the particular forms set forth, but is intended to cover such alternatives, modifications, and equivalents as may be included within the true spirit and scope of the invention as defined by the appended claims.

What is claimed is:

1. An exercise treadmill having a movable surface for walking or running while exercising, comprising:

a) a resistance mechanism for providing a resistance for simulating the pushing or pulling of a load, wherein the resistance can be adjusted and set to a specific resistance setting, wherein the resistance mechanism is a moment arm weight resistance means comprising:

i) a cantilevered moment arm pivotally attached to an upright at a pivot point;

ii) an adjustable weight attached to the moment arm; and iii) a weight adjusting drive for adjusting the adjustable weight along the moment arm, wherein the position of the adjustable weight along the moment arm creates a moment about the pivot point; and b) a movable pushing and pulling means operatively attached to the resistance mechanism, whereby movement of the pushing and pulling means actuates the resistance mechanism, wherein the movable surface moves in a direction simulating walking or running forwards and backwards, wherein the resistance mechanism exerts an approximately constant and static counterforce to the pushing and pulling means generally only in the same direction as an upper run of the movable surface is moving and opposite a direction of the pushing and pulling means, and whereby operation of the treadmill simulates the pushing or pulling of a load by a combination of (i) gripping and pushing or pulling the pushing and pulling means in a pushing or pulling direction, respectively, to actuate the resistance mechanism to simulate the load and (ii) the walking or running forward or backward on the movable surface, to provide the pushing or pulling action, respectively.

2. The exercise treadmill as claimed in claim 1, wherein the counterforce is static and approximately constant at a set resistance level throughout an entire range of movement of the movable pushing and pulling means.

3. The exercise treadmill as claimed in claim 1, wherein the resistance mechanism can be set to a chosen resistance level that is adjustable for providing resistance only against the pushing or pulling direction.

4. The exercise treadmill as claimed in claim 1, further comprising an inclination mechanism to permit inclination of the exercise surface to simulate an incline or decline.

5. The exercise treadmill as claimed in claim 1, further comprising a console support structure, wherein the pushing and pulling means is operatively connected to the resistance mechanism via the console support structure.

6. The exercise treadmill as claimed in claim 5, wherein the console support structure rests in a neutral position unless and until acted upon by the gripping and pushing or pulling of the pushing and pulling means.

7. The exercise treadmill as claimed in claim 6, wherein the resistance mechanism is unactuated when the console support structure is in the neutral position.

8. The exercise treadmill as claimed in claim 5, further comprising a locking means, wherein the console support structure can be locked in a neutral position by the locking means.

9. The exercise treadmill as claimed in claim 5, wherein the console support structure is slidable.

10. The exercise treadmill as claimed in claim 1, further comprising a console support structure, wherein the pushing and pulling means is operatively connected to the resistance mechanism via a cable.

11. The exercise treadmill as claimed in claim 1, wherein the pushing and pulling means comprises a handle rigidly attached to a movable console support structure and wherein movement of the console support structure actuates the resistance mechanism.

12. The exercise treadmill as claimed in claim 1, wherein the pushing and pulling means is movable both in a forward and in a backward direction relative to the direction of motion of the movable surface.

13. The exercise treadmill as claimed in claim 1, wherein the pushing and pulling means is movable between a first at rest position and a second fully extended position and can be maintained at any position between the first at rest position and the second fully extended position.

14. The exercise treadmill as claimed in claim 1, wherein at least a portion of the moment arm weight resistance means is pivotable about the pivot point.

15. The exercise treadmill as claimed in claim 1, further comprising:

c) a belt, the movable surface comprising the belt; and d) a motor for moving the belt, wherein the movable surface is moved by the motor in a direction simulating walking or running forwards and backwards, whereby movement of the pushing and pulling means in the pushing or pulling direction actuates the resistance mechanism, and whereby operation of the treadmill simulates the pushing or pulling of a load by a combination of (i) gripping and pushing or pulling the pushing and pulling means in the pushing or pulling direction to actuate the resistance mechanism to simulate the load and (ii) the walking or running forward or backward on the movable surface, as the movable surface is being moved by the motor, to provide the pushing or pulling action, respectively.

* * * * *